US009488957B2

(12) United States Patent
Sato et al.

(10) Patent No.: US 9,488,957 B2
(45) Date of Patent: Nov. 8, 2016

(54) VERTICAL ARRANGEMENT OF COMPONENTS IN AN IMAGE FORMING APPARATUS

(71) Applicant: Brother Kogyo Kabushiki Kaisha, Nagoya-shi, Aichi-ken (JP)

(72) Inventors: Shougo Sato, Seto (JP); Keisuke Takahashi, Nagoya (JP); Kazutoshi Kotama, Toyota (JP); Hikaru Yoshizumi, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/056,159

(22) Filed: Feb. 29, 2016

(65) Prior Publication Data

US 2016/0179052 A1 Jun. 23, 2016

Related U.S. Application Data

(63) Continuation of application No. 14/458,394, filed on Aug. 13, 2014, now Pat. No. 9,274,498.

(30) Foreign Application Priority Data

Aug. 13, 2013 (JP) ..... 2013-168348
Aug. 13, 2013 (JP) ..... 2013-168350

(51) Int. Cl.
*G03G 15/00* (2006.01)
*G03G 21/18* (2006.01)

(52) U.S. Cl.
CPC ..... *G03G 21/18* (2013.01)

(58) Field of Classification Search
CPC ..... G03G 21/18; G03G 21/1623; G03G 21/1604
USPC ..... 399/111, 107
See application file for complete search history.

(56) References Cited

U.S. PATENT DOCUMENTS 4,500,195 A * 2/1985 Hosono ..... G03G 15/01 399/111
7,729,637 B2 6/2010 Sato (Continued)

FOREIGN PATENT DOCUMENTS

JP H05-341587 A 12/1993
JP 2004-240198 A 8/2004

(Continued)

*Primary Examiner* — Susan Lee
(74) *Attorney, Agent, or Firm* — Banner & Witcoff, Ltd.

(57) ABSTRACT

An image forming apparatus into the casing, and the exposure unit is disposed on the one side in the second direction of the includes a an image forming unit, the image forming unit including a toner accommodation portion. The image forming apparatus further includes a detachable sheet feed cassette that is disposed at a lower part of the casing, a pickup roller, a sheet conveying path, and a sheet discharge path. The pickup roller and the toner accommodation portion are positioned at heights that at least partially overlap one another (e.g., when viewed in a horizontal direction). In some arrangements, the sheet conveying path passes between the toner accommodation portion and the sheet feed cassette. Moreover, the image forming apparatus may include a scanner unit, wherein the toner accommodation portion and the scanner unit are arranged at positions where at least a part of the toner accommodation portion overlaps the scanner unit when viewed in horizontal direction.

18 Claims, 23 Drawing Sheets

(56) References Cited

U.S. PATENT DOCUMENTS

| | | | | |
|---|---|---|---|---|
| 8,103,187 | B2 * | 1/2012 | Sato | G03G 21/1676 399/120 |
| 2002/0181968 | A1 | 12/2002 | Okimura et al. | |
| 2002/0186986 | A1 | 12/2002 | Makihira | |
| 2004/0161260 | A1 | 8/2004 | Sato | |
| 2005/0141916 | A1 | 6/2005 | Arimitsu et al. | |
| 2005/0276629 | A1 * | 12/2005 | Ahn | G03G 21/1853 399/111 |
| 2007/0160381 | A1 * | 7/2007 | Sato | G03G 21/1638 399/111 |
| 2010/0172678 | A1 | 7/2010 | Kim | |
| 2011/0236054 | A1 * | 9/2011 | Mori | G03G 21/1623 399/101 |
| 2012/0070185 | A1 | 3/2012 | Yokota | |
| 2012/0195629 | A1 * | 8/2012 | Imai | G03G 21/1814 399/111 |
| 2012/0207511 | A1 * | 8/2012 | Sato | G03G 21/1633 399/110 |
| 2012/0320392 | A1 | 12/2012 | Asaoka | |
| 2013/0209135 | A1 | 8/2013 | Tsuchiya | |
| 2013/0259518 | A1 | 10/2013 | Miwa | |
| 2013/0266341 | A1 | 10/2013 | Sato | |

FOREIGN PATENT DOCUMENTS

| | | | |
|---|---|---|---|
| JP | 2005-017425 | A | 1/2005 |
| JP | 2005-128087 | A | 5/2005 |

* cited by examiner

200

VERTICAL ARRANGEMENT OF COMPONENTS IN AN IMAGE FORMING APPARATUS

CROSS-REFERENCE TO RELATED APPLICATION

This application is a continuation of U.S. patent application Ser. No. 14/458,394 filed Aug. 13, 2014 which claims priority from Japanese Patent Application Nos. 2013-168348 and 2013-168350, both filed on Aug. 13, 2013, the entire subject matters of which are incorporated herein by reference.

TECHNICAL FIELD

Aspects of the present invention relate to an image forming apparatus which employs an electro-photographic method.

BACKGROUND

A related-art electro-photographic image forming apparatus includes a sheet feed cassette which accommodates recording sheets, a sheet feed roller which is disposed on the front upper side with respect to the sheet feed cassette, an image forming section which is disposed on the rear upper side with respect to the sheet feed roller, a laser scanner which is disposed on the rear upper side with respect to the image forming section, a fixing section which is disposed on the rear side with respect to the image forming section, and a sheet discharge section which is disposed on the upper side with respect to the fixing section (refer to JP-A-2005-17425). The image forming apparatus is configured to transport the recording sheet in a substantially S shape in an apparatus main body.

Incidentally, in recent years, from the viewpoint of a degree of freedom of an installation location or a storage location of an image forming apparatus, size-reduction of the image forming apparatus in a vertical direction is desired. However, in the image forming apparatus disclosed in JP-A-2005-17425, the laser scanner is disposed on the rear upper side with respect to the image forming section, and thus size-reduction in the vertical direction is restricted.

SUMMARY

Accordingly, an aspect of the present invention provides an image forming apparatus which can achieve size-reduction in a vertical direction.

According to an illustrative embodiment of the present invention, there is provided an image forming apparatus comprising a casing, a process unit, a cassette, a first roller, an exposure unit, a fixing unit and a second roller. The process unit is configured to be removably mounted to the casing, and is configured to form a developer image on a recording medium. The process unit includes a photosensitive body extending in a first direction which intersects a vertical direction. The cassette is disposed on a lower side in the vertical direction with respect to the process unit, and is configured to accommodate recording media to be supplied to the process unit. The first roller is disposed on one side in a second direction with respect to the process unit, and is configured to separate the recording media in the cassette one by one. The second direction is substantially perpendicular to the vertical direction and the first direction. The exposure unit is configured to expose the photosensitive body. The fixing unit is disposed on the other side in the second direction with respect to the process unit, and is configured to fix a developer image formed on a recording medium by the photosensitive body. The second roller is disposed on an upper side in the vertical direction with respect to the fixing unit and on the other side in the second direction with respect to the first roller, and is configured to transport the recording medium passed through the fixing unit to an outside of the casing. The casing includes a guide portion which is configured to guide the process unit into the casing. The exposure unit is disposed on the one side in the second direction with respect to the process unit and the guide portion.

According to this configuration, since the exposure unit is disposed on the one side in the second direction with respect to the process unit, the exposure unit and the process unit can be disposed so as to be arranged in the second direction. Therefore, it is possible to achieve size-reduction of the image forming apparatus in the vertical direction.

Further, the guide portion of the casing guides the removing and mounting of the process unit with respect to the casing. Therefore, it is possible to ensure smooth mounting and removing operations of the process unit even if the exposure unit and the process unit are disposed so as to be arranged in the second direction.

As a result, it is possible to achieve size-reduction of the image forming apparatus in the vertical direction and also to ensure smooth mounting and removing operations of the process unit.

According to another illustrative embodiment of the present invention, there is provided an image forming apparatus comprising a process unit, a cassette, a first roller, an exposure unit, a second roller and a transport guide. The process unit is configured to form a developer image on a recording medium, and includes a photosensitive body extending in a first direction which intersects a vertical direction. The cassette is disposed on a lower side in the vertical direction with respect to the process unit, and is configured to accommodate recording media. The first roller is disposed on one side in a second direction with respect to the process unit, and is configured to separate the recording media in the cassette one by one. The second direction is substantially perpendicular to the vertical direction and the first direction. The exposure unit is configured to expose the photosensitive body. The fixing unit is disposed on the other side in the second direction with respect to the process unit, and is configured to fix a developer image transferred on a recording medium from the photosensitive body. The second roller is disposed on an upper side in the vertical direction with respect to the fixing unit and on the other side in the second direction with respect to the first roller, and is configured to transport the recording medium passed through the fixing unit to an outside. The transport guide is configured to guide transport of a recording medium which is directed from the first roller toward the photosensitive body. The exposure unit is disposed on the one side in the second direction with respect to the photosensitive body. The exposure unit and the process unit are disposed to be arranged in the second direction along the transport guide.

According to this configuration, since the exposure unit is disposed on the one side in the second direction with respect to the process unit, and the exposure unit and the process unit are disposed to be arranged in the second direction along the transport guide, it is possible to achieve size-reduction of the image forming apparatus in the vertical direction.

According to the above-described image forming apparatus, it is possible to achieve size-reduction in the vertical direction.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

1. Overall Configuration of Printer

Figure 1:
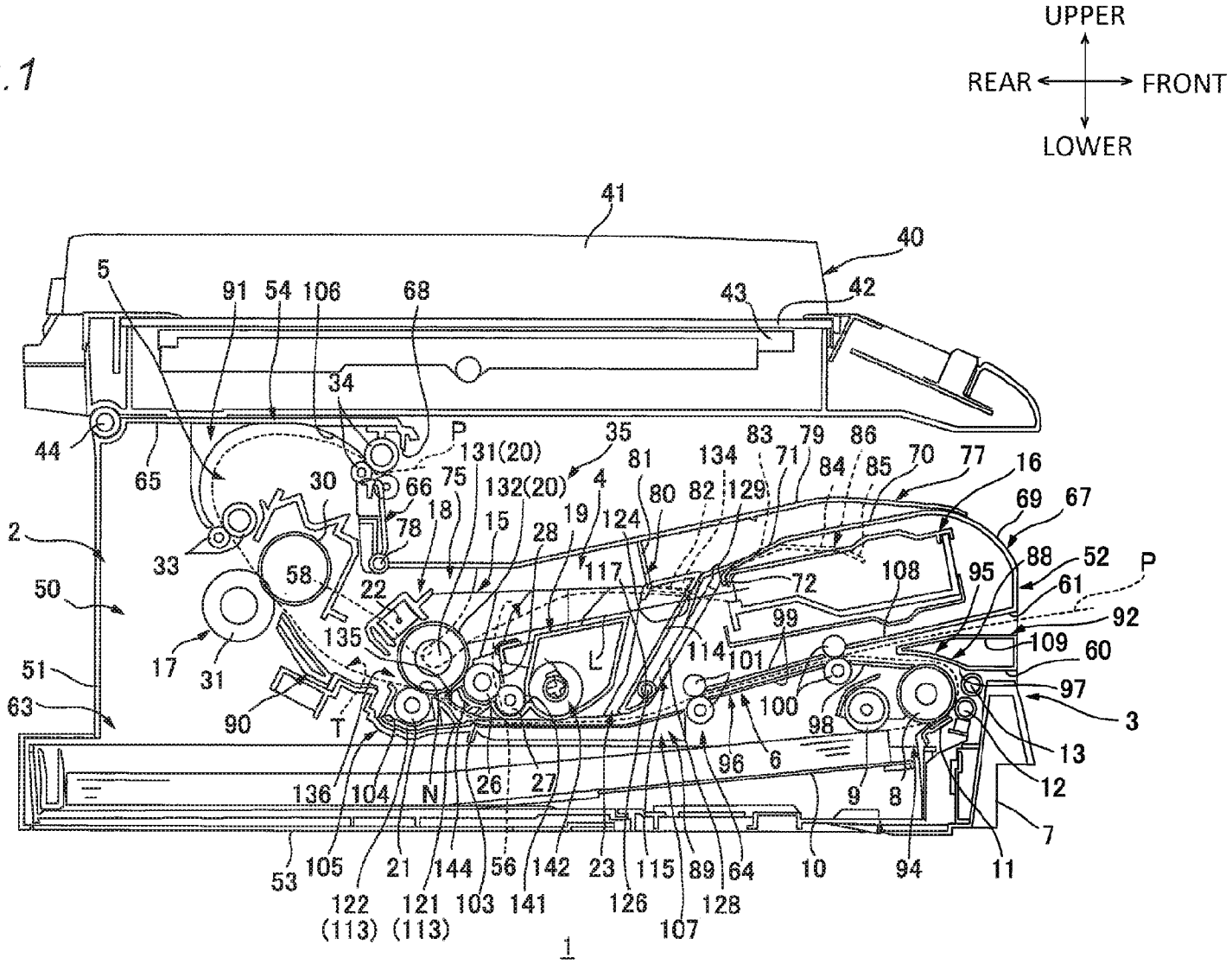
FIG. 1 is a center cross-sectional view showing a printer as an image forming apparatus according to a first illustrative embodiment of the present invention, and shows a state where a process cartridge is located at an internal position.

As shown in FIG. 1, a printer 1 includes a main body casing 2, a sheet feed section 3, an image forming section 4, a sheet discharge section 5, a sheet guide section 6, and a flat bed scanner 40.

In the following description, when directions are mentioned, the right side of FIG. 1 is referred to as the front side, and the left side of FIG. 1 is referred to as the rear side, with a state of the printer 1 being horizontally placed as a reference. Further, with a state of the printer 1 being viewed from the front side as a reference of left and right sides, the front side of FIG. 1 is referred to as the left side, and a back side of FIG. 1 is referred to as the right side. For a process cartridge 15, front and rear sides, left and right sides, and upper and lower sides are defined with a mounted state of the process cartridge 15 in a main body casing 2 (described later) as a reference. Specifically, directions in each drawing are indicated by arrows.

Incidentally, a left-right direction is an example of a first direction, the left side is one side of the first direction, and the right side is the other side of the first direction. Further, a front-rear direction is an example of a second direction, the front side is one side of the second direction, and the rear side is the other side of the second direction. Furthermore, an upper-lower direction is the same direction as a vertical direction, and the front-rear direction and the left-right direction are the same direction as a horizontal direction.

The main body casing 2 has a substantially box shape which extends in the left-right direction, and accommodates the sheet feed section 3, the image forming section 4, the sheet discharge section 5, and the sheet guide section 6 in an inner space thereof.

The sheet feed section 3 supplies a sheet P to the image forming section 4. The sheet feed section 3 is disposed at a lower part in the main body casing 2. The sheet feed section 3 includes a sheet feed cassette 7 and a sheet feed roller 8.

Figure 3:
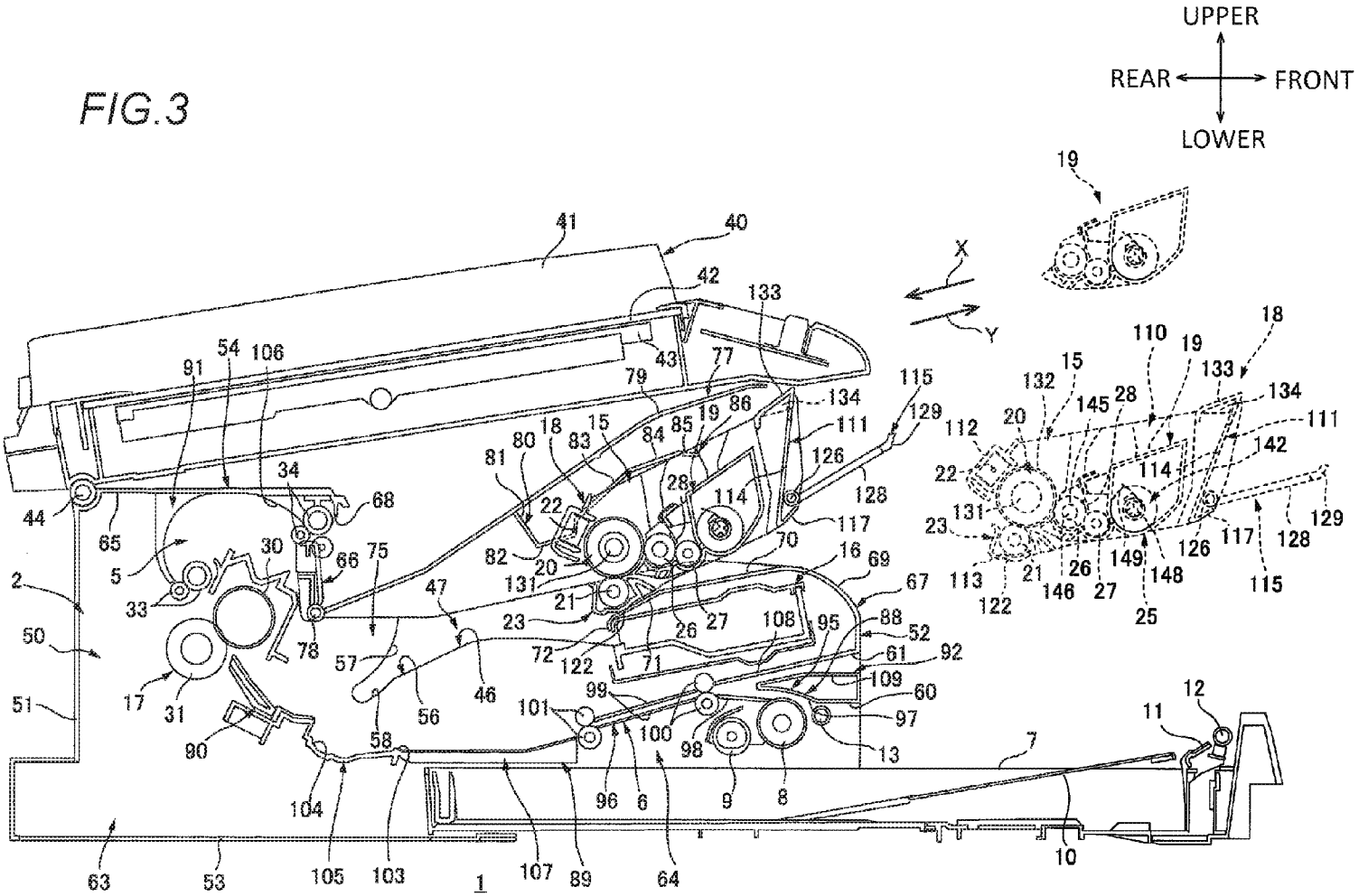
FIG. 3 is a center cross-sectional view of the printer shown in FIG. 1, and shows a state where the process cartridge is located between the extraction position and an external position and a state where the process cartridge is located at the external position.

As shown in FIGS. 1 and 3, the sheet feed cassette 7 is disposed at a lower end in the main body casing 2, and is removably mounted in the main body casing 2. As shown in FIG. 1, the sheet feed cassette 7 has a substantially box shape which is opened upward, and accommodates a plurality of sheets P which are supplied to a process cartridge 15 (described later). Incidentally, although described later in detail, the sheet feed cassette 7 supports a sheet lift 10, a sheet feed pad 11, and a first pinch roller 12.

The sheet feed roller 8 has a substantially columnar shape which extends in the left-right direction. The sheet feed roller 8 is disposed on the upper side with respect to a front end of the sheet feed cassette 7, and is disposed further forward than the process cartridge 15.

The image forming section 4 forms an image on the sheet P. The image forming section 4 is disposed on the upper side of the sheet feed section 3 in the main body casing 2. The image forming section 4 includes the process cartridge 15, a scanner unit 16, and a fixing unit 17.

Although described later in detail, as shown in FIGS. 1 and 3, the process cartridge 15 can be moved between an internal position where the process cartridge 15 lies in the main body casing 2 and an external position where the process cartridge 15 is removed from the main body casing 2. As shown in FIG. 1, in a state of being located at the internal position, the process cartridge 15 is disposed at a substantially center in a side view in the main body casing 2, and is disposed on the upper side with respect to a substantially center part of the sheet feed cassette 7 in the front-rear direction. That is, the sheet feed cassette 7 is disposed on the lower side with respect to the process cartridge 15.

The process cartridge 15 includes a drum cartridge 18 and a developing cartridge 19.

The drum cartridge 18 includes a photosensitive drum 20, a transfer roller 21, and a scorotron charger 22. The photosensitive drum 20 is disposed at a rear end of the drum cartridge 18. The transfer roller 21 is disposed on the lower side of the photosensitive drum 20. An upper end of the transfer roller 21 is in contact with a lower end of the photosensitive drum 20. The scorotron charger 22 is disposed with respect to the photosensitive drum 20 with a slight gap therebetween on the rear upper side of the photosensitive drum 20.

Figure 7A:
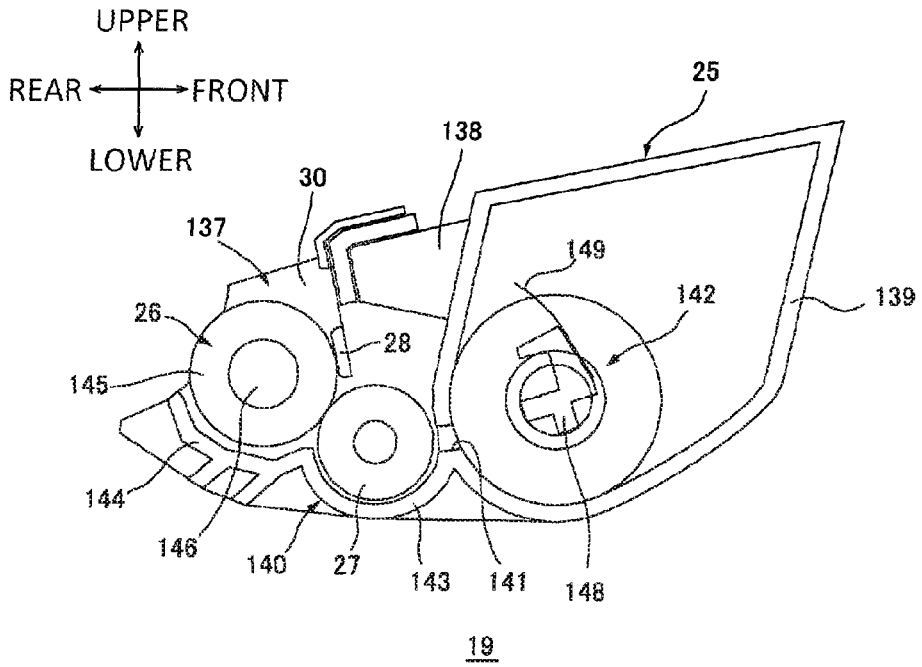
FIG. 7A is a center cross-sectional view of a developing cartridge shown in FIG. 1.

As shown in FIG. 7A, the developing cartridge 19 includes a developing roller 26, a supply roller 27, and a layer thickness regulation blade 28, and accommodates toner.

The developing roller 26 has a substantially columnar shape extending in the left-right direction, and is disposed at a rear end of the developing cartridge 19. An upper part and a rear part of the developing roller 26 are exposed from the developing cartridge 19 as shown in FIG. 1, and a rear upper end of the developing roller 26 is in contact with a front lower end of the photosensitive drum 20.

As shown in FIG. 7A, the supply roller 27 has a substantially columnar shape extending in the left-right direction, and is disposed on the front lower side with respect to the developing roller 26. A rear upper end of the supply roller 27 is in pressing contact with a front lower end of the developing roller 26.

The layer thickness regulation blade 28 is disposed on the front upper side of the developing roller 26. The layer thickness regulation blade 28 has a plate shape extending in the upper-lower direction in a side view. Further, a lower end of the layer thickness regulation blade 28 is in contact with a front end of the developing roller 26.

As shown in FIG. 1, the scanner unit 16 is disposed on the front side with respect to the process cartridge 15, and is disposed on the upper side with respect to the sheet feed roller 8 with an interval therebetween. Specifically, the scanner unit 16 is disposed so as to overlap the process cartridge 15 and the fixing unit 17 when projected in the front-rear direction, and is disposed so as to overlap the sheet feed roller 8 when projected in the upper-lower direction. In addition, the scanner unit 16 is disposed in a direction which connects the front upper side to the rear lower side so as to be inclined downward toward the rear side. Further, the scanner unit 16 emits a laser beam L based on image data toward the photosensitive drum 20 as indicated by a solid line of FIG. 1.

The fixing unit 17 is disposed on the rear upper side with respect to the process cartridge 15 with an interval therebetween. That is, the fixing unit 17 is disposed further rearward than the process cartridge 15. The fixing unit 17 includes a heating roller 30 and a pressing roller 31.

The heating roller 30 is disposed on the rear upper side with respect to the scorotron charger 22 of the process cartridge 15 with an interval therebetween. The pressing roller 31 is disposed on the rear lower side with respect to the heating roller 30. A front upper end of the pressing roller 31 is in pressing contact with a rear lower end of the heating roller 30.

The sheet discharge section 5 is disposed on the upper side with respect to the fixing unit 17. The sheet discharge section 5 includes a pair of guide rollers 33 and a pair of sheet discharge rollers 34.

The pair of guide rollers 33 are disposed on the rear upper side with respect to the fixing unit 17 with an interval therebetween. Each of the pair of guide rollers 33 has a substantially columnar shape extending in the left-right direction, and the guide rollers 33 are in contact with each other in a direction which connects the front upper side to the rear lower side.

The pair of sheet discharge rollers 34 are disposed on the front upper side with respect to the fixing unit 17 with an interval therebetween, and is disposed further rearward than the photosensitive drum 20. That is, the pair of sheet discharge rollers 34 are disposed further upward than the fixing unit 17, and further rearward than the sheet feed roller 8. Each of the pair of sheet discharge rollers 34 has a substantially columnar shape extending in the left-right direction, and the sheet discharge rollers 34 are in contact with each other in a direction which connects the front upper side to the rear lower side.

Although described later in detail, the sheet guide section 6 guides transport of the sheet P so that the sheet P is transported from the sheet feed cassette 7 by the sheet feed roller 8 to reach the sheet discharge rollers 34 through a contact point N between the photosensitive drum 20 and the transfer roller 21. The sheet guide section 6 defines a transport path T in a substantially S shape in a side view.

The flat bed scanner 40 is disposed adjacent to the main body casing 2 on the upper side, and is disposed on the upper side with respect to a sheet discharge tray 35 (described later) with an interval therebetween. The flat bed scanner 40 includes a shaft portion 44, a pressing cover 41, a glass surface 42, and a CCD sensor 43.

The shaft portion 44 is provided at a rear lower end of the flat bed scanner 40. The shaft portion 44 has a substantially columnar shape extending in the left-right direction, and is rotatably supported at a rear upper end of the main body casing 2. Thus, the flat bed scanner 40 swings with respect to the main body casing 2 with the shaft portion 44 as a fulcrum.

The flat bed scanner 40 has a configuration in which an original document is placed between the pressing cover 41 and the glass surface 42, and then image information of the original document is read by the CCD sensor 43.

2. Details of Main Body Casing

As shown in FIG. 3, the main body casing 2 includes a pair of side walls 50, a rear wall 51, a front wall 52, a bottom wall 53, and a top wall 54, which are integrally formed.

The pair of side walls 50 are respectively disposed at both left and right ends of the main body casing 2, and are disposed with an interval therebetween in the left-right direction. Each of the pair of side walls 50 has a substantially L plate shape in a side view. Specifically, a rear part 63 of the side walls 50 has a substantially rectangular shape extending in the upper-lower direction in a side view. A front part 64 of the side walls 50 has a substantially rectangular shape extending in the front-rear direction in a side view, and extends forward from a lower part of a front edge of the rear part 63.

Further, each of the pair of side walls 50 includes a groove 46.

The grooves 46 are disposed on inner surfaces in the left-right direction of the front parts 64 of the respective side walls 50 so as to match each other when projected in the left-right direction. In the present illustrative embodiment, configurations of the grooves 46 are the same as each other in the pair of side walls 50. Therefore, in the following description of the grooves 46, the groove 46 disposed on the right side wall 50 will be described in detail, and description of the groove 46 disposed on the left side wall 50 will be omitted.

The groove 46 is recessed outward in the left-right direction on the inner surface in the left-right direction of the front part 64 of the side wall 50 and is opened upward. The groove 46 includes a first groove 47 and a second groove 56.

The first groove 47 is located at an upper part of the groove 46, and is disposed at an upper part on the inner surface in the left-right direction of the front part 64 of the side wall 50. A front end of the first groove 47 is disposed with respect to the rear part of the scanner unit 16 with an interval therebetween in the left-right direction.

The first groove 47 has a substantially rectangular shape extending in the front-rear direction in a side view, and is recessed downward from an upper edge of the front part 64 of the side wall 50.

The second groove 56 is a lower part of the groove 46, and is connected to a rear lower end of the first groove 47 and extends toward the rear lower side. Thus, the second groove 56 is disposed further rearward than the scanner unit 16.

The second groove 56 includes a large width portion 57 and a small width portion 58 which are integrally formed.

The large width portion 57 extends so as to be inclined rearward downward from the rear part at the lower edge of the first groove 47. A width of the large width portion 57 is reduced toward the rear lower side.

The small width portion 58 is connected to the lower end of the large width portion 57 and extends toward the rear lower side. The small width portion 58 has a substantially arc shape with a center at a rotation shaft 78 (described later) when viewed from the left-right direction. A width of the small width portion 58 is approximately the same as an outer diameter of an end of a drum shaft 131 (described later) in the left-right direction.

The rear wall 51 is disposed at a rear end of the main body casing 2. The rear wall 51 has a substantially rectangular shape extending in the left-right direction when viewed from the rear side. Each of both left and right ends of the rear wall 51 is connected to the rear end of the rear part 63 of each side wall 50.

The front wall 52 is disposed at a front end of the main body casing 2. The front wall 52 has a rectangular shape extending in the left-right direction when viewed from the front side. Each of both left and right ends of the front wall 52 is connected to the front end of the front part 64 of each side wall 50. The front wall 52 includes a cassette opening 60 and a sheet opening 61.

The cassette opening 60 is disposed at a lower end of the front wall 52. The cassette opening 60 has a shape and a size which allow the sheet feed cassette 7 to pass through the cassette opening, and penetrates through the lower end of the front wall 52 in the front-rear direction. The cassette opening 60 allows the sheet feed cassette 7 to pass therethrough when the sheet feed cassette 7 is mounted to or removed from the main body casing 2.

The sheet opening 61 is disposed on the upper side of the cassette opening 60 with an interval therebetween at the front wall 52. The sheet opening 61 has a shape and a size which allow the sheet P to pass through the sheet opening 61, and penetrates through a substantially vertical center part of the front wall 52 in the front-rear direction. Although described later in detail, the sheet opening 61 receives the sheet P which is supplied from outside of the main body casing 2.

The bottom wall 53 is disposed at the lower end of the main body casing 2. The bottom wall 53 has a substantially rectangular plate shape in a bottom view. Each of both left and right ends of the bottom wall 53 is connected to the lower end of each side wall 50, and a rear end of the bottom wall 53 is connected to a lower end of the rear wall 51.

The top wall 54 is disposed at an upper end of the main body casing 2. The top wall 54 includes a flat bed support wall 65, a tray wall 66, and a mounting/removing guide wall 67.

The flat bed support wall 65 is disposed on the upper side of the sheet discharge section 5. The flat bed support wall 65 is connected to the upper end of the rear wall 51, and extends forward and in the left-right direction. Both left and right ends of the flat bed support wall 65 are connected to the upper end of the rear part 63 of each side wall 50. Further, the flat bed support wall 65 is in contact with a rear part of the flat bed scanner 40 from the lower side so as to support the flat bed scanner 40. Further, a connecting part of the flat bed support wall 65 and the rear wall 51 rotatably supports the shaft portion 44 of the flat bed scanner 40.

The tray wall 66 is bent from a front end of the flat bed support wall 65, and extends downward and in the left-right direction. Both left and right ends of the tray wall 66 are connected to the upper part at the front end of the rear part 63 of each side wall 50. The tray wall 66 includes a sheet discharge port 68.

The sheet discharge port 68 is disposed at an upper end of the tray wall 66, and is disposed on the front side of the pair of sheet discharge rollers 34. The sheet discharge port 68 has a shape and a size which allow the sheet P to pass through the sheet discharge port 68, and penetrates through the upper end of the tray wall 66 in the front-rear direction.

The mounting/removing guide wall 67 is disposed on the front side with respect to the tray wall 66 with an interval therebetween, and is disposed on the upper side of the scanner unit 16 so as to cover the scanner unit 16. The mounting/removing guide wall 67 is connected to the upper end of the front wall 52 and extends rearward and in the left-right direction. Specifically, the mounting/removing guide wall 67 includes a curved wall 69, an inclined wall 70, a guide wall 71, and a regulation wall 72 which are integrally formed.

The curved wall 69 is connected to the upper end of the front wall 52, and extends so as to be curved rearward upward. Both left and right ends of the curved wall 69 are connected to the front upper end of the front part 64 of each side wall 50.

The inclined wall 70 is connected to the upper end of the curved wall 69, and extends so as to be inclined downward rearward.

The guide wall 71 is bent from a rear end of the inclined wall 70 so that a downward inclination thereof is larger than that of the inclined wall 70, and extends so as to be inclined downward rearward.

The regulation wall 72 is bent from a rear end of the guide wall 71, and protrudes downward.

Figure 4:
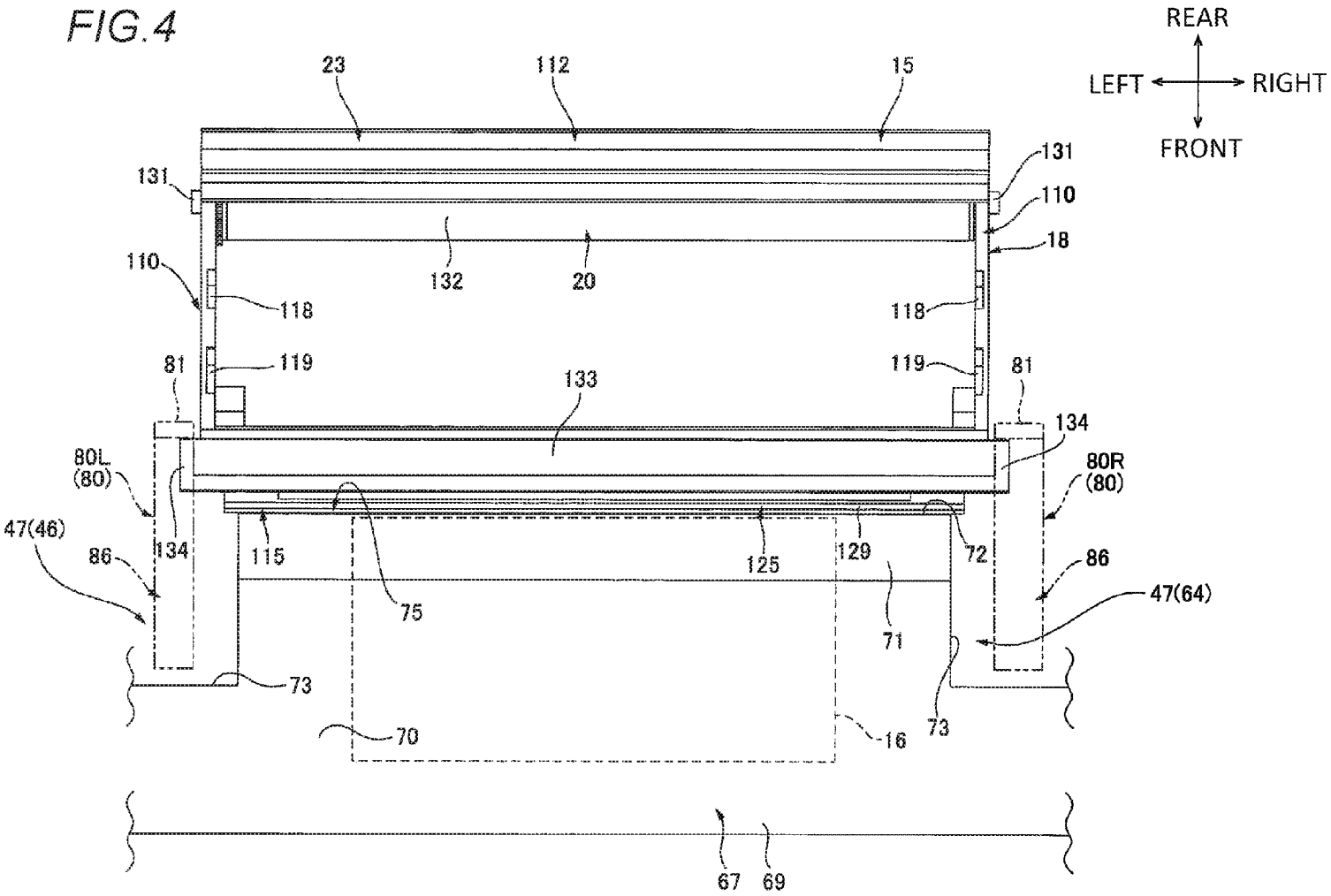
FIG. 4 is a plan view of the printer shown in FIG. 1, and shows a state where a cover body is removed.

In addition, the mounting/removing guide wall 67 includes cutout portions 73 as shown in FIG. 4.

The cutout portions 73 are respectively disposed at the left and right ends of the mounting/removing guide wall 67, so as to correspond to a cover guide 80 (described later). The cutout portions 73 are cut out in a substantially rectangular shape in a plan view from left and right ends of the regulation wall 72 up to an approximately center of the inclined wall 70 in the front-rear direction. Thus, the cutout portions 73 communicate with the front end of the first groove 47 of the main body casing 2 in the upper-lower direction.

As shown in FIG. 1, a process opening 75 is defined by the regulation wall 72, the lower end of the tray wall 66, and the upper end of the front part 64 of each side wall 50 located between the regulation wall 72 and the tray wall 66. That is, the main body casing 2 has the process opening 75.

The process opening 75 has a substantially rectangular shape in a plan view, and allows the inner space of the main body casing 2 to communicate with the outside of the main body casing 2 in the upper-lower direction. The process opening 75 has a size which allows the process cartridge 15 to pass through the process opening 75.

Further, the main body casing 2 includes a top cover 77 for opening and closing the process opening 75.

The top cover 77 includes a rotation shaft 78, a cover body 79, and a cover guide 80.

The rotation shaft 78 has a substantially columnar shape extending in the left-right direction, and is rotatably supported at the lower end of the tray wall 66, that is, at a rear edge of the process opening 75.

The cover body 79 has a plate shape, and extends outward in the radial direction of the rotation shaft 78 from the rotation shaft 78.

The cover guide 80 is disposed at each of both left and right ends in a front part of a lower surface of the cover body 79. Herein, when the left cover guide 80 and the right cover guide 80 are differentiated from each other, the left cover guide 80 is indicated by a left cover guide 80L, and the right cover guide 80 is indicated by a right cover guide 80R.

The cover guide 80 has a substantially L shape in a side view. A dimension of the cover guide 80 in the left-right direction is smaller than a dimension of the cutout portion 73 in the left-right direction as shown in FIG. 4. Further, the cover guide 80 includes a regulation portion 81 and a guide body 86 which are integrally formed as shown in FIG. 1.

The regulation portion 81 is connected to an approximately center part in the front-rear direction at an end of the cover body 79 in the left-right direction and extends toward the front lower side.

The guide body 86 is connected to a lower end of the regulation portion 81 and extends forward. Thus, the guide body 86 is substantially parallel to the cover body 79, and extends so as to be separated from the rotation shaft 78. Specifically, the guide body 86 includes an engagement portion 82, a first cover guide 83, a second cover guide 84, and an introduction portion 85 which are integrally formed.

The engagement portion 82 is connected to the lower end of the regulation portion 81 and extends toward the front lower side, and is then bent so as to extend toward the front upper side.

The first cover guide 83 is bent from a front end of the engagement portion 82 so that a forward inclination is larger than that of a front part of the engagement portion 82, and extends so as to be inclined slightly upward forward.

The second cover guide 84 is bent from a front end of the first cover guide 83, and extends so as to be inclined slightly downward forward.

The introduction portion 85 is bent from a front end of the second cover guide 84, and extends so as to be further inclined slightly downward forward than the second cover guide 84.

Figure 2:
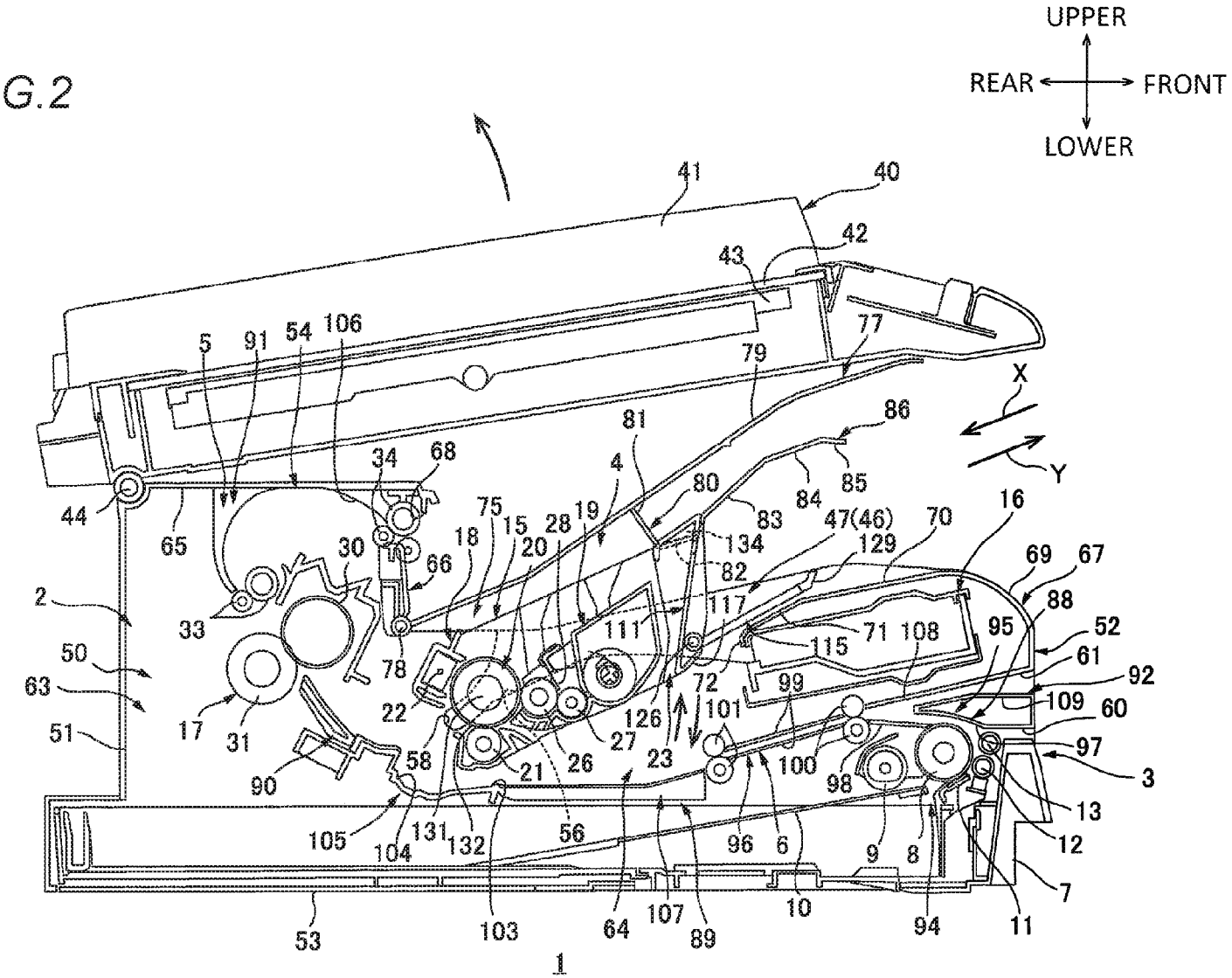
FIG. 2 is a center cross-sectional view of the printer shown in FIG. 1, and shows a state where the process cartridge is located at an extraction position.

The top cover 77 can swing between a closed position where the process opening 75 is closed and an open position where the process opening 75 is opened with the rotation shaft 78 as a fulcrum as shown in FIG. 2.

As shown in FIG. 1, in a state where the top cover 77 is located at the closed position, the cover body 79 is disposed so as to extend forward from the rotation shaft 78, and a front end of the cover body 79 is adjacent to an upper side of the connection part of the curved wall 69 and the inclined wall 70. In a state where the top cover 77 is located at the closed position, the front surface of the tray wall 66 and the upper surface of the cover body 79 configure the sheet discharge tray 35.

Each of both left and right cover guides 80 is disposed inside the first groove 47 of the main body casing 2 via the cutout portion 73 in a state where the top cover 77 is located at the closed position as shown in FIG. 4. Thus, the left cover guide 80L is disposed on the left with respect to the scanner unit 16 with an interval therebetween, and the right cover guide 80R is disposed on the right side with respect to the scanner unit 16 with an interval therebetween. The introduction portion 85 of the guide body 86 overlaps the scanner unit 16 when projected in the left-right direction as shown in FIG. 1.

On the other hand, as shown in FIG. 2, in a state where the top cover 77 is located at the open position, the cover body 79 is disposed in a direction which connects the front upper side and the rear lower side, and the front end of the cover body 79 is disposed on the upper side with respect to the inclined wall 70 with an interval therebetween through which the process cartridge 15 can pass.

The first cover guide 83 of the cover guide 80 is disposed so as to be substantially parallel to the guide wall 71 of the mounting/removing guide wall 67, and the second cover guide 84 is disposed so as to be substantially parallel to the inclined wall 70 of the mounting/removing guide wall 67.

3. Details of Sheet Guide Section

The sheet guide section 6 is disposed in the main body casing 2 as shown in FIG. 1. The sheet guide section 6 includes a first sheet guide 88, a second sheet guide 89, a third sheet guide 90, a fourth sheet guide 91, and a fifth sheet guide 92.

The first sheet guide 88 is a part which is located on the lower side of the scanner unit 16 in the sheet guide section 6, and guides transport of the sheet P which is directed from the sheet feed cassette 7 toward the sheet feed roller 8 and is returned toward the rear upper side. The first sheet guide 88 includes an upstream part 94, a middle part 95, and a downstream part 96.

The upstream part 94 is an upstream part in a transport direction of the sheet P in the first sheet guide 88, and guides transport of the sheet P accommodated in the sheet feed cassette 7, which is directed toward the sheet feed roller 8. The upstream part 94 includes a pickup roller 9, the sheet lift 10, and the sheet feed pad 11.

The pickup roller 9 has a substantially columnar shape extending in the left-right direction, and is disposed on the rear side of the sheet feed roller 8 with an interval therebetween.

The sheet lift 10 has a substantially rectangular plate shape in a plan view, and is disposed at a front part in the sheet feed cassette 7. A front part of the sheet P accommodated in the sheet feed cassette 7 is placed on an upper surface of the sheet lift 10.

The sheet lift 10 can swing with its rear end as a fulcrum, and is biased in a counterclockwise direction in a left side view at all times by a spring member (not shown). That is, a front end of the sheet lift 10 is biased toward the pickup roller 9 by the spring member (not shown). Therefore, the front end of the sheet P placed on the upper surface of the sheet lift 10 is interposed between the front end of the sheet lift 10 and the pickup roller 9.

The sheet feed pad 11 is disposed on the front lower side of the pickup roller 9, and is also disposed on the front lower side of the sheet feed roller 8. The sheet feed pad 11 has a plate shape, and extends in a direction which connects the front upper side to the rear lower side in a side view. An upper surface of the sheet feed pad 11 is in contact with a front lower end of the sheet feed roller 8.

The middle part 95 is a part which is disposed between the upstream part 94 and the downstream part 96 in the first sheet guide 88, and guides transport of the sheet P which is returned by the sheet feed roller 8. The middle part 95 includes a first pinch roller 12, a second pinch roller 13, a curved guide 97, and a linear guide 98.

The first pinch roller 12 is disposed on the front upper side with respect to the sheet feed pad 11, and is also disposed on the front side of the sheet feed roller 8. The first pinch roller 12 has a substantially columnar shape extending in the left-right direction, and a rear end of the first pinch roller 12 is in contact with the front end of the sheet feed roller 8.

The second pinch roller 13 is disposed on the front upper side of the first pinch roller 12, and is also disposed on the front side of the sheet feed roller 8 with an interval therebetween. The second pinch roller 13 has a substantially columnar shape extending in the left-right direction.

The curved guide 97 is disposed on the rear upper side of the second pinch roller 13, and is disposed on the upper side with respect to the upper end of the sheet feed roller 8 with an interval therebetween. The curved guide 97 has a plate shape extending in the front-rear direction, and is curved toward the front upper side in a side view.

The linear guide 98 is disposed on the rear lower side of the curved guide 97 with an interval therebetween, and is disposed to be adjacent to the upper end of the sheet feed roller 8 on the rear side. The linear guide 98 has a plate shape extending in the front-rear direction.

The downstream part 96 is a downstream part in the transport direction of the sheet P in the first sheet guide 88, and guides transport of the sheet P which is directed from the sheet feed roller 8 to the second sheet guide 89. The downstream part 96 includes a pair of first transport rollers 100, a pair of second transport rollers 101, and a pair of inclined guides 99.

The pair of first transport rollers 100 are disposed to be adjacent to the rear end of the linear guide 98 on the rear side, and is also disposed on the lower side of the scanner unit 16. The pair of first transport rollers 100 are disposed further rearward than the sheet feed roller 8. Each of the pair of first transport rollers 100 has a substantially columnar shape extending in the left-right direction, and the first transport rollers 100 are in contact with each other in the upper-lower direction.

The pair of second transport rollers 101 are disposed on the rear lower side with respect to the pair of first transport rollers 100 with an interval therebetween, and is disposed further rearward than the scanner unit 16. Each of the pair of second transport rollers 101 has a substantially columnar shape extending in the left-right direction, and the second transport rollers 101 are in contact with each other in the upper-lower direction.

The pair of inclined guides 99 are disposed between the pair of first transport rollers 100 and the pair of second transport rollers 101. The pair of inclined guides 99 are disposed on the lower side with respect to the rear part of the scanner unit 16, and is disposed approximately along the inclination of the scanner unit 16. Specifically, the pair of inclined guides 99 is inclined downward as proceeding downstream in the transport direction of the sheet P at the downstream part 96.

Each of the pair of inclined guides 99 has a plate shape extending in a direction which connects the front upper side to the rear lower side in a side view, and the inclined guides 99 are disposed with an interval therebetween so as to allow the sheet P to pass therethrough in a direction which connects the front lower side and the rear upper side.

The second sheet guide 89 is a part which is disposed on the lower side of the process cartridge 15 in the sheet guide section 6, and includes a guide part 107 and a reception part 105 which are integrally formed.

The guide part 107 is disposed on the lower side of the developing cartridge 19, and guides transport of the sheet P which is directed from the first sheet guide 88 toward the contact point N between the photosensitive drum 20 and the transfer roller 21 along a sheet feed path 135 (described later).

The guide part 107 is disposed to be adjacent to the pair of second transport rollers 101 on the rear side so as to be connected to a downstream end of the first sheet guide 88 in the transport direction. The second sheet guide 89 extends in the front-rear direction in a side view. The second sheet guide 89 includes a guide protrusion 103.

The guide protrusion 103 is disposed at a rear end of an upper surface of the guide part 107, that is, a downstream end of the guide part 107 in the transport direction of the sheet P.

The guide protrusion 103 corresponds to the sheet feed path 135 (described later), and is disposed on the front lower side of the sheet feed path 135. The guide protrusion 103 has a substantially rectangular shape in a side view, and protrudes upward from the upper surface of the guide part 107.

The reception part 105 is disposed on the lower side of a transfer accommodation wall 113 (described later), and is disposed to be adjacent to the guide part 107 on the rear side. The reception part 105 is connected to the rear end of the guide part 107 and extends rearward. Further, the reception part 105 includes a recess portion 104.

The recess portion 104 is recessed from an upper surface of the reception part 105 toward the rear lower side. The recess portion 104 has a substantially curved shape in a side view, and is disposed along the rear end of the process cartridge 15, specifically, a rear end of a roller accommodation portion 122 (described later).

The third sheet guide 90 is a part which is disposed between the process cartridge 15 and the fixing unit 17 in the sheet guide section 6, and guides transport of the sheet P which passes through the contact point N between the photosensitive drum 20 and the transfer roller 21 and is then directed toward the fixing unit 17. The third sheet guide 90 is connected to the rear end of the reception part 105, and extends toward the rear upper side so as to be directed toward the fixing unit 17.

The fourth sheet guide 91 is a part which is disposed between the pair of guide rollers 33 and the pair of sheet discharge rollers 34 in the sheet guide section 6, and guides transport of the sheet P which passes through the pair of guide rollers 33 and is then returned to the pair of sheet discharge rollers 34. The fourth sheet guide 91 is disposed on the lower side of the flat bed support wall 65, and protrudes downward from the front part of the lower surface of the flat bed support wall 65. The fourth sheet guide 91 includes a concave portion 106.

The concave portion 106 has a substantially U shape which is opened toward the front lower side in a side view, and is recessed toward the rear upper side from the lower end of the fourth sheet guide 91. A rear end of the concave portion 106 is disposed on the upper side of the pair of guide rollers 33, and a front end of the concave portion 106 is disposed on the rear side of the pair of sheet discharge rollers 34.

The fifth sheet guide 92 is disposed on the upper side of the middle part 95 of the first sheet guide 88 and the lower side of the front part of the scanner unit 16, at the front end of the main body casing 2. The fifth sheet guide 92 guides transport of the sheet P which is supplied from outside of the main body casing 2 via the sheet opening 61 and is directed toward the pair of first transport rollers 100. The fifth sheet guide 92 includes an upper plate 108 and a lower plate 109.

The upper plate 108 extends toward the rear lower side from an upper edge of the sheet opening 61 of the front wall 52 to the first transport rollers 100 on the upper side in a side view. A rear part of the upper plate 108 is disposed on the lower side with respect to the front part of the scanner unit 16, and is disposed approximately along the inclination of the scanner unit 16. Further, an inclination of the upper plate 108 is substantially the same as the inclination of the inclined guides 99. That is, the scanner unit 16 is disposed approximately along the upper plate 108 of the fifth sheet guide 92 and the inclined guides 99 of the first sheet guide 88.

The lower plate 109 extends rearward from a lower edge of the sheet opening 61 of the front wall 52, is then bent so as to be substantially parallel to the upper plate 108, and extends toward the rear lower side, in a side view.

A rear end of the lower plate 109 is connected to the rear end of the curved guide 97. Thus, the fifth sheet guide 92 and the middle part 95 of the first sheet guide 88 are connected to each other on the front side of the pair of first transport rollers 100.

4. Details of Process Cartridge

The process cartridge 15 includes the drum cartridge 18 and the developing cartridge 19 as described above.

(1) Drum Cartridge

Figure 5:
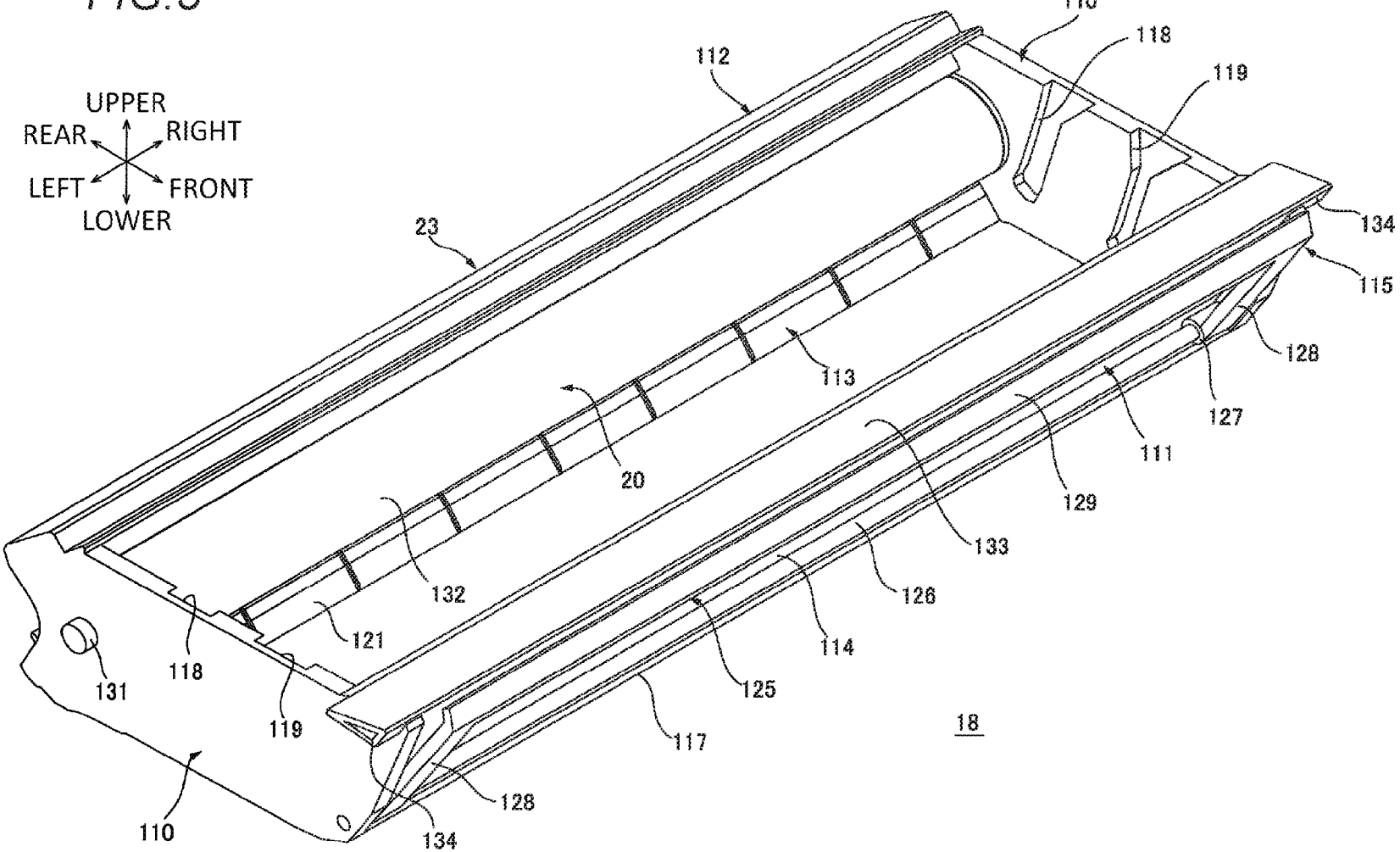
FIG. 5 is a perspective view in which a drum cartridge shown in FIG. 4 is viewed from an upper left side.

The drum cartridge 18 includes a drum frame 23 as shown in FIG. 5. The drum frame 23 has a substantially rectangular frame shape extending in the left-right direction, and includes a pair of drum side walls 110, a drum front wall 111, a charger holding wall 112, and a transfer accommodation wall 113 which are integrally formed.

The pair of drum side walls 110 are respectively disposed at both left and right ends of the drum frame 23, and are disposed with an interval therebetween in the left-right direction. Each of the pair of drum side walls 110 has a substantially rectangular plate shape extending in the front-rear direction in a side view. Each of the pair of drum side walls 110 includes a first roller reception groove 118, a second roller reception groove 119, and a protrusion 134.

The first roller reception groove 118 and the second roller reception groove 119 are disposed on an inner surface of each of the drum side walls 110 in the left-right direction.

Figure 6:
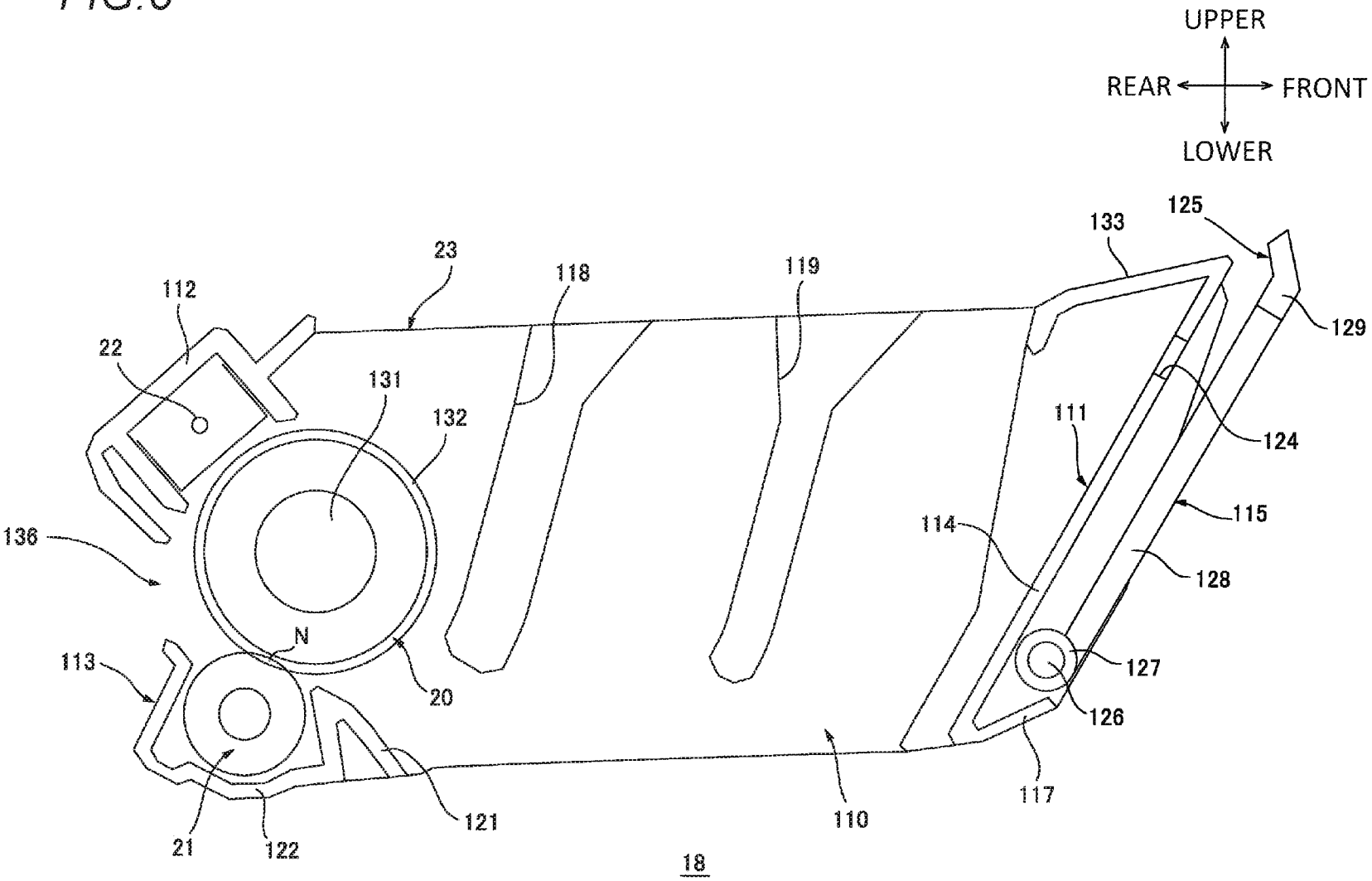
FIG. 6 is a center cross-sectional view of the drum cartridge shown in FIG. 5.

The first roller reception groove 118, as shown in FIG. 6, corresponds to a first roller 147 (described later), and is disposed at a rear part of the inner surface of the drum side wall 110 in the left-right direction. The first roller reception groove 118 is recessed outward in the left-right direction on the inner surface of the drum side wall 110 in the left-right direction, and extends so as to be inclined rearward downward from an upper edge of the drum side wall 110.

The second roller reception groove 119 corresponds to a second roller 150 (described later), and is disposed on the front side of the first roller reception groove 118 with an interval therebetween on the inner surface of the drum side wall 110 in the left-right direction. The second roller reception groove 119 is recessed outward in the left-right direction on the inner surface of the drum side wall 110 in the left-right direction, and extends so as to be inclined rearward downward from an upper edge of the drum side wall 110.

The protrusions 134 are respectively disposed on outer surfaces of the pair of drum side walls 110 in the left-right direction so as to correspond to the two cover guides 80, as shown in FIG. 5. The protrusion 134 has a substantially triangular shape in a side view, and protrudes outward in the left-right direction from a front upper end of the outer surface of each drum side wall 110 in the left-right direction.

A front edge and a lower edge of the protrusion 134 have substantially the same as the shape of the engagement portion 82 of the cover guide 80 in a side view. Specifically, the upper edge of the protrusion 134 extends substantially in the front-rear direction; the front edge of the protrusion 134 extends from a front end of the upper edge of the protrusion 134 toward the rear lower side; and the lower edge of the protrusion 134 extends from a lower end of the front edge of the protrusion 134 toward the rear upper side and is connected to a rear end of the upper edge of the protrusion 134.

The drum front wall 111 is disposed at the front end of the drum frame 23 as shown in FIG. 6. The drum front wall 111 has a substantially Z shape in a side view, and extends in the left-right direction. Each of both left and right ends of the drum front wall 111 is connected to the front end of each drum side wall 110.

The drum front wall 111 includes a front wall body 114, a handle portion 133, and a contact portion 117 which are integrally formed.

The front wall body 114 has a plate shape extending in a direction which connects the front upper side to the rear lower side, and extends in the left-right direction. Each of both left and right ends of the front wall body 114 is connected to a part which is located slightly further rearward than the front edge of each drum side wall 110. Thus, the front end of each drum side wall 110 is located further forward than the front wall body 114. The front wall body 114 includes a laser passing hole 124.

The laser passing hole 124 is disposed on an upper part of the front wall body 114 so as to correspond to a light path of the laser beam L. The laser passing hole 124 has a shape and a size which allow the laser beam L to pass through the laser passing hole 124, and penetrates through the front wall body 114 in the front-rear direction.

The handle portion 133 has a plate shape extending from the upper end of the drum front wall 111 toward the rear lower side, and extends in the left-right direction as shown in FIG. 5. An upper surface of the handle portion 133 is substantially same level as an upper surface of each protrusion 134.

The contact portion 117 has a plate shape which extends from the lower end of the drum front wall 111 toward the front upper side as shown in FIG. 6.

The charger holding wall 112 is disposed at a rear upper end of the drum frame 23. The charger holding wall 112 has a substantially U shape which is opened toward the front lower side in a side view, and extends in the left-right direction. Each of both left and right ends of the charger holding wall 112 is connected to the rear upper end of each drum side wall 110.

The transfer accommodation wall 113 is disposed at the rear lower end of the drum frame 23, and is disposed on the lower side with respect to the charger holding wall 112 with an interval therebetween. The transfer accommodation wall 113 extends in the left-right direction, and is connected to the rear lower end of each drum side wall 110. The transfer accommodation wall 113 includes a roller accommodation portion 122 and a lip portion 121 which are integrally formed.

The roller accommodation portion 122 is a rear part of the transfer accommodation wall 113, and has a substantially U shape which is opened upward in a side view. The lip portion 121 is a front part of the transfer accommodation wall 113, and extends so as to be inclined downward forward from an upper end of a front wall of the roller accommodation portion 122.

An opening region between an upper end of a rear wall of the roller accommodation portion 122 and a lower end of a rear wall of the charger holding wall 112 is defined as a sheet discharge opening 136 for discharging the sheet P which has passed through the contact point N between the photosensitive drum 20 and the transfer roller 21.

The drum cartridge 18 includes the photosensitive drum 20, the transfer roller 21, the scorotron charger 22, and a handle 115.

The photosensitive drum 20 is disposed between the rear ends of the pair of drum side walls 110, and is disposed on the front lower side of the charger holding wall 112 and an upper side of the transfer accommodation wall 113. The photosensitive drum 20 includes a drum body 132 and a drum shaft 131.

The drum body 132 includes a cylindrical portion which has a substantially cylindrical shape extending in the left-right direction and is made of a metal, and a photosensitive layer which is coated over a circumferential surface of the cylindrical portion.

The drum shaft 131 has a substantially columnar shape extending in the left-right direction. A dimension of the drum shaft 131 in the left-right direction is larger than a dimension of the drum body 132 in the left-right direction, and is also larger than a dimension of the drum frame 23 in the left-right direction. The drum shaft 131 is disposed inside the drum body 132 so that a center axis line thereof matches a center axis line of the drum body 132.

Further, the photosensitive drum 20 is rotatably supported at the drum frame 23 while both left and right ends of the drum shaft 131 are supported at the respective drum side walls 110. Each of both left and right ends of the drum shaft 131 protrudes outward in the left-right direction from the drum side wall 110 as shown in FIG. 5.

The transfer roller 21 is disposed inside the roller accommodation portion 122 of the transfer accommodation wall 113 as shown in FIG. 6. The transfer roller 21 has a substantially columnar shape extending in the left-right direction. The transfer roller 21 is rotatably supported at the drum frame 23 while both left and right ends thereof are supported at the respective drum side walls 110. The front upper end of the transfer roller 21 is in contact with the rear lower end of the drum body 132 of the photosensitive drum 20.

The scorotron charger 22 is supported at the charger holding wall 112 inside the charger holding wall 112. Thus, the scorotron charger 22 is disposed with respect to the photosensitive drum 20 on the rear upper side of the photosensitive drum 20 with a slight gap therebetween.

The handle 115 is disposed at the front end of the drum cartridge 18, and is disposed on the front side with respect to the drum front wall 111. Although described later in detail, the handle 115 swings between an accommodation position where the handle 115 stands up along the drum front wall 111 as shown in FIGS. 1 and 4 to 6, and an ejection position where a grip portion 129 (described later) is inclined so as to be separated forward from the drum front wall 111 as shown in FIGS. 2 and 3. Further, the following description will be made with a state where the handle 115 is located at the accommodation position shown in FIGS. 1 and 4 to 6 as a reference.

As shown in FIG. 5, the handle 115 includes a handle body 125 and a swing shaft 126.

The handle body 125 has a substantially U shape which is opened downward in a front view, and includes a pair of cylindrical portions 127, a pair of connection portions 128, and a grip portion 129 which are integrally formed.

The pair of cylindrical portions 127 are disposed with an interval therebetween in the left-right direction. Each of the pair of cylindrical portions 127 has a substantially cylindrical shape extending in the left-right direction. An inner diameter of the cylindrical portion 127 is slightly larger than an outer diameter of the swing shaft 126. Each of the pair of connection portions 128 corresponds to each cylindrical portion 127 as shown in FIG. 6, is connected to the corresponding cylindrical portion 127, and has a substantially rod shape extending toward the front upper side. The grip portion 129 is disposed between upper ends of the pair of connection portions 128. The grip portion 129 has a substantially rod shape extending in the left-right direction, and both left and right ends thereof are connected to the upper ends of the respective connection portions 128.

The swing shaft 126 has a substantially columnar shape extending in the left-right direction. The swing shaft 126 is inserted into the pair of cylindrical portions 127 so as to be relatively rotatable.

The handle 115 is supported at the drum frame 23 while both left and right ends of the swing shaft 126 are supported at the front lower ends of the pair of drum side walls 110.

(2) Developing Cartridge

Figure 7B:
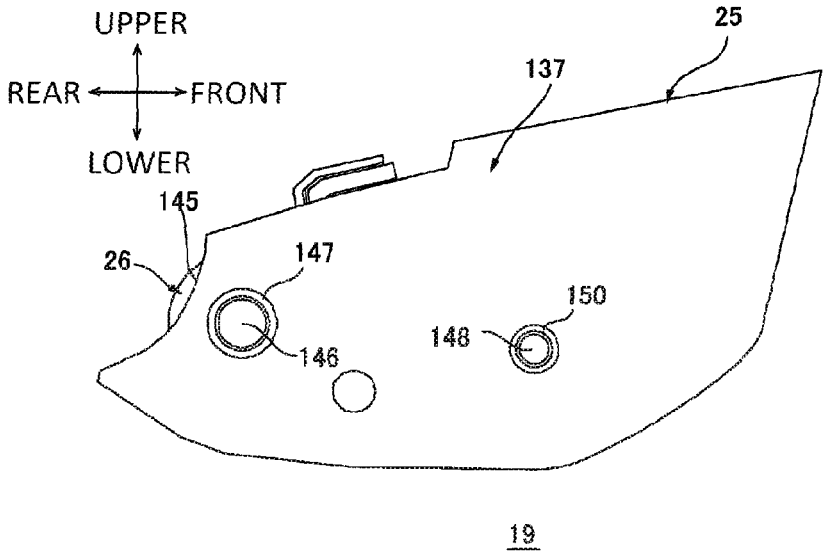
FIG. 7B is a left side view of the developing cartridge shown in FIG. 7A.

The developing cartridge 19 is removably mounted to the drum frame 23 as shown in FIGS. 5 and 7B.

The developing cartridge 19 includes, as shown in FIG. 7A, a developing frame 25, the developing roller 26, the supply roller 27, the layer thickness regulation blade 28, and an agitator 142.

The developing frame 25 includes a pair of developing side walls 137, a toner accommodation portion 139, a blade support portion 138, and a developing bottom wall 140 which are integrally formed.

The pair of developing side walls 137 are disposed at both left and right ends of the developing frame 25, and are disposed with an interval therebetween in the left-right direction. Each of the pair of developing side walls 137 has a substantially rectangular plate shape extending in the front-rear direction in a side view as shown in FIG. 7B.

The toner accommodation portion 139 is disposed between front parts of the pair of developing side walls 137 as shown in FIG. 7A. The toner accommodation portion 139 has a substantially square tubular shape extending in the left-right direction, and both left and right ends thereof are closed by the front part of each developing side wall 137. The toner accommodation portion 139 accommodates toner therein. The toner accommodation portion 139 includes a communication hole 141.

The communication hole 141 is disposed at a lower end of a rear wall of the toner accommodation portion 139, and penetrates through the rear wall of the toner accommodation portion 139 in the front-rear direction.

The blade support portion 138 is disposed at an upper end of a rear surface of a rear wall of the toner accommodation portion 139. The blade support portion 138 has a substantially rectangular shape which protrudes rearward from the rear surface of the rear wall of the toner accommodation portion 139 in a side view.

The developing bottom wall 140 extends rearward from a lower end of the rear wall of the toner accommodation portion 139. Both left and right ends of the developing bottom wall 140 are connected to lower ends of rear parts of the respective developing side walls 137. The developing bottom wall 140 includes a front part 143 and a rear part 144 which are integrally formed.

The front part 143 has a substantially semicircular shape which is opened upward in a side view, and an inner circumferential surface of the front part 143 is curved along an outer circumferential surface of the supply roller 27. A front end of the front part 143 is connected to a lower edge of the communication hole 141 of the rear wall of the toner accommodation portion 139. The rear part 144 extends toward the rear upper side so as to be curved along an outer circumferential surface of the developing roller 26 from a rear end of the front part 143.

The developing roller 26 is disposed on the front upper side of the rear part 144 of the developing bottom wall 140 with an interval therebetween. As shown in FIGS. 7A and 7B, the developing roller 26 includes a roller body 145, a developing roller shaft 146, and the first roller 147.

The roller body 145 is disposed between the rear ends of the pair of developing side walls 137, and has a substantially cylindrical shape extending in the left-right direction. A dimension of the roller body 145 in the left-right direction is slightly smaller than an interval between the pair of developing side walls 137 in the left-right direction.

The developing roller shaft 146 has a substantially columnar shape extending in the left-right direction. A dimension of the developing roller shaft 146 in the left-right direction is larger than a dimension of the developing frame 25 in the left-right direction. The developing roller shaft 146 is fitted in the roller body 145 so that each of both left and right ends protrudes further outward than the roller body 145 in the left-right direction. Both left and right ends of the developing roller shaft 146 are rotatably supported at the developing side walls 137. Thus, the developing roller 26 is rotatably supported at the developing frame 25. Further, each of both left and right ends of the developing roller shaft 146 protrudes outward in the left-right direction from the developing side wall 137.

Two first rollers 147 are provided so as to respectively correspond to both left and right ends of the developing roller shaft 146. Each first roller 147 is disposed outward in the left-right direction with respect to the developing side wall 137. The first roller 147 has a cylindrical shape extending in the left-right direction, and an inner diameter of the first roller 147 is substantially the same as an outer diameter of the developing roller shaft 146. The first roller 147 is fitted in a part which is an end of the developing roller shaft 146 in the left-right direction and is located further outward than the developing side wall 137 in the left-right direction.

The supply roller 27 is disposed inside the front part 143 of the developing bottom wall 140, and is disposed on the rear side of the communication hole 141 of the toner accommodation portion 139. A rear upper end of the supply roller 27 is in contact with a front lower end of the roller body 145. Further, the supply roller 27 is rotatably supported at the developing frame 25 while both left and right ends thereof are supported at the respective developing side walls 137.

The layer thickness regulation blade 28 is fixed to a rear surface of the blade support portion 138. A lower end of the layer thickness regulation blade 28 is in contact with a front end of the roller body 145.

The agitator 142 is disposed at a rear lower end inside the toner accommodation portion 139. The agitator 142 includes an agitator shaft 148, and an agitator blade 149.

The agitator shaft 148 has a substantially columnar shape extending in the left-right direction. A dimension of the agitator shaft 148 in the left-right direction is larger than a dimension of the developing frame 25 in the left-right direction. Both left and right ends of the agitator shaft 148 are rotatably supported at the respective developing side walls 137. Thus, the agitator 142 is rotatably supported at the developing frame 25. Further, each of both left and right ends of the agitator shaft 148 protrudes outward in the left-right direction from the developing side wall 137.

The agitator blade 149 is made of a flexible film material. The agitator blade 149 extends outward in the radial direction of the agitator shaft 148 from a part where the agitator shaft 148 is located inside the toner accommodation portion 139.

Two second rollers 150 are provided so as to respectively correspond to both left and right ends of the agitator shaft 148. Each second roller 150 is disposed outward in the left-right direction with respect to the developing side wall 137. The second roller 150 has a cylindrical shape extending in the left-right direction, and an inner diameter of the second roller 150 is substantially the same as an outer diameter of the agitator shaft 148. The second roller 150 is fitted in a part which is an end of the agitator shaft 148 in the left-right direction and is located further outward in the left-right direction than the developing side wall 137.

This developing cartridge 19 is mounted to the drum frame 23 shown in FIG. 5 from the upper side, for example, by an operator. Specifically, the developing cartridge 19 is mounted to the drum frame 23 so that each first roller 147 is inserted into the corresponding first roller reception groove 118 from the upper side, and each second roller 150 is inserted into the corresponding second roller reception groove 119 from the upper side.

Accordingly, the developing cartridge 19 is mounted to the drum frame 23, so as to configure the process cartridge 15.

In a state where the developing cartridge 19 is mounted to the drum frame 23, as shown in FIG. 1, the developing roller 26 is disposed on the front lower side of the photosensitive drum 20, and the rear upper end of the roller body 145 is in contact with the front lower end of the drum body 132. The rear part 144 of the developing bottom wall 140 is disposed on the front upper side with respect to the lip portion 121 of the transfer accommodation wall 113 with an interval therebetween. Thus, the rear part 144 of the developing bottom wall 140 and the lip portion 121 of the transfer accommodation wall 113 define the sheet feed path 135 for supplying the sheet P to the contact point N between the photosensitive drum 20 and the transfer roller 21.

5. Removing and Mounting Operations of Process Cartridge with Respect to Main Body Casing Next, a removing operation and a mounting operation of the process cartridge 15 with respect to the main body casing 2 will be described.

(1) Removing Operation of Process Cartridge from Main Body Casing

First, a description will be made of a removing operation of the process cartridge 15 from the main body casing 2, that is, a movement of the process cartridge 15 from the internal position to the external position.

As shown in FIG. 1, in a state where the process cartridge 15 is located at the internal position, the rear end of the roller accommodation portion 122 of the drum cartridge 18 is disposed inside the recess portion 104 of the reception part 105, and the left and right ends of the drum shaft 131 are inserted into the lower end of the small width portion 58 of the second groove 56. In the state where the process cartridge 15 is located at the internal position, the protrusion 134 of the drum cartridge 18 is fitted in the engagement portion 82 of the cover guide 80, and the front surface of the grip portion 129 of the handle 115 is in contact with the rear surface of the regulation wall 72 of the mounting/removing guide wall 67. Thus, the handle 115 is located at the accommodation position where the connection portion 128 extends toward the front upper side from the swing shaft 126, and the grip portion 129 is disposed on the upper side with respect to the swing shaft 126 in the main body casing 2.

In order to move the process cartridge 15 from the internal position to the external position, as shown in FIG. 2, the operator swings the flat bed scanner 40 in the counterclockwise direction in a left side view, and also moves the top cover 77 from the closed position to the open position. Incidentally, the movement of the top cover 77 between the closed position and the open position may be interlocked with swing of the flat bed scanner 40 by using a known interlocking mechanism.

At this time, since the protrusion 134 is fitted in the engagement portion 82, the protrusion 134 is moved toward the rear upper side according to a movement of the top cover 77 from the closed position to the open position. Accordingly, the process cartridge 15 is moved toward the front upper side and rotated in the counterclockwise direction in a left side view about the drum shaft 131 while the left and right ends of the drum shaft 131 are guided by the small width portion 58.

Thus, the process cartridge 15 is located on the upper side with respect to the internal position, and the front upper end of the process cartridge 15 is located at the extraction position which lies outside the main body casing 2, via the process opening 75. That is, the small width portion 58 of the second groove 56 guides a movement of the process cartridge 15 from the internal position to the extraction position.

At this time, the handle 115 is inclined so as to be separated forward from the drum front wall 111 with the swing shaft 126 as a fulcrum by the gravity due to release of contact between the grip portion 129 and the regulation wall 72, and swings from the accommodation position to the ejection position. In a state where the handle 115 is located at the ejection position, the grip portion 129 is located further downstream (upstream in a mounting direction X which is a direction from the front upper side toward the rear lower side) in a removing direction Y which is a direction from the rear lower side toward the front upper side than when the handle 115 is located at the accommodation position, and is located on the upper side of the connection part between the inclined wall 70 and the guide wall 71, outside the main body casing 2. The removing direction Y and the mounting direction X are directions intersecting the left-right direction.

That is, the process cartridge 15 is taken out from the internal position to the extraction position in interlocking with the movement of the top cover 77 from the closed position to the open position, and the handle 115 is moved from the accommodation position to the ejection position in interlocking with the movement of the process cartridge 15 from the internal position to the extraction position.

In a state where the top cover 77 is located at the open position, the guide body 86 of the cover guide 80 extends downstream (upstream in the mounting direction X) in the removing direction Y from the lower end of the regulation portion 81.

In other words, the handle 115 and the guide body 86 of the cover guide 80 are disposed further upstream in the mounting direction X than the rotation shaft 78.

Next, the operator, as shown in FIGS. 2 and 3, holds the grip portion 129 of the handle 115 located at the ejection position, and pulls out the process cartridge 15 toward the front upper side.

Accordingly, the protrusion 134 is moved toward the front upper side so as to be separated from the engagement portion 82 of the guide body 86, and is thus moved onto the first cover guide 83. The left-right ends of the drum shaft 131 are moved toward the front upper side, and are moved from the small width portion 58 to the large width portion 57. Further, the first cover guide 83 guides a movement of the protrusion 134, and the lower edge of the large width portion 57 guides a movement of the left-right ends of the drum shaft 131. Thus, the process cartridge 15 is moved toward the front upper side in the removing direction Y while each of the front upper end and the rear end thereof are guided.

Then, the front end of the process cartridge 15, specifically, the contact portion 117 of the drum front wall 111 is brought into contact with the regulation wall 72 of the mounting/removing guide wall 67.

Next, when the operator pulls out the grip portion 129 of the handle 115 further toward the front upper side, the protrusion 134 is moved toward the front upper side, and is moved from on the first cover guide 83 to on the second cover guide 84. The contact portion 117 is moved toward the front upper side so as to reach the guide wall 71, and is slid on the guide wall 71. At this time, the second cover guide 84 guides a movement of the protrusion 134, and the guide wall 71 guides a movement of the contact portion 117.

Thus, the process cartridge 15 is guided further toward the front upper side in the removing direction Y.

Successively, as shown in FIG. 3, when the operator pulls out the grip portion 129 of the handle 115 still further forward, the protrusion 134 is moved forward so as to be moved from on the second cover guide 84 to on the introduction portion 85, and is then separated from the cover guide 80.

At this time, the transfer accommodation wall 113 of the drum frame 23 sequentially reaches the upper side of the guide wall 71 and the inclined wall 70, and is slid on the guide wall 71 and the inclined wall 70. That is, each of the guide wall 71 and the inclined wall 70 guides a movement of the transfer accommodation wall 113. Thus, the rear end of the process cartridge 15 is guided so that the process cartridge 15 is moved forward in the removing direction Y and is removed from the main body casing 2.

Accordingly, the process cartridge 15 is moved from the internal position to the extraction position so as to be then moved from the extraction position downstream (upstream in the mounting direction X) in the removing direction Y and to reach the external position.

That is, the cover guide 80 and the mounting/removing guide wall 67 guide the movement of the process cartridge 15 from the extraction position to the external position.

Successively, the operator moves the top cover 77 from the open position to the closed position, and swings the flat bed scanner 40 in the clockwise direction in a left side view until the flat bed scanner 40 is brought into contact with the flat bed support wall 65.

In the above-described manner, the removing operation of the process cartridge 15 from the main body casing 2 is completed.

(2) Mounting Operation of Process Cartridge to Main Body Casing

In order to mount the process cartridge 15 to the main body casing 2, procedures are performed in a reverse order to the above-described removing operation.

Specifically, as shown in FIG. 3, the operator swings the flat bed scanner 40 in the counterclockwise direction in a left side view, and moves the top cover 77 from the closed position to the open position.

Next, the operator holds the handle portion 133 of the drum cartridge 18 and inserts the process cartridge 15 into the main body casing 2 toward the rear lower side through the process opening 75. At this time, the protrusion 134 is located on the introduction portion 85 of the cover guide 80, and the left and right ends of the drum shaft 131 are received by the large width portion 57 of the second groove 56.

Successively, the operator holds the grip portion 129 of the handle 115, and pushes the process cartridge 15 into the main body casing 2 toward the rear lower side. Therefore, the protrusion 134 reaches the upper side of the first cover guide 83 from the introduction portion 85 via the second cover guide 84, and the left-right ends of the drum shaft 131 reach the continuous part of the large width portion 57 and the second groove 56 along the lower edge of the large width portion 57 of the second groove 56. Thus, the drum cartridge 18 is moved toward the rear lower side in the mounting direction X so as to pass over the inclined wall 70 and the guide wall 71 of the mounting/removing guide wall 67.

As shown in FIG. 2, if the process cartridge 15 is moved further toward the rear lower side, the protrusion 134 reaches the engagement portion 82 so as to be fitted therein, and the rear end of the protrusion 134 is also brought into contact with the regulation portion 81. Further, the left and right ends of the drum shaft 131 reach the continuous part of the large width portion 57 and the small width portion 58.

In the above-described manner, the movement of the drum cartridge 18 from the external position to the extraction position is completed.

That is, the cover guide 80 guides the movement of the process cartridge 15 from the external position to the extraction position.

Next, the operator moves the top cover 77 from the open position to the closed position, and also swings the flat bed scanner 40 in the clockwise direction in a left side view.

At this time, the protrusion 134 is moved toward the rear lower side due to the movement of the top cover 77. Accordingly, the process cartridge 15 is moved toward the rear lower side and rotated in the clockwise direction about the drum shaft 131 in a left side view while the left and right ends of the drum shaft 131 are guided by the small width portion 58. Thus, the process cartridge 15 is moved from the extraction position to the internal position as shown in FIG. 1. That is, the small width portion 58 of the second groove 56 guides the movement of the process cartridge 15 from the extraction position to the internal position.

When the process cartridge 15 is moved from the extraction position to the internal position, the grip portion 129 of the handle 115 is slid on the upper surface of the guide wall 71 of the mounting/removing guide wall 67 as shown in FIG. 2. Thus, the handle 115 is rotated in the counterclockwise direction in a left side view with the swing shaft 126 as a fulcrum so that the grip portion 129 becomes close to the drum front wall 111 from the ejection position.

Further, when the process cartridge 15 reaches the internal position, the handle 115 is located at the accommodation position while the grip portion 129 is disposed to be adjacent to the regulation wall 72 of the mounting/removing guide wall 67 on the rear side.

That is, the process cartridge 15 is moved from the extraction position to the internal position in interlocking with the movement of the top cover 77 from the open position to the closed position, and the handle 115 is moved from the ejection position to the accommodation position in interlocking with the movement of the process cartridge 15 from the extraction position to the internal position.

In the above-described manner, the mounting operation of the process cartridge 15 to the main body casing 2 is completed.

In the state where the process cartridge 15 is located at the internal position, the process cartridge 15 is disposed on the rear side of the scanner unit 16, and is disposed on the upper side with respect to the second sheet guide 89 with a slight interval therebetween. The toner accommodation portion 139, the supply roller 27, the developing roller 26, and the photosensitive drum 20 are sequentially disposed along the second sheet guide 89 from the front side to the rear side.

That is, in the state where the process cartridge 15 is located at the internal position, the scanner unit 16, the toner accommodation portion 139, the supply roller 27, the developing roller 26, and the photosensitive drum 20 are disposed so as to be sequentially arranged in the front-rear direction from the front side to the rear side.

Further, in the state where the process cartridge 15 is located at the internal position, the contact point N between the drum body 132 of the photosensitive drum 20 and the transfer roller 21 is located on the upper side with respect to the rear end of the second sheet guide 89, and is thus located on the rear upper side with respect to the guide protrusion 103 of the second sheet guide 89.

6. Image Forming Operation (1) Developing Operation

The printer 1 starts an image forming operation under the control of a controller (not shown). When the image forming operation is started, the scorotron charger 22 uniformly charges the surface of the photosensitive drum 20.

Then, the scanner unit 16 emits a laser beam L toward the surface of the photosensitive drum 20 in the rear lower direction. The laser beam L passes under the grip portion 129 of the handle 115, then passes through the laser passing hole 124 of the drum front wall 111, further pass over the developing cartridge 19, and exposes the front circumferential surface of the drum body 132 of the photosensitive drum 20. Thus, an electrostatic latent image based on image data is formed on the circumferential surface of the drum body 132. Incidentally, the image data may include, for example, image data which is transmitted to the printer 1 from a personal computer (not shown) connected to the printer 1, or image data read by the flat bed scanner 40.

Further, the agitator 142 agitates toner in the toner accommodation portion 139 and supplies the agitated toner to the supply roller 27 via the communication hole 141. The supply roller 27 supplies the toner which is supplied from the agitator 142, to the developing roller 26. At this time, the toner is positively friction-charged between the developing roller 26 and the supply roller 27 and is carried on the developing roller 26. The layer thickness regulation blade 28 regulates the toner carried on the developing roller 26 to a constant thickness.

The developing roller 26 supplies the toner which is carried in the constant thickness to the electrostatic latent image on the circumferential surface of the drum body 132. Thus, the toner image is carried on the circumferential surface of the drum body 132.

(2) Sheet Feed Operation

A plurality of sheets P accommodated in the sheet feed cassette 7 are guided to the upstream part 94 and the middle part 95 of the first sheet guide 88, and are moved toward the pair of first transport rollers 100. Specifically, the sheet lift 10 swings in the counterclockwise direction in a left side view with a rear end as a fulcrum, and pinches front ends of the sheets P placed on the upper surface of the sheet lift 10 together with the pickup roller 9.

The pickup roller 9 is rotated, and thus the sheets P are sent toward the sheet feed roller 8. The sheet feed pad 11 guides the ends of the sent sheets P downstream in the transport direction so as to direct the ends thereof toward a gap between the sheet feed roller 8 and the sheet feed pad 11.

Next, the sheet feed roller 8 is rotated, and thus the sheets P which reach between the sheet feed roller 8 and the sheet feed pad 11 are separated one by one. One sheet P separated by the sheet feed roller 8 passes between the sheet feed roller 8 and the first pinch roller 12 so as to be then sequentially guided to the second pinch roller 13 and the curved guide 97, and are transported so as to be returned toward the rear upper side.

Next, the sheet P is guided to the upper surface of the linear guide 98 so as to reach between the pair of first transport rollers 100.

On the other hand, a sheet P which is supplied from outside of the main body casing 2 is inserted into the main body casing 2 via the sheet opening 61 by an operator. The sheet P is guided to the lower plate 109 and the upper plate 108 of the fifth sheet guide 92 so as to reach between the pair of first transport rollers 100.

The pair of first transport rollers 100 sends the sheet P to an interval between the pair of inclined guides 99 so as to transport the sheet P toward a gap between the pair of second transport rollers 101. The pair of inclined guides 99 guides a movement of the sheet P which is directed toward the rear lower side. Thus, the sheet P reaches between the pair of second transport rollers 101.

Successively, the pair of second transport rollers 101 sends the sheet P to a gap between the process cartridge 15 located at the internal position and the second sheet guide 89 so that the sheet P is transported toward the contact point N between the photosensitive drum 20 and the transfer roller 21. Accordingly, the sheet P is moved rearward along the upper surface of the second sheet guide 89.

Then, a leading end of the sheet P in the transport direction comes into contact with the guide protrusion 103. Thus, the transport direction of the sheet P is changed so as to be directed toward the rear upper side, and the sheet P is supplied to the sheet feed path 135 of the process cartridge 15.

The sheet P supplied to the sheet feed path 135 is transported toward the contact point N between the drum body 132 and the transfer roller 21 so as to pass through the contact point N. At this time, the transfer roller 21 transfers a toner image onto the sheet P from the photosensitive drum 20 so as to form the toner image on the sheet P.

The sheet P on which the toner image is formed is discharged through the sheet discharge opening 136 of the process cartridge 15, and is guided by the third sheet guide 90 so as to be moved toward the fixing unit 17. The sheet P passes between the heating roller 30 and the pressing roller 31. At this time, the heating roller 30 and the pressing roller 31 heat and press the sheet P so that the toner image is thermally fixed to the sheet P.

The sheet P to which the toner image is fixed passes through the pair of guide rollers 33 so as to be guided to the concave portion 106 of the fourth sheet guide 91, and is transported so as to be returned toward the front lower side and to reach between the pair of sheet discharge rollers 34.

The pair of sheet discharge rollers 34 are rotated, and thus the sheet P is discharged on the sheet discharge tray 35 through the sheet discharge port 68. The sheet P on which the toner image is formed and which is discharged from the main body casing 2 is placed on the sheet discharge tray 35.

As described above, the sheet P accommodated in the sheet feed cassette 7 is transported along the transport path T with a substantially S shape in a side view, which is defined by the sheet guide section 6.

7. Operations and Effects (1) In the printer 1, as shown in FIG. 1, the scanner unit 16 is disposed further forward than the process cartridge 15. Therefore, the scanner unit 16 and the process cartridge 15 can be disposed so as to be arranged in the front-rear direction. Specifically, the scanner unit 16 and the process cartridge 15 are disposed to be arranged in the front-rear direction along the sheet guide section 6. As a result, the printer 1 can be size-reduced in the vertical direction.

Further, as shown in FIG. 3, the small width portion 58 of the groove 46 of the main body casing 2 guides mounting and removing of the process cartridge 15 with respect to the main body casing 2. Therefore, even if the scanner unit 16 and the process cartridge 15 are disposed so as to be arranged in the front-rear direction, smooth mounting and removing operations of the process cartridge 15 can be ensured.

Therefore, it is possible to achieve size-reduction of the printer 1 in the vertical direction and also to ensure smooth mounting and removing operations of the process cartridge 15.

Further, in the printer 1, when an image forming operation is performed, the sheet P is transported in a substantially S shape in a side view. Therefore, the sheet feed roller 8 is disposed further forward than the photosensitive drum 20, and the fixing unit 17 is disposed further rearward than the photosensitive drum 20. That is, the sheet feed roller 8, the photosensitive drum 20, and the fixing unit 17 are disposed so as to be approximately arranged in the front-rear direction.

In contrast, in a case where the scanner unit 16 is disposed further forward than the process cartridge 15, and, when an image forming operation is performed, the sheet P is transported in a substantially C shape, the sheet feed roller 8, the photosensitive drum 20, and the fixing unit 17 are disposed so as to be approximately arranged in the vertical direction. Therefore, size-reduction of such a printer in the vertical direction is restricted.

On the other hand, since the sheet feed roller 8, the photosensitive drum 20, and the fixing unit 17 are disposed so as to be approximately arranged in the front-rear direction in the printer 1, size-reduction in the vertical direction can be reliably achieved. Particularly, a dimension of the printer 1 in the horizontal direction depends on a size of a sheet P which can be accommodated in the sheet feed cassette 7. Therefore, if the scanner unit 16, the process cartridge 15, and the fixing unit 17 are disposed so as to overlap the sheet feed cassette 7 when projected in the vertical direction, it is possible to prevent a size of the printer 1 in the horizontal direction from being increased.

That is, according to the printer 1, it is possible to prevent a size in the horizontal direction from being increased and also to reliably achieve size-reduction in the vertical direction.

(2) Further, the main body casing 2 includes the sheet guide section 6 which guides transport of the sheet P as shown in FIG. 1. Further, the sheet guide section 6 guides transport of the sheet P which is directed toward the photosensitive drum 20 from the sheet feed roller 8, and thus it is possible to reliably transport the sheet P from the sheet feed cassette 7 to the photosensitive drum 20.

Further, the downstream part 96 of the first sheet guide 88 is inclined downward rearward. Therefore, the sheet P can be transported lowered as proceeding toward a downstream in the transport direction. As a result, in the printer 1, the photosensitive drum 20 can be located on the further lower side, and thus the process cartridge 15 can be located on the further lower side. Therefore, it is possible to more reliably achieve size-reduction of the printer 1 in the vertical direction.

(3) Further, the sheet guide section 6 includes the guide part 107 of the second sheet guide 89 as shown in FIG. 1. Therefore, when an image forming operation is performed, the sheet P can be made to pass under the process cartridge 15 and then to reach the contact point N between the photosensitive drum 20 and the transfer roller 21.

As a result, the process cartridge 15 can be located on the further lower side, and the sheet P can be made to reliably reach the photosensitive drum 20.

Further, the contact point N between the photosensitive drum 20 and the transfer roller 21 is located at the rear end of the guide part 107, more specifically, on the upper side with respect to the guide protrusion 103. Therefore, the sheet P is guided to the guide part 107, and is then transported toward the contact point N between the photosensitive drum 20 and the transfer roller 21 in the rear upper direction. Therefore, the sheet P which has passed between the photosensitive drum 20 and the transfer roller 21 can be smoothly transported toward the fixing unit 17 and the sheet discharge rollers 34.

Further, the transfer roller 21 transfers a toner image onto the sheet P from the photosensitive drum 20 when the sheet P passes between the photosensitive drum 20 and the transfer roller 21. Therefore, it is possible to reliably transfer the toner image onto the sheet P.

Further, since the contact point N is located on the upper side with respect to the guide protrusion 103 of the second sheet guide 89, it is possible to secure a space for disposing the developing roller 26 and the rear part 144 of the developing bottom wall 140 on the front lower side of the photosensitive drum 20 and on the upper side of the second sheet guide 89.

Further, the developing roller 26 is disposed on the front lower side with respect to the photosensitive drum 20, and the rear part 144 of the developing bottom wall 140 is disposed between the developing roller 26 and the second sheet guide 89 in the upper-lower direction.

Therefore, in an image forming operation, even if toner falls down when the toner is supplied from the developing roller 26 to the photosensitive drum 20, the fallen toner is accumulated on the upper surface of the rear part 144 of the developing bottom wall 140. As a result, it is possible to prevent the inside of the printer 1 from being contaminated due to the toner.

(4) Further, the scanner unit 16 is disposed so as to overlap the sheet feed roller 8 when projected in the upper-lower direction as shown in FIG. 1. Therefore, it is possible to achieve size-reduction of the printer 1 in the front-rear direction as compared with a case where the scanner unit 16 and the sheet feed roller 8 are arranged in the front-rear direction.

As a result, it is possible to achieve size-reduction of the printer 1 in each of the upper-lower direction and the front-rear direction.

Further, the sheet feed roller 8 and the scanner unit 16 overlap each other in the upper-lower direction, and thus the front part of the sheet discharge tray 35 is heightened by a height of the sheet feed roller 8. In other words, a height of the front part of the sheet discharge tray 35 is approximate to a height of the sheet discharge port 68 disposed at the rear part of the sheet discharge tray 35. Thus, it is possible to prevent the sheet P discharged to the sheet discharge tray 35 from dropping forward from the sheet discharge tray 35.

(5) Further, the printer 1 includes the first transport rollers 100 and the second transport rollers 101 as shown in FIG. 1. Further, each of the first transport rollers 100 and the second transport rollers 101 transports the sheet P transported from the sheet feed roller 8 toward the photosensitive drum 20, at a position located further rearward than the sheet feed roller 8, that is, around the process cartridge 15. As a result, the sheet P transported from the sheet feed roller 8 can be reliably transported to the photosensitive drum 20.

(6) In the printer 1, as shown in FIG. 1, the scanner unit 16 is disposed further forward than the process cartridge 15, and the scanner unit 16 and the process cartridge 15 are disposed so as to be arranged in the front-rear direction along the sheet guide section 6.

Therefore, it is possible to achieve size-reduction of the printer 1 in the vertical direction.

(7) Further, toner accommodated in the developing frame 25 is supplied to the developing roller 26, and is then supplied to the photosensitive drum 20 by the developing roller 26, as shown in FIG. 1. Therefore, the process cartridge 15 can reliably form a toner image on the sheet P.

Furthermore, the developing frame 25 and the developing roller 26 are disposed so as to be arranged in the front-rear direction along the sheet guide section 6. That is, the scanner unit 16, the developing frame 25, and the developing roller 26 are disposed so as to be arranged in the front-rear direction along the sheet guide section 6.

Therefore, while the process cartridge 15 includes the developing frame 25 and the developing roller 26, the printer 1 can reliably achieve size-reduction in the vertical direction.

(8) Further, the process cartridge 15 can be removably mounted to the main body casing 2 as shown in FIGS. 1 to 3. Therefore, it is possible to improve maintenance property of the process cartridge 15.

(9) According to the printer 1, as shown in FIGS. 1 and 2, when the top cover 77 of the main body casing 2 is moved from the closed position to the open position, the protrusion 134 of the process cartridge 15 is engaged with the engagement portion 82 of the cover guide 80, and thus the process cartridge 15 is moved from the internal position to the extraction position. Further, the handle 115 of the process cartridge 15 is moved from the accommodation position to the ejection position in interlocking with the movement of the process cartridge 15 from the internal position to the extraction position.

Therefore, if the top cover 77 is moved from the closed position to the open position, the process cartridge 15 can be moved from the internal position to the extraction position, and the handle 115 of the process cartridge 15 can also be moved to the ejection position. In a state where the handle 115 is located at the ejection position, the handle body 125 is inclined so as to fall forward from the drum front wall 111 with the swing shaft 126 as a fulcrum. That is, in the state where the handle 115 is located at the ejection position, the grip portion 129 of the handle 115 is located outside the main body casing 2, and is thus located on the upper side of the connection part between the inclined wall 70 and the guide wall 71, that is, on the upstream side of the process cartridge 15 in the mounting direction.

As a result, the grip portion 129 of the handle 115 can be easily held, and thus the process cartridge 15 can be easily pulled out toward the upstream side in the mounting direction.

Therefore, the process cartridge 15 can be mounted to and removed from the main body casing 2 without opening the top cover 77 largely.

(10) Further, according to the printer 1, as shown in FIGS. 1 and 2, the process cartridge 15 is guided by the second groove 56 of the groove 46 when the process cartridge 15 is interlocked with a movement of the top cover 77 between the closed position and the open position.

Therefore, the process cartridge 15 can be reliably moved between the internal position and the extraction position in interlocking with the movement of the top cover 77.

(11) According to the printer 1, as shown in FIGS. 1 and 2, the second groove 56 has a substantially arc shape with a center at the rotation shaft 78 when viewed from the left-right direction, and thus it is possible to smoothly guide the process cartridge 15 which is interlocked with a movement of the top cover 77.

Therefore, the process cartridge 15 can be reliably positioned in the main body casing 2.

(12) Further, according to the printer 1, as shown in FIGS. 1 and 2, the cover guide 80 can be moved so as to follow a movement of the top cover 77 between the closed position and the open position.

Therefore, when the top cover 77 is located at the closed position, the cover guide 80 can be accommodated in the main body casing 2 along with the process cartridge 15 located at the internal position.

Further, when the process cartridge 15 is moved from the internal position to the extraction position, the protrusion 134 of the process cartridge 15 is engaged with the engagement portion 82 of the cover guide 80, and thus the cover guide 80 is located outside the main body casing 2 in following a movement of the top cover 77.

As a result, as shown in FIG. 3, the process cartridge 15 can be easily pulled out from the extraction position to the external position by using the cover guide 80 which is located outside the main body casing 2.

(13) Further, according to the printer 1, as shown in FIGS. 2 and 3, the cover guide 80 extends in the mounting direction X of the process cartridge 15.

Therefore, when the process cartridge 15 located at the extraction position is moved to the external position outside the main body casing 2, the process cartridge 15 can be guided in the mounting direction X.

As a result, the process cartridge 15 can be easily mounted to and removed from the main body casing 2.

(14) Further, according to the printer 1, as shown in FIGS. 2 and 3, since the process cartridge 15 is located at a position where the handle 115 is separated from the rotation shaft 78 of the top cover 77 and a position where the cover guide 80 is separated from the rotation shaft 78 of the top cover 77, the process cartridge 15 can be mounted and removed in the mounting direction intersecting the rotation shaft 78.

Therefore, the process cartridge 15 can be mounted to and removed from the main body casing 2 without opening the top cover 77 largely as compared with a case where the process cartridge 15 is mounted and removed along the rotation shaft 78.

(15) Further, according to the printer 1, as shown in FIG. 4, the cover guides 80 are respectively disposed at both left and right ends of the top cover 77, and thus can guide the pair of protrusions 134 disposed on both left and right outsides of the process cartridge 15, that is, the left and right outer surfaces of the process cartridge 15.

Therefore, both left and right ends of the process cartridge 15 are supported at two locations, and thus a movement between the extraction position and the external position can be stably performed.

(16) Further, according to the printer 1, as shown in FIG. 1, when an image is formed, the cover guide 80 is disposed further outward in the left-right direction than the scanner unit 16 so as not to interfere with exposure of the photosensitive drum 20 from the scanner unit 16.

Therefore, it is possible to reliably form an electrostatic latent image on the photosensitive drum 20.

Further, according to the printer 1, as shown in FIG. 1, when the top cover 77 is located at the closed position, that is, the process cartridge 15 is located at the internal position, the scanner unit 16 and the cover guide 80 overlap each other when projected in the left-right direction. That is, the cover guide 80 is stored in the main body casing 2 so as to be disposed outside the scanner unit 16 in the left-right direction.

Therefore, it is possible to achieve size-reduction of the printer 1 in the vertical direction.

(17) Further, according to the printer 1, as shown in FIG. 3, the mounting/removing guide wall 67 disposed on the upper side with respect to the scanner unit 16 guides a movement of the process cartridge 15 between the extraction position and the external position.

Therefore, not only the cover guide 80 but also the mounting/removing guide wall 67 can more reliably guide a movement of the process cartridge 15 between the extraction position and the external position by using a narrow space between the top cover 77 and the scanner unit 16.

(18) Further, according to the printer 1, as shown in FIGS. 1 and 2, the engagement portion 82 of the cover guide 80 can be moved so as to follow a movement of the top cover 77 between the closed position and the open position.

Therefore, the process cartridge 15 can be moved in interlocking with a movement of the top cover 77 while the protrusion 134 and the engagement portion 82 (an example of an interlocking mechanism) are engaged with each other.

(19) Further, according to the printer 1, as shown in FIGS. 1 and 2, when the process cartridge 15 is moved from the internal position to the extraction position which is located on the upper side with respect to the internal position, the handle 115 is inclined so as to become separated forward from the drum front wall 111 due to the self-weight of the handle body 125 with the swing shaft 126 as a fulcrum, and is thus moved from the accommodation position to the ejection position.

Therefore, the handle 115 can be easily moved from the accommodation position to the ejection position.

(20) Further, according to the printer 1, as shown in FIG. 3, since the process cartridge 15 can be mounted to and removed from the main body casing 2 without opening the top cover 77 largely, it is possible to prevent a size of the printer 1 from being increased in the vertical direction even if the flat bed scanner 40 is provided on the upper side of the main body casing 2.

Incidentally, in the first illustrative embodiment, the printer 1 is an example of an image forming apparatus; the main body casing 2 is an example of a casing; the sheet guide section 6 is an example of a transport guide; the sheet feed cassette 7 is an example of a cassette; and the sheet feed roller 8 is an example of a first roller. Further, the process cartridge 15 is an example of a process unit; the scanner unit 16 is an example of an exposure unit; and the fixing unit 17 is an example of a fixing unit. Furthermore, the developing cartridge 19 is an example of a developing unit; the photosensitive drum 20 is an example of a photosensitive body; and the transfer roller 21 is an example of a transfer member. Moreover, the developing frame 25 is an example of a developer accommodation portion and a first developer accommodation portion; the developing roller 26 is an example of a developer carrier; the sheet discharge rollers 34 is an example of a second roller; the sheet discharge tray 35 is an example of a discharge portion and a tray; and the flat bed scanner 40 is an example of an image reading unit. Further, the bottom wall 53 is an example of one side wall; the second groove 56 is an example of a guide portion; and the small width portion 58 is an example of a first guide portion. Further, the sheet opening 61 is an example of a first opening; the mounting/removing guide wall 67 is an example of a wall portion; the process opening 75 is an example of an opening; the top cover 77 is an example of a cover; the rotation shaft 78 is an example of a rotation shaft; the cover guide 80 is an example of a second guide portion; the left cover guide 80L is an example of one guide; and the right cover guide 80R is an example of the other guide. Furthermore, the first sheet guide 88 is an example of a first guide, and the downstream part 96 is an example of a downstream part of the first guide in a transport direction. Moreover, the first transport rollers 100 are examples of a third roller and a fifth roller, and the second transport rollers 101 are examples of a third roller and a sixth roller. Further, the guide part 107 is an example of a second guide, and the guide protrusion 103 is an example of a downstream end of the second guide in the transport direction. The handle 115 is an example of a handle; the handle body 125 is an example of a body portion; and the swing shaft 126 is an example of a swing shaft. Further, the protrusion 134 is an example of a protrusion; the engagement portion 82 is an example of an engagement portion; and the protrusion 134 and the engagement portion 82 are an example of an interlocking mechanism. Further, the sheet P is an example of a recording medium, and the contact point N is an example of a contact part.

8. Second Illustrative Embodiment

Next, with reference to FIGS. 8 to 12, a second illustrative embodiment of the printer 1 will be described. In the second illustrative embodiment, the same members as in the first illustrative embodiment are given the same reference numerals, and description thereof will be omitted. Further, among operations in the second illustrative embodiment, the same operation in the first illustrative embodiment will not be repeated.

Figure 8:
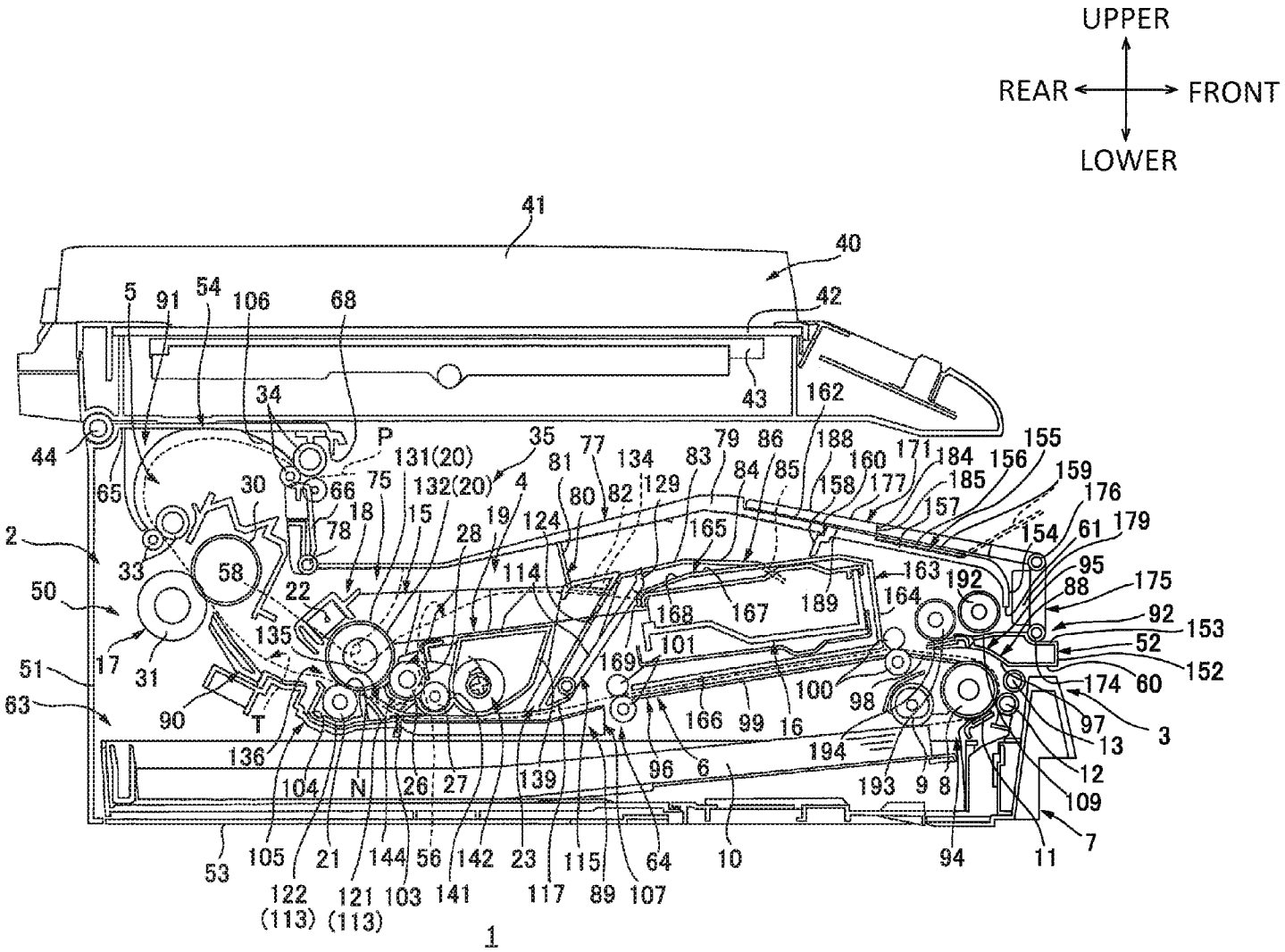
FIG. 8 is a center cross-sectional view showing a printer as an image forming apparatus according to a second illustrative embodiment of the present invention, and shows a state where a process cartridge is located at an internal position.

In the second illustrative embodiment, the scanner unit 16 is adjacent to the process cartridge 15 on the front side and is disposed on the rear upper side with respect to the sheet feed roller 8 with an interval therebetween as shown in FIG. 8. Specifically, the scanner unit 16 is disposed between the process cartridge 15 and the sheet feed roller 8 in the front-rear direction when projected in the upper-lower direction. That is, the sheet feed roller 8 is disposed further forward than the process cartridge 15.

(1) Details of Main Body Casing of Second Illustrative Embodiment

The front wall 52 of the main body casing 2 has a substantially crank shape in a side view, and includes a lower portion 152, a stepped portion 153, and an upper portion 154 which are integrally formed.

The lower portion 152 is a lower part of the front wall 52. The lower portion 152 is a substantially plate shape extending in the upper-lower direction in a side view, and includes a cassette opening 60. The cassette opening 60 is disposed at a lower end of the lower portion 152.

The stepped portion 153 has a plate shape extending in the front-rear direction in a side view, and is bent from an upper end of the lower portion 152 and extends rearward.

The upper portion 154 is an upper part of the front wall 52 and is located further rearward than the lower portion 152. The upper portion 154 has a substantially plate shape extending in the upper-lower direction in a side view, and is bent from a rear end of the stepped portion 153 and extends upward. The upper portion 154 has a sheet opening 61. The sheet opening 61 is disposed at a lower end of the upper portion 154.

The top wall 54 of the main body casing 2 includes a sheet discharge wall 155.

The sheet discharge wall 155 is disposed on the front side with respect to the tray wall 66 with an interval therebetween, and is disposed on the front upper side with respect to the scanner unit 16. The sheet discharge wall 155 is disposed so as to overlap the front end of the scanner unit 16, a transport roller 192 (described later), a sheet feed roller 193 (described later), and a pad 194 (described later), when projected in the upper-lower direction.

The sheet discharge wall 155 is connected to the upper end of the front wall 52, and extends toward the rear upper side and in the left-right direction. Both left and right ends of the sheet discharge wall 155 are connected to upper ends of the front parts 64 of the respective side walls 50. The sheet discharge wall 155 includes a sheet discharge wall body 157 and a bent portion 158 which are integrally formed.

The sheet discharge wall body 157 is connected to the upper end of the front wall 52, and extends so as to be inclined upward rearward. The sheet discharge wall body 157 is provided with a regulation receiving groove 156 and a sheet regulation portion 159.

The regulation receiving groove 156 is disposed at a substantially center part of the sheet discharge wall body 157 in the front-rear direction and the left-right direction.

The sheet regulation portion 159 is a substantially rectangular plate shape in a plan view. The sheet regulation portion 159 is moved between an inclined position where the sheet regulation portion 159 is accommodated in the regulation receiving groove 156 and is disposed along the sheet discharge wall body 157, and a standing position where the sheet regulation portion 159 is rotated in the clockwise direction in a left side view with a front end thereof as a fulcrum and stands up so as to extend toward the front upper side from the sheet discharge wall body 157. In a state where a movable tray 171 (described later) is located at a first position, the sheet regulation portion 159 is moved between the inclined position and the standing position via a base portion opening 184 and an extension portion opening 185.

The bent portion 158 is disposed at a rear end of the sheet discharge wall 155. The bent portion 158, which has a substantially crank shape in a side view, protrudes downward from the rear end of the sheet discharge wall body 157, is then bent rearward, and is subsequently bent downward.

That is, an engagement portion 160 is defined by the rear end of the sheet discharge wall body 157 and the bent part of the bent portion 158. The engagement portion 160 is recessed in a substantially rectangular shape in a side view from the rear upper side toward the front lower side over the sheet discharge wall 155 in the left-right direction.

The main body casing 2 includes a scanner unit accommodation portion 163.

The scanner unit accommodation portion 163 has a substantially box shape which is opened rearward, and accommodates the scanner unit 16 in an inner space thereof. The scanner unit accommodation portion 163 includes an accommodation portion front wall 164, an accommodation portion top wall 165, and an accommodation portion bottom wall 166.

The accommodation portion front wall 164 is disposed at a front end of the scanner unit accommodation portion 163. The accommodation portion front wall 164 has a substantially rectangular plate shape extending in the left-right direction in a front view. Both left and right ends of the accommodation portion front wall 164 are connected to inner surfaces in the left-right direction of the front parts 64 of the respective side walls 50.

The accommodation portion top wall 165 is disposed at the upper end of the scanner unit accommodation portion 163. The accommodation portion top wall 165 has a substantially plate shape extending in a direction which connects the front upper side and the rear lower side. The accommodation portion top wall 165 includes an inclined wall 167, a guide wall 168, and a regulation wall 169.

The inclined wall 167 is connected to the upper end of the accommodation portion front wall 164, extends so as to be inclined upward rearward, is then bent, and extends so as to be inclined downward rearward.

The guide wall 168 is bent from a rear end of the inclined wall 167 so that a downward inclination thereof is larger than that of the inclined wall 167, and extends so as to be inclined downward rearward.

The regulation wall 169 is bent from a rear end of the guide wall 168 so that a downward inclination thereof is larger than that of the guide wall 168, is inclined downward rearward, and is further bent so as to protrude downward.

Figure 11:
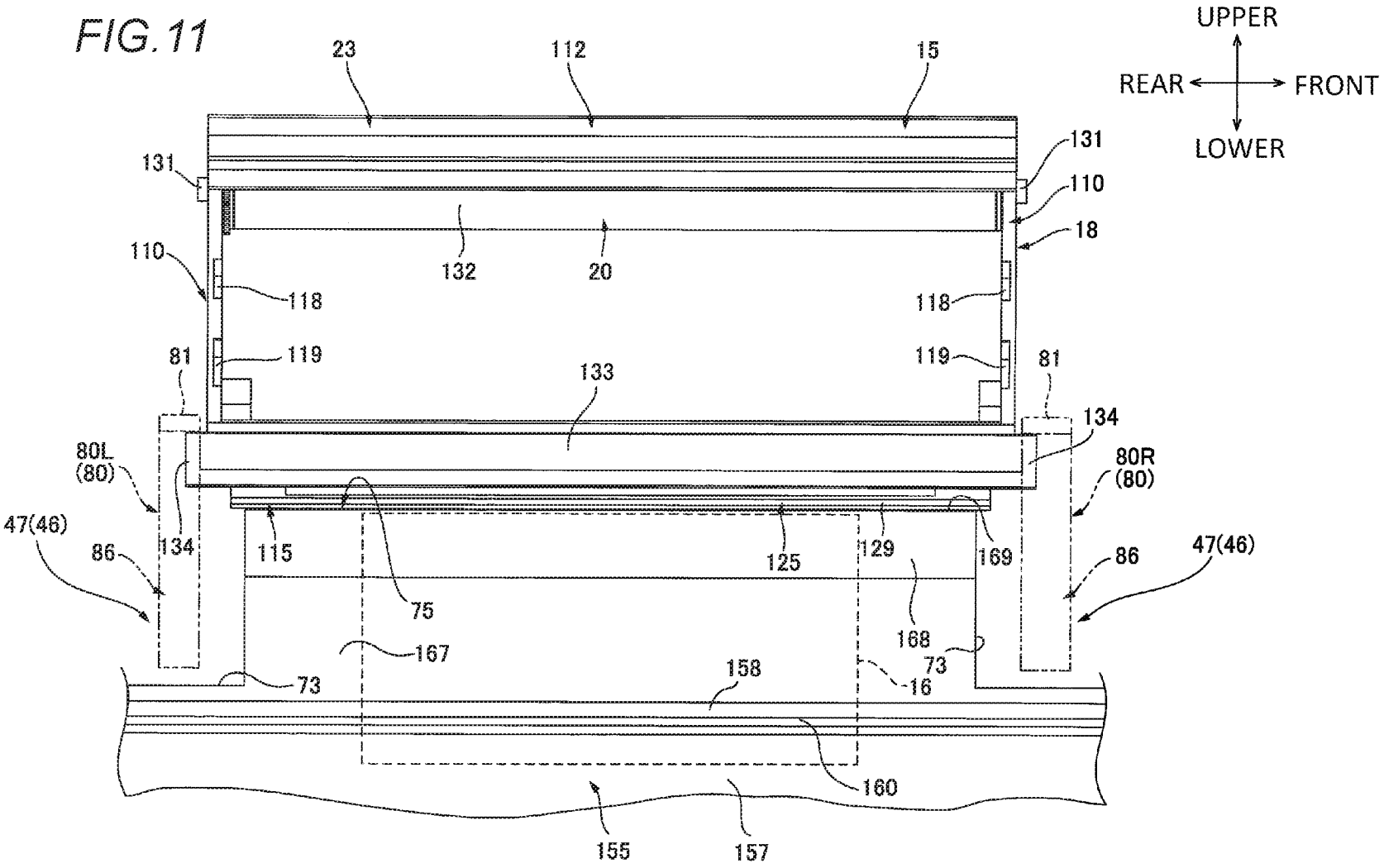
FIG. 11 is a plan view of the printer shown in FIG. 8, and shows a state where a cover body and a movable tray are removed.

The accommodation portion top wall 165 includes, as shown in FIG. 11, cutout portions 73 at respective ends thereof in the left-right direction. The cutout portions 73 correspond to the cover guides 80, and are cut out in a substantially rectangular shape in a plan view from ends of the regulation wall 169 in the left-right direction up to an approximately center of the inclined wall 167 in the front-rear direction.

The accommodation portion bottom wall 166 is disposed at a lower end of the scanner unit accommodation portion 163 as shown in FIG. 8. The accommodation portion bottom wall 166 has a substantially rectangular plate shape extending in the left-right direction in a bottom view. A front end of the accommodation portion bottom wall 166 is connected to the lower end of the accommodation portion front wall 164, and both left and right ends of the accommodation portion bottom wall 166 are connected to the inner surfaces in the left-right direction of the front parts 64 of the respective side walls 50.

Figure 9:
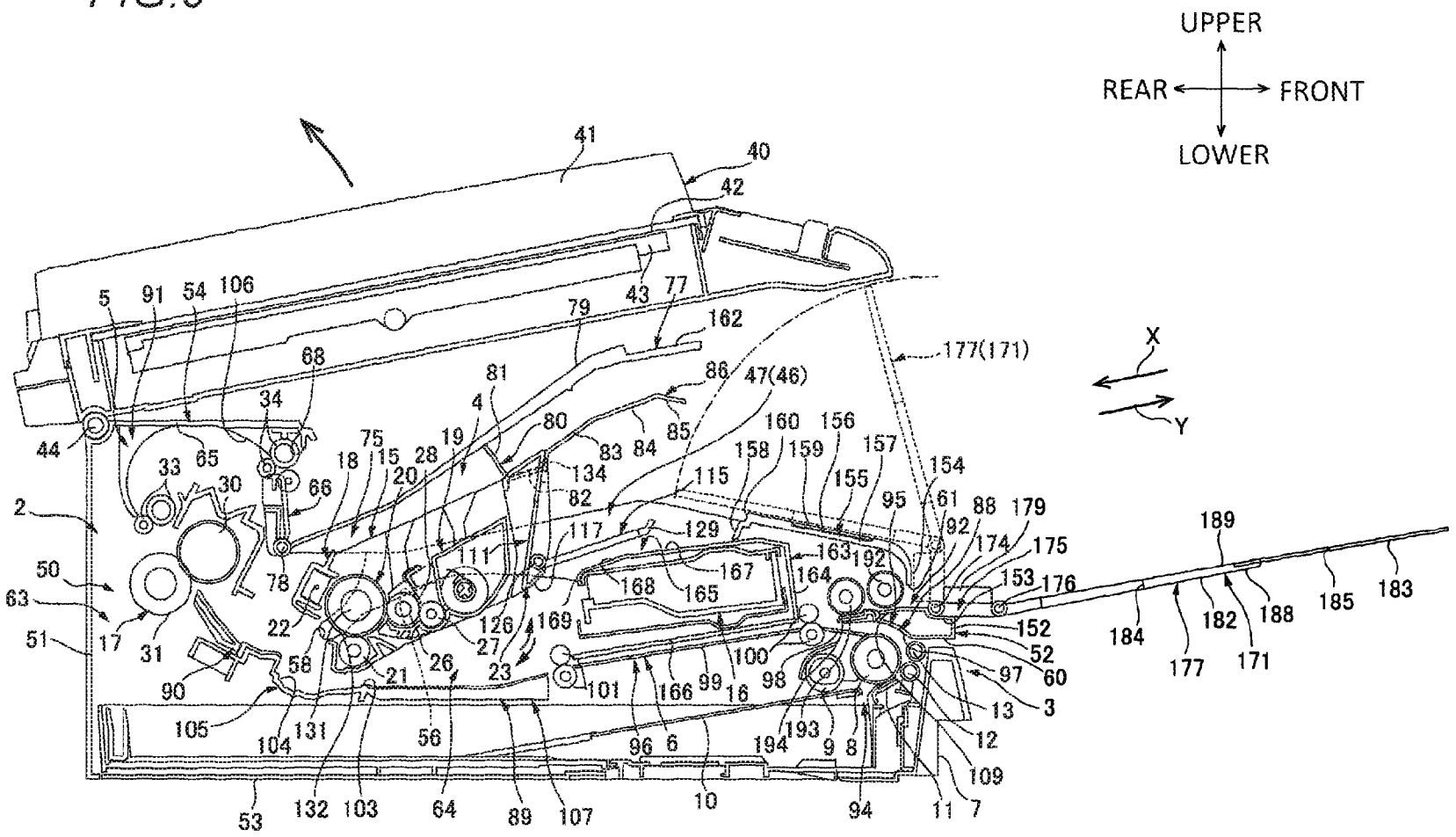
FIG. 9 is a center cross-sectional view of the printer shown in FIG. 8, and shows a state where the process cartridge is located at an extraction position.

In a similar manner to in the first illustrative embodiment, the top cover 77 can swing between a closed position where the process opening 75 is closed as shown in FIG. 8, and an open position where the process opening 75 is opened as shown in FIG. 9, with the rotation shaft 78 as a fulcrum.

As shown in FIG. 8, in a state where the top cover 77 is located at the closed position, the cover body 79 is disposed so as to extend forward from the rotation shaft 78, and a front end of the cover body 79 is fitted in the engagement portion 160. Thus, the front surface of the tray wall 66, the upper surface of the cover body 79, and the upper surface of the sheet discharge wall 155 configure the sheet discharge tray 35. The front part of the guide body 86 is disposed inside the first groove 47 of the groove 46 via the cutout portion 73, and thus each of both of the left and right cover guides 80 is disposed with respect to the scanner unit 16 with an interval therebetween in the left-right direction. Therefore, the introduction portion 85 of the guide body 86 overlaps the scanner unit 16 when projected in the left-right direction.

The cover body 79 includes a reception portion 162. The reception portion 162 is disposed at a front end of the upper surface of the cover body 79 of the top cover 77. The reception portion 162 is recessed in a substantially rectangular shape in a side view from the upper surface of the cover body 79 toward the rear lower side, and is opened toward the front lower side.

(2) Details of Sheet Guide Section of Second Illustrative Embodiment

In the first sheet guide 88, the upstream part 94 and the middle part 95 are disposed further forward than the scanner unit 16. On the other hand, the downstream part 96 of the first sheet guide 88 is disposed on the lower side of the scanner unit 16 so as to overlap the scanner unit 16 when projected in the upper-lower direction.

The downstream part 96 includes the pair of first transport rollers 100, the pair of second transport rollers 101, and an inclined guide 99.

The pair of first transport rollers 100 are disposed to be adjacent to the rear end of the linear guide 98 on the rear side, and is also disposed further forward than the scanner unit 16. The pair of first transport rollers 100 is disposed further rearward than the sheet feed roller 8.

The pair of second transport rollers 101 are disposed on the rear lower side with respect to the pair of first transport rollers 100 with an interval therebetween, and is disposed further rearward than the scanner unit 16.

The inclined guide 99 is disposed between the pair of first transport rollers 100 and the pair of second transport rollers 101. The inclined guide 99 is disposed on the lower side so as to be parallel to the accommodation portion bottom wall 166 of the scanner unit accommodation portion 163 with an interval therebetween. That is, the accommodation portion bottom wall 166 configures the downstream part 96 of the first sheet guide 88 along with the pair of first transport rollers 100, the pair of second transport rollers 101, and the inclined guide 99.

The fifth sheet guide 92 of the sheet guide section 6 is disposed on the upper side of the middle part 95 of the first sheet guide 88 and the front side of the scanner unit 16, at the front end of the main body casing 2. The fifth sheet guide 92 guides transport of the sheet P which is supplied from outside of the main body casing 2 via the sheet opening 61 and is directed toward the pair of first transport rollers 100. The fifth sheet guide 92 includes the transport roller 192, the sheet feed roller 193, the lower plate 109, and the pad 194.

The transport roller 192 has a substantially columnar shape extending in the left-right direction, and is disposed on the rear side with respect to the sheet opening 61.

The sheet feed roller 193 has a substantially columnar shape extending in the left-right direction, and is disposed on the rear side with respect to the transport roller 192.

The lower plate 109 extends rearward from a lower edge of the sheet opening 61 of the front wall 52 in a side view. The lower plate 109 is disposed on the lower side with respect to the transport roller 192 and the sheet feed roller 193 with an interval therebetween.

The lower plate 109 is connected to the rear end of the curved guide 97. Thus, the fifth sheet guide 92 and the middle part 95 of the first sheet guide 88 are connected to each other on the front side of the pair of first transport rollers 100.

The pad 194 is disposed on the lower side of the sheet feed roller 193, and is supported at a rear end of the upper surface of the lower plate 109. The pad 194 has a plate shape, and extends in a direction which connects the front upper side and the rear lower side in a side view. The upper surface of the pad 194 is in contact with a lower end of the sheet feed roller 193.

(3) Details of Movable Tray

Figure 12:
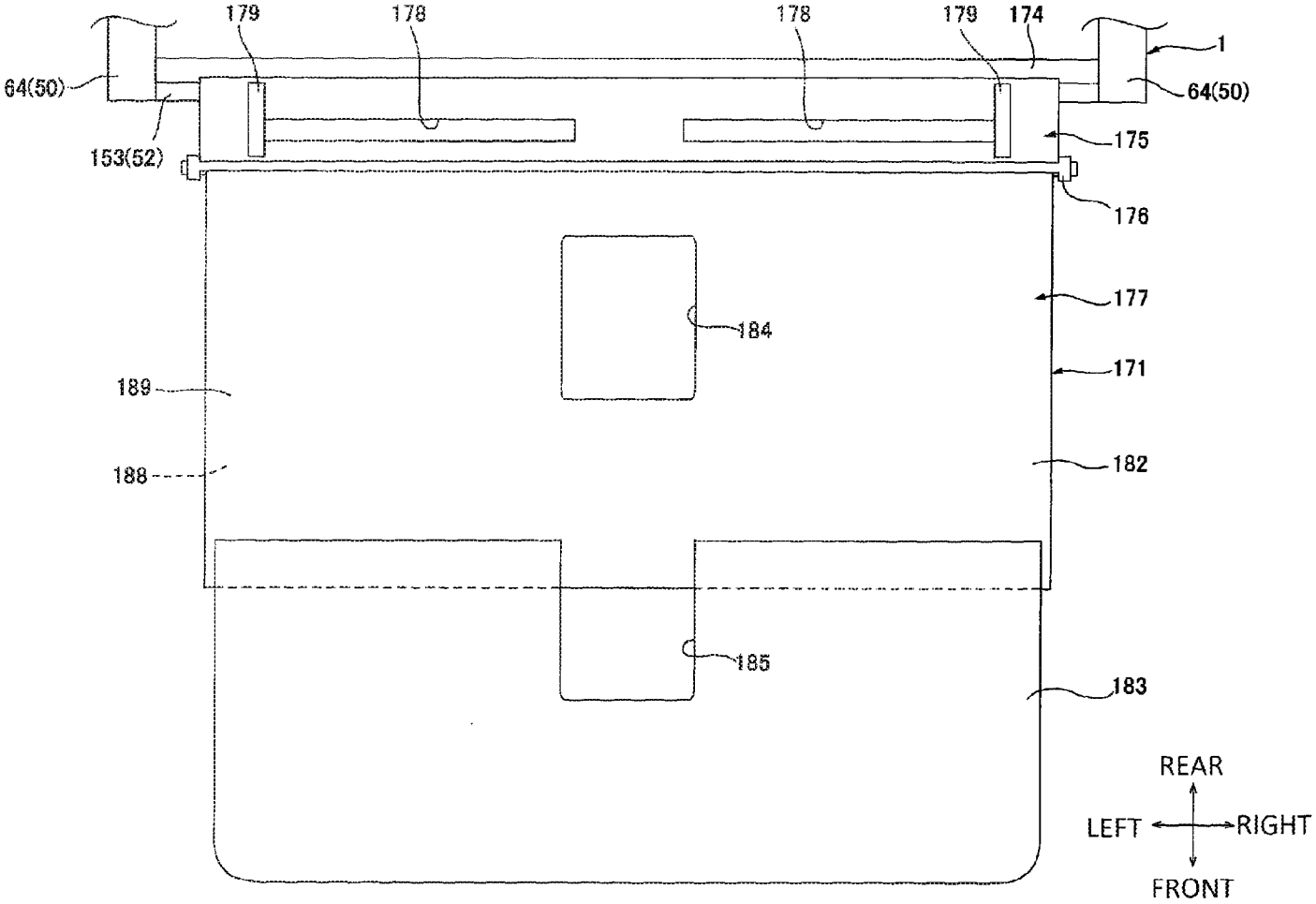
FIG. 12 is a plan view of the printer shown in FIG. 10, and shows a state where the movable tray is located at a second position.

The main body casing 2 includes the movable tray 171 as shown in FIGS. 9 and 12. Although described later in detail, the movable tray 171 is moved between a first position where the movable tray 171 is bent along an exterior of the main body casing 2 as shown in FIG. 8, and a second position where the movable tray 171 extends forward from the main body casing 2 as shown in FIG. 9.

The following description of the movable tray 171 will be made with a state where the movable tray 171 is located at the second position as a reference.

As shown in FIG. 9, the movable tray 171 includes a first movable shaft 174, a first part 175, a second movable shaft 176, and a second part 177.

The first movable shaft 174, which has a substantially columnar shape extending in the left-right direction, is disposed over the upper surface of the stepped portion 153 of the front wall 52, that is, on the front side of a lower edge of the sheet opening 61, and is rotatably supported at the front ends of the front parts 64 of both of the side walls 50.

The first part 175 has a plate shape, and extends outward in a radial direction of the first movable shaft 174 from the first movable shaft 174. The first part 175 includes a pair of regulation portion grooves 178 and a pair of supply regulation portions 179, as shown in FIG. 12.

The pair of regulation portion grooves 178 are grooves which extend in the left-right direction on the upper surface of the first part 175, and are disposed with an interval therebetween in the left-right direction.

The pair of supply regulation portions 179 are disposed on the upper surface of the first part 175 as shown in FIG. 9. Each of the pair of supply regulation portions 179 has a substantially rectangular plate shape extending in the front-rear direction in a side view. Each of the pair of supply regulation portions 179 is slidable in the left-right direction along the corresponding regulation portion groove 178. The pair of supply regulation portions 179 are interlocked with each other by a link mechanism (not shown), and if one supply regulation portion 179 is slid and moved inward in the left-right direction, the other supply regulation portion 179 is also slid and moved inward in the left-right direction. Furthermore, if one supply regulation portion 179 is slid and moved outward in the left-right direction, the other supply regulation portion 179 is also slid and moved outward in the left-right direction.

The second movable shaft 176 has a substantially columnar shape extending in the left-right direction, and is rotatably supported at an end of the first part 175 on an opposite side to the first movable shaft 174, that is, at a front end thereof.

The second part 177 includes a base portion 182 and an extension portion 183.

The base portion 182 has a substantially rectangular plate shape in a plan view, and extends outward in a radial direction of the second movable shaft 176 from the second movable shaft 176. The base portion 182 includes the base portion opening 184. The base portion opening 184 is disposed from a substantially center of the base portion 182 in the front-rear direction to a rear part thereof at a substantially center of the base portion 182 in the left-right direction. The base portion opening 184 has a substantially rectangular shape extending in a plan view, and penetrates through the base portion 182 in the upper-lower direction. A dimension of the base portion opening 184 in the left-right direction is slightly larger than a dimension of the sheet regulation portion 159 in the left-right direction.

The extension portion 183 has a plate shape extending in the same direction as the base portion 182. The extension portion 183 is slid and moved with respect to the base portion 182 between a retreat position where the extension portion 183 overlaps an upper surface of the base portion 182 as indicated by a dashed line in FIG. 9, and an advance position where the extension portion 183 extends further forward from the base portion 182 as indicated by a solid line in FIG. 9. The extension portion 183 includes the extension portion opening 185.

The extension portion opening 185 is disposed so as to overlap the base portion opening 184 of the base portion 182 in a state where the extension portion 183 is located at the retreat position. Specifically, the extension portion opening 185 has a substantially U shape which is opened rearward in a plan view, and is cut out forward from a substantially center part in the front-rear direction at a rear edge of the extension portion 183. A dimension of the extension portion opening 185 in the left-right direction is the same as a dimension of the base portion opening 184 in the left-right direction.

A dimension of the second part 177 viewed from the left-right direction is larger than a dimension of the first part 175 viewed from the left-right direction in both states where the extension portion 183 is located at the retreat position or the advance position.

Further, the movable tray 171 is rotated between a first position where the movable tray 171 is bent along the exterior of the main body casing 2 so that the second part 177 covers the sheet discharge wall 155 and the front end of the sheet discharge tray 35 as shown in FIG. 8, and a second position where the movable tray 171 extends in a direction which linearly connects the front upper side and the rear lower side in a side view so as to become separated from the main body casing 2 as shown in FIG. 9, with the first movable shaft 174 as a fulcrum.

A downstream surface of the movable tray 171 in the clockwise direction in a left side view is referred to as a front surface 188, and an upstream surface thereof in the clockwise direction in a left side view is referred to as a rear surface 189.

As shown in FIG. 8, in a state where the movable tray 171 is located at the first position, the first part 175 is disposed so as to extend upward from the first movable shaft 174. The second part 177 is disposed so as to extend toward the rear upper side from the upper end of the first part 175, that is, the second movable shaft 176 when the extension portion 183 thereof is located at the retreat position. Thus, the second part 177 covers the upper portion 154 of the front wall 52 and the sheet discharge wall body 157 of the sheet discharge wall 155, and the rear upper end thereof is received by the reception portion 162 of the cover body 79. That is, in a state where the movable tray 171 is located at the first position, the sheet discharge tray 35 is formed by the front surface of the tray wall 66, the upper surface of the cover body 79, and the front surface 188 of the movable tray 171 at the second part 177. Accordingly, the front surface 188 receives a discharged sheet P when the movable tray 171 is located at the first position.

Figure 10:
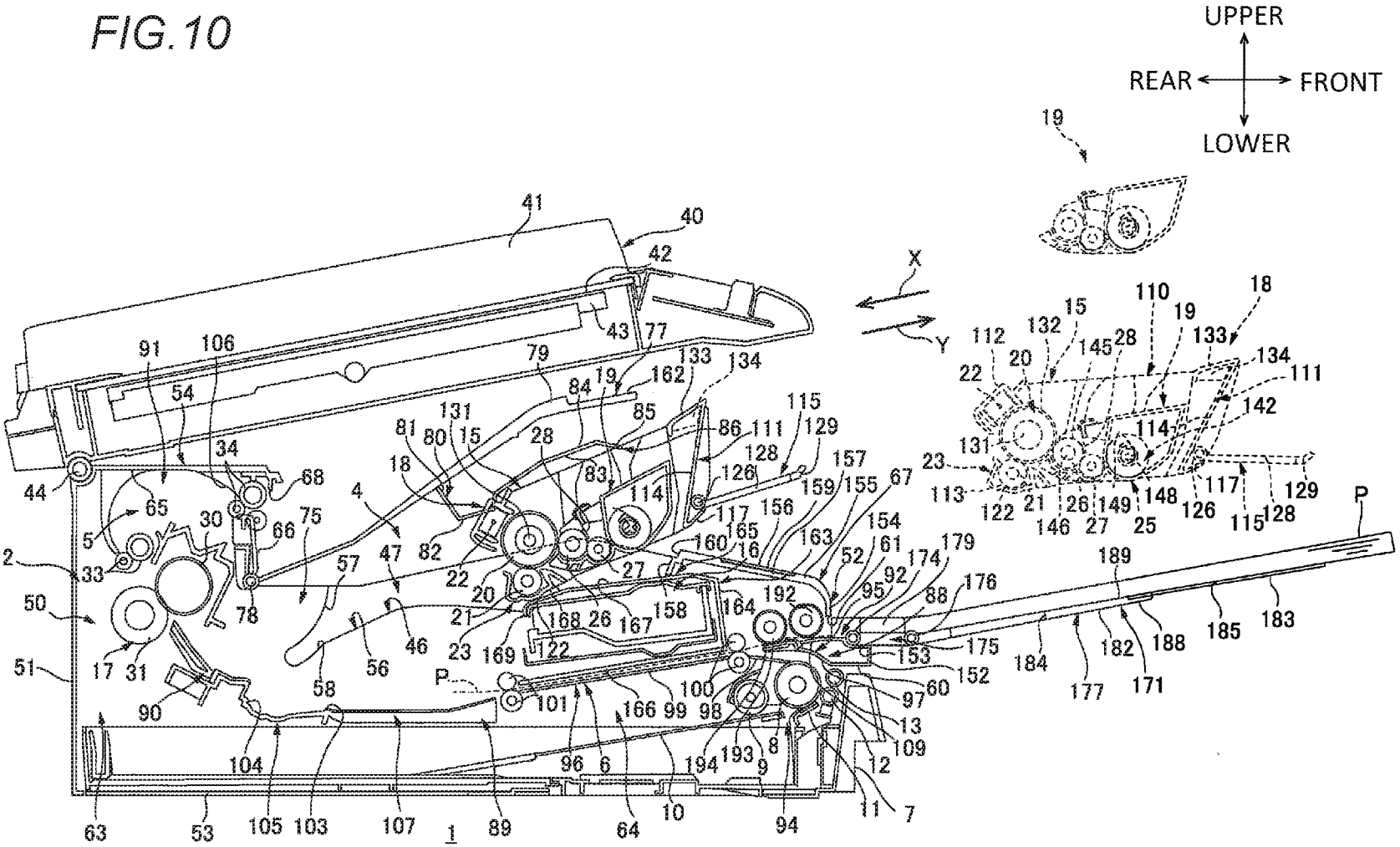
FIG. 10 is a center cross-sectional view of the printer shown in FIG. 8, and shows a state where the process cartridge is located between the extraction position and an external position and a state where the process cartridge is located at the external position.

As shown in FIG. 10, in a state where the movable tray 171 is located at the second position, the first part 175 is disposed so as to extend toward the front upper side from the first movable shaft 174. The second part 177 is disposed so as to extend toward the front upper side from the front upper end of the first part 175, that is, the second movable shaft 176 so that an upward inclination thereof is larger than that of the first part 175, when the extension portion 183 thereof is located at the advance position. That is, the movable tray 171 extends substantially linearly in a direction which connects the rear lower side to the front upper side in a side view in a state of being located at the second position. Thus, the movable tray 171 located at the second position allows a sheet P to be placed on the rear surface 189, and thus guides the supply of the sheet P into the main body casing 2 via the sheet opening 61. As mentioned above, the rear surface 189 receives a sheet P which is transported into the main body casing 2 from outside via the sheet opening 61 when the movable tray 171 is located at the second position. In a state where the movable tray 171 is located at the second position, the sheet discharge tray 35 is formed by the front surface of the tray wall 66, the upper surface of the cover body 79, and the upper surface of the sheet discharge wall body 157 of the sheet discharge wall 155.

(4) Removing and Mounting Operations of Process Cartridge with respect to Main Body Casing Next, a removing operation and a mounting operation of the process cartridge 15 with respect to the main body casing 2 will be described.

(4-1) Removing Operation of Process Cartridge From Main Body Casing

First, a description will be made of a removing operation of the process cartridge 15 from the main body casing 2, that is, a movement of the process cartridge 15 from the internal position to the external position.

As shown in FIG. 8, in a state where the process cartridge 15 is located at the internal position, the front surface of the grip portion 129 of the handle 115 is in contact with the regulation wall 169 of the scanner unit accommodation portion 163. Therefore, the handle 115 is located at the accommodation position inside the main body casing 2.

In order to move the process cartridge 15 from the internal position to the external position, as shown in FIG. 9, the operator swings the flat bed scanner 40 in the counterclockwise direction in a left side view, and also moves the movable tray 171 from the first position to the second position. At this time, the extension portion 183 of the second part 177 is located at the retreat position, and thus a rotation radius is reduced when the movable tray 171 is rotated with the first movable shaft 174 as a fulcrum. Therefore, it is possible to reduce a displacement amount of the swing of the flat bed scanner 40 in the counterclockwise direction in a left side view. The flat bed scanner 40 is swung so that the movable tray 171 is located at the second position, and then the top cover 77 is moved from the closed position to the open position.

Accordingly, contact between the grip portion 129 and the regulation wall 169 is released, and the handle 115 is moved from the accommodation position to the ejection position by the gravity.

Thus, the process cartridge 15 is taken out from the internal position to the extraction position in interlocking with the movement of the top cover 77 from the closed position to the open position, and the handle 115 is moved from the accommodation position to the ejection position in interlocking with the movement of the process cartridge 15 from the internal position to the extraction position.

Next, the operator, as shown in FIGS. 9 and 10, holds the grip portion 129 of the handle 115 located at the ejection position, and pulls out the process cartridge 15 toward the front upper side in the removing direction Y.

In the course of the pulling-out, the contact portion 117 and the transfer accommodation wall 113 of the drum frame 23 reach the upper side of the guide wall 168, and are slid on the guide wall 168. The guide wall 168 guides the contact portion 117 and the roller accommodation portion 122, and thus the process cartridge 15 is moved forward and is removed from the main body casing 2.

Accordingly, the process cartridge 15 passes through the process opening 75 from the internal position, and reaches the external position via the extraction position.

That is, the cover guide 80 and the accommodation portion top wall 165 guide a movement of the process cartridge 15 from the extraction position to the external position.

Next, the operator moves the top cover 77 from the open position to the closed position so as to move the movable tray 171 from the second position to the first position, and then swings the flat bed scanner 40 in the clockwise direction in a left side view until the flat bed scanner 40 is brought into contact with the flat bed support wall 65.

In the above-described manner, the removing operation of the process cartridge 15 from the main body casing 2 is completed.

(4-2) Mounting Operation of Process Cartridge to Main Body Casing

In order to mount the process cartridge 15 to the main body casing 2, procedures are performed in a reverse order to the above-described removing operation.

Specifically, as shown in FIGS. 9 and 10, the operator swings the flat bed scanner 40 in the counterclockwise direction in a left side view. Next, the movable tray 171 is moved from the first position to the second position, and then the top cover 77 is moved from the closed position to the open position.

Next, the operator moves the process cartridge 15 from the external position to the extraction position.

Successively, the operator moves the top cover 77 from the open position to the closed position, and also swings the flat bed scanner 40 in the clockwise direction in a left side view.

When the process cartridge 15 reaches the internal position from the extraction position, the handle 115 is located at the accommodation position while the grip portion 129 is disposed to be adjacent to the regulation wall 169 of the scanner unit accommodation portion 163 on the rear upper side.

In the above-described manner, the mounting operation of the process cartridge 15 to the main body casing 2 is completed.

(5) Sheet Feed Operation from outside of Main Body Casing

If sheet sheets P are to be supplied from outside of the main body casing 2, the operator places the sheet sheets P on the rear surface 189 of the movable tray 171 located at the second position. Therefore, the sheet sheets P are moved toward the rear lower side along the inclination of the second part 177. Thus, rear ends of the sheet sheets P are located inside the main body casing 2 via the sheet opening 61, and come into contact with the front lower end of the transport roller 192. The pair of supply regulation portion 179 comes into contact with both left and right ends of rear parts of the sheets P, and regulates a movement of the sheets P in the left-right direction.

The transport roller 192 is rotated, and thus the sheets P are sent toward the sheet feed roller 193. Therefore, the sheets P reach between the sheet feed roller 193 and the pad 194.

Next, the sheet feed roller 193 is rotated, and thus the sheets P which reach between the sheet feed roller 193 and the pad 194 are separated one by one, so as to be sent toward the pair of first transport rollers 100. Then, one sheet P separated by the sheet feed roller 193 reaches between the pair of first transport rollers 100.

Thus, the sheet P supplied from the outside of the main body casing 2 is transported along the transport path T with a substantially S shape in a side view, which is defined by the sheet guide section 6, allows an image to be formed thereon by the image forming section 4, and is discharged to the sheet discharge tray 35.

If the sheet regulation portion 159 is disposed at the standing position, the sheet regulation portion 159 prevents the sheet P discharged to the sheet discharge tray 35 from falling down from the sheet discharge tray 35.

(6) Operations and Effects of Second Illustrative Embodiment (6-1) The scanner unit 16 is disposed further rearward than the sheet feed roller 8 as shown in FIG. 8. Therefore, it is possible to reliably achieve size-reduction of the printer 1 in the vertical direction as compared with a case where the scanner unit 16 and the sheet feed roller 8 are arranged in the vertical direction.

(6-2) The sheet feed roller 193 transports a sheet P which is supplied from outside of the main body casing 2, toward the photosensitive drum 20. Therefore, it is possible to form a toner image on the sheet P supplied from outside of the main body casing 2.

The sheet feed roller 193 is disposed further forward than the scanner unit 16. Therefore, it is possible to prevent a size of the printer 1 from being increased in the vertical direction.

That is, it is possible to form a toner image on a sheet P supplied from outside of the main body casing 2, and also to prevent a size of the printer 1 from being increased in the vertical direction.

(6-3) The scanner unit 16 is disposed between the first transport rollers 100 and the second transport rollers 101 when projected in the upper-lower direction as shown in FIG. 8. Therefore, it is possible to ensure an efficient arrangement of the scanner unit 16, the first transport rollers 100, and the second transport rollers 101.

(6-4) According to the printer 1, as shown in FIG. 10, in a case where the movable tray 171 is used, when the movable tray 171 is located at the second position, the movable tray 171 receives a sheet P, and the sheet P can be supplied into the main body casing 2 via the sheet opening 61 of the front wall 52.

Further, as shown in FIG. 8, the movable tray 171 covers the front wall 52 of the main body casing 2 and the sheet discharge wall body 157 of the sheet discharge wall 155, and the rear upper end thereof is received by the reception portion 162 of the cover body 79, at the first position. That is, when the movable tray 171 is not used, the movable tray 171 can be accommodated while being located at the first position.

Therefore, the movable tray 171 does not extend in the vertical direction, and thus it is possible to achieve size-reduction of the printer 1 in the vertical direction.

(6-5) According to the printer 1, as shown in FIG. 10, a sheet P is placed on the movable tray 171 located at the second position, and thus the sheet P can be reliably supplied into the main body casing 2 via the sheet opening 61 of the front wall 52.

(6-6) According to the printer 1, as shown in FIG. 8, the movable tray 171 is divided into two members including the first part 175 and the second part 177, and thus the movable tray 171 can be easily folded back.

Therefore, when the movable tray 171 is located at the first position, the second part 177 is folded back toward the sheet discharge section 5, and thus it is possible to achieve size-reduction of the printer 1 in the vertical direction.

(6-7) According to the printer 1, as shown in FIG. 8, when the movable tray 171 is located at the first position, the reception portion 162 of the top cover 77 receives the rear upper end of the second part 177, and thus the second part 177 can be configured as part of the sheet discharge section 5.

Therefore, even if the movable tray 171 is located at the first position, and the second part 177 is folded back toward the sheet discharge section 5, a sheet P can be discharged from the main body casing 2 without the second part 177 hindering the sheet P from being placed on the sheet discharge section 5.

(6-8) According to the printer 1, as shown in FIG. 10, the first part 175 and the second part 177 of the movable tray 171 located at the second position extend substantially linearly when viewed from the left-right direction.

Therefore, a sheet P can be stably placed on the movable tray 171 located at the second position.

As a result, the sheet P can be reliably supplied into the main body casing 2 via the sheet opening 61.

(6-9) According to the printer 1, as shown in FIG. 12, when a sheet P is placed on the movable tray 171 located at the second position, the supply regulation portion 179 can prevent an image formed on the sheet P from being displaced in the left-right direction due to a movement of the sheet P in the left-right direction.

Therefore, the sheet P can be more reliably supplied into the main body casing 2 via the sheet opening 61.

(6-10) According to the printer 1, as shown in FIG. 8, it is possible to prevent a discharged sheet P from falling down by using the sheet regulation portion 159 which is disposed so as to pass through the base portion opening 184 and the extension portion opening 185 even if the movable tray 171 is located at the first position.

Therefore, it is possible to regulate falling of the sheet P discharged to the sheet discharge section 5 by using the sheet regulation portion 159 even if the movable tray 171 is located either the first position or the second position.

(6-11) According to the printer 1, as shown in FIG. 8, when the movable tray 171 is located at the first position, the second part 177 longer than the first part 175 can be folded back toward the sheet discharge section 5 when viewed from the left-right direction.

Therefore, when viewed from the left-right direction, the relatively long second part 177 of the movable tray 171 is disposed along the sheet discharge wall body 157 of the sheet discharge wall 155, that is, folded back in a direction which connects the front lower side and the rear upper side, and thus the printer 1 can be size-reduced in the vertical direction even if the movable tray 171 is located at the first position.

(6-12) According to the printer 1, as shown in FIG. 8, when the movable tray 171 is located at the first position, a discharged sheet P can be received by using the front surface 188, and, as shown in FIG. 10, when the movable tray 171 is located at the second position, a sheet P which is supplied into the main body casing 2 from outside via the sheet opening 61 can be received by using the rear surface 189.

Therefore, both surfaces of the movable tray 171 can be used.

(6-13) According to the printer 1, as shown in FIG. 9, even if the flat bed scanner 40 is provided on the upper side with respect to the main body casing 2, in the movable tray 171, the second part 177 is rotated with the second movable shaft 176 as a fulcrum in a state where the extension portion 183 is located at the retreat position, and thus it is possible to reduce a rotation radius.

Therefore, the movable tray 171 can be moved between the first position and the second position without interfering with the flat bed scanner 40 simply by slightly swinging the flat bed scanner 40.

Therefore, it is possible to prevent a size of the printer 1 in the vertical direction even if the flat bed scanner 40 is provided.

Also, in the second illustrative embodiment, it is possible to achieve the same operations and effects as in the above-described first illustrative embodiment.

Incidentally, in the second illustrative embodiment, the sheet regulation portion 159 is an example of a second regulation portion; the reception portion 162 is an example of a reception portion; and the accommodation portion top wall 165 is an example of a wall portion. The movable tray 171 is an example of a tray; the first part 175 is an example of a first part; and the second part 177 is an example of a second part. The supply regulation portion 179 is an example of a first regulation portion; the base portion opening 184 and the extension portion opening 185 are an example of a second opening; and the front surface 188 is an example of a first surface. The rear surface 189 is an example of a second surface, and the sheet feed roller 193 is an example of a fourth roller.

9. Third Illustrative Embodiment

Next, with reference to FIGS. 13 to 19, a third illustrative embodiment of the printer 1 will be described. In the third illustrative embodiment, the same members as in the first illustrative embodiment are given the same reference numerals, and description thereof will be omitted. Further, among operations in the third illustrative embodiment, the same operation in the first illustrative embodiment will not be repeated.

In the third illustrative embodiment of the present invention, the image forming section 4 includes a process unit 200.

Although described later in detail, the process unit 200 can be moved between an internal position where the process unit 200 lies in the main body casing 2 and an external position where the process unit is removed from the main body casing 2. In a state of being located at the internal position, the process unit 200 is disposed at a substantially center inside the main body casing 2 in a side view, and is disposed on the upper side with respect to a substantially center part of the sheet feed cassette 7 in the front-rear direction. That is, the sheet feed cassette 7 is disposed on the lower side with respect to the process unit 200.

The process unit 200 includes a process cartridge 201 and a toner cartridge 202.

The process cartridge 201 is a lower part of the process unit 200, and includes a process frame 203, a drum unit 204, a developing unit 205, and a transport unit 230.

(1) Process Frame

Figure 13:
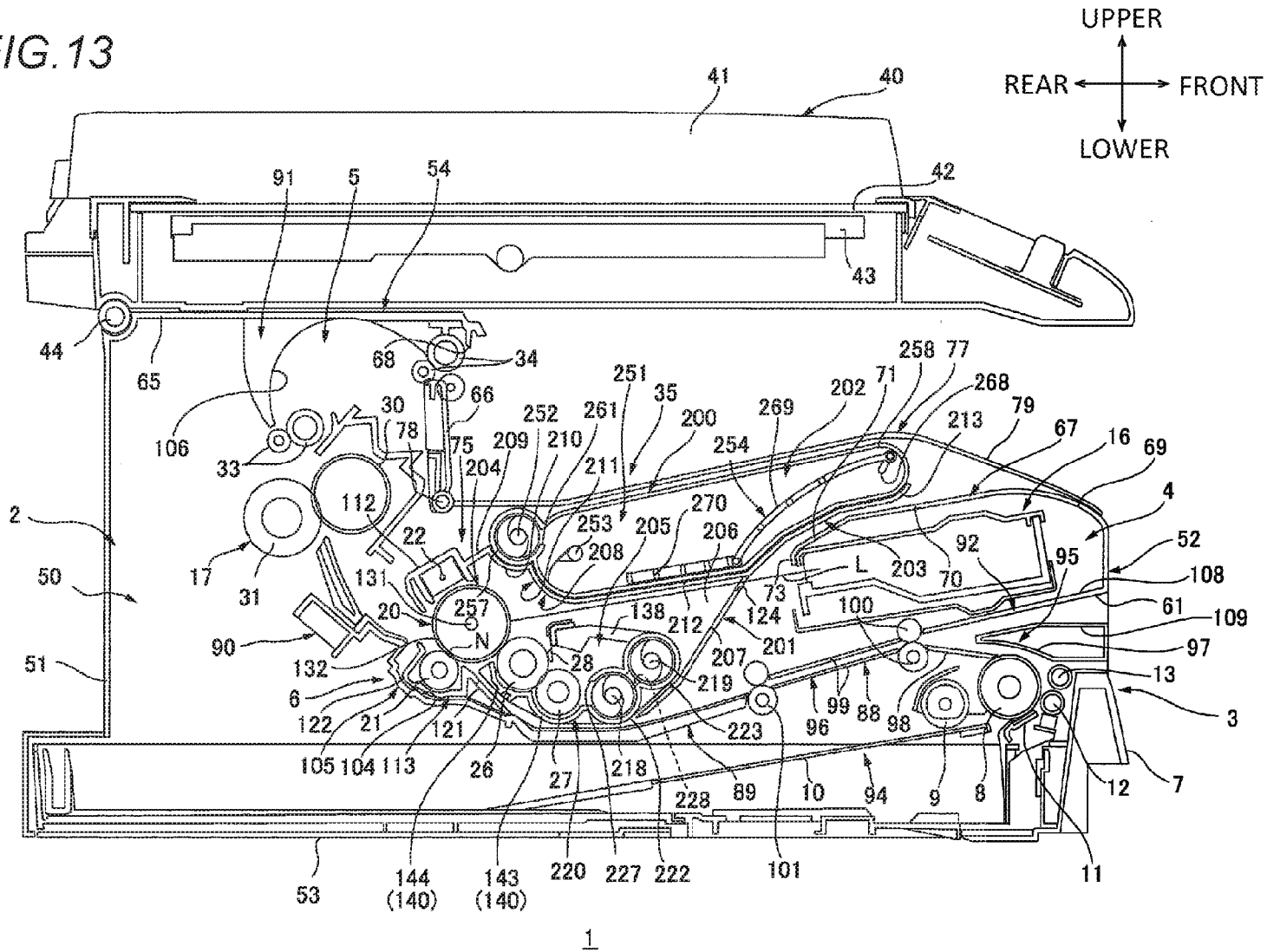
FIG. 13 is a center cross-sectional view showing a printer as an image forming apparatus according to a third illustrative embodiment of the present invention, and shows a state where a process cartridge is located at an internal position.
Figure 18A:
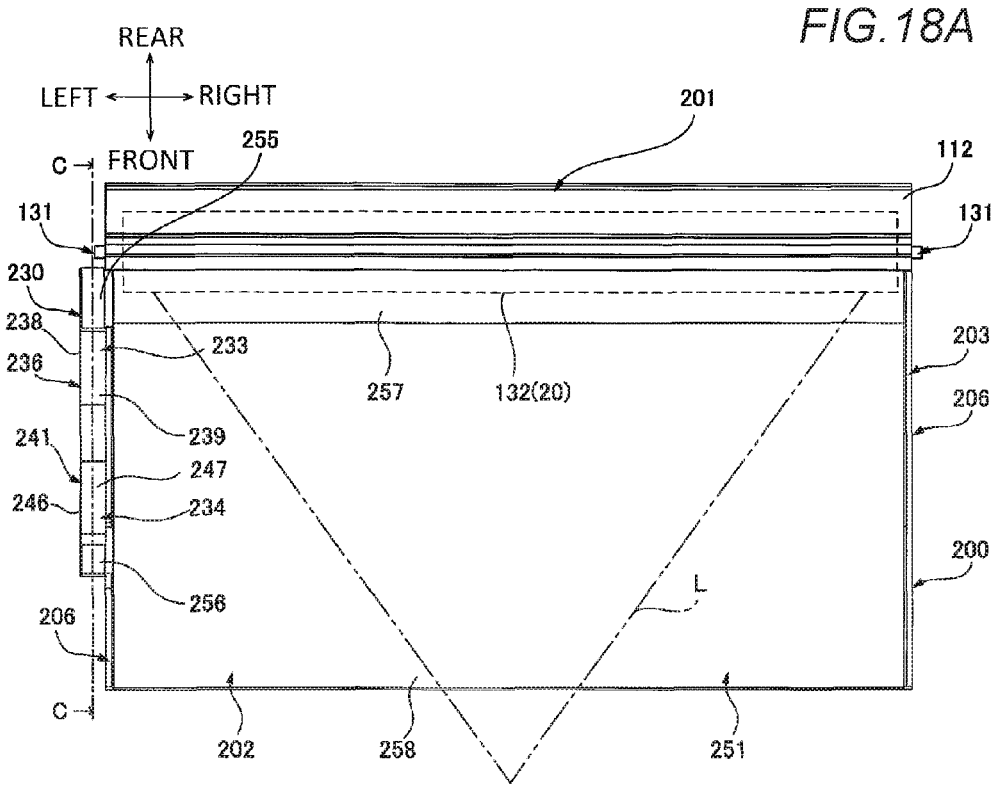
FIG. 18A is a plan view of the process unit shown in FIG. 16.

As shown in FIGS. 13 and 18A, the process frame 203 includes a pair of process side walls 206, a process front wall 207, a charger holding wall 112, a transfer accommodation wall 113, and a cartridge support wall 208 which are integrally formed.

Figure 18B:
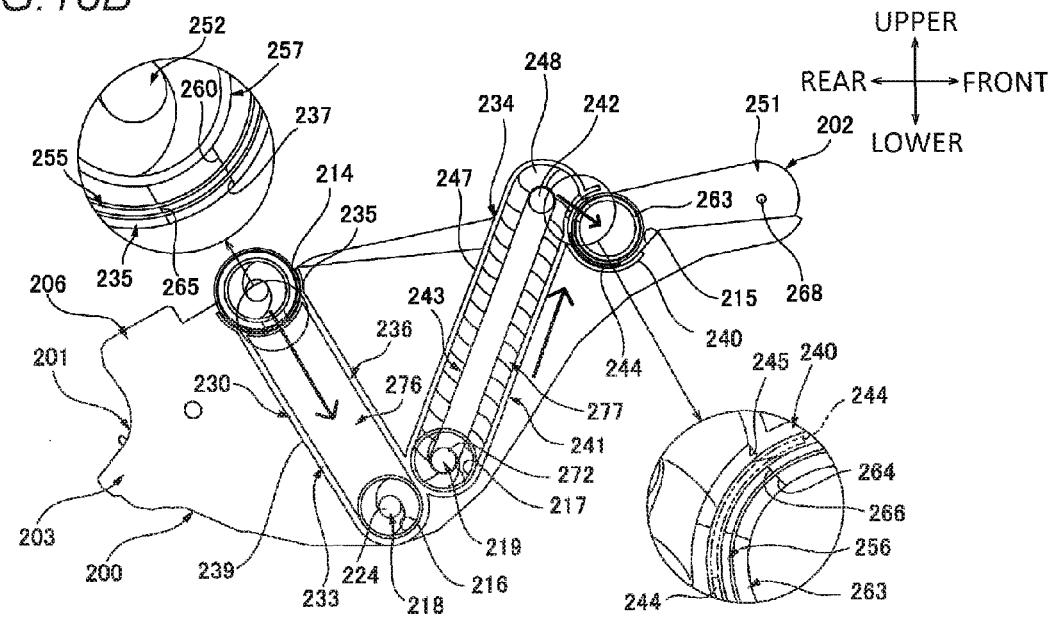
FIG. 18B is a cross-sectional view taken along a line C-C of the process unit shown in FIG. 18A.

As shown in FIG. 18A, the pair of process side walls 206 are respectively disposed at both left and right ends of the process frame 203, and are disposed with an interval therebetween in the left-right direction. Each of the pair of process side walls 206 has a substantially rectangular plate shape in a side view as shown in FIG. 18B.

Of the pair of process side walls 206, the left process side wall 206 includes a first reception groove 214, a second reception groove 215, a toner supply port 216, and a toner return hole 217.

The first reception groove 214 is disposed on a rear upper end of the process side wall 206. The first reception groove 214 has a semicircular shape which is opened upward in a side view, and is recessed downward from a rear end of an upper edge of the process side wall 206. The first reception groove 214 is disposed along an outer circumferential surface of a first shutter 255 (described later).

The second reception groove 215 is disposed on a front with respect to the first reception groove 214 with an interval therebetween. The second reception groove 215 has a semicircular shape which is opened upward in a side view, and is recessed downward from the upper edge of the process side wall 206. The second reception groove 215 is disposed along an outer circumferential surface of a reception cylinder 263 (described later).

The toner supply port 216 is disposed at a lower end of the process side wall 206, and is disposed on the front lower side with respect to the first reception groove 214 with an interval therebetween. The toner supply port 216 has a substantially circular shape in a side view, and penetrates through the process side wall 206 in the left-right direction.

The toner return hole 217 is disposed on the front upper side with respect to the toner supply port 216, and is disposed on the rear lower side with respect to the second reception groove 215 with an interval therebetween. The toner return hole 217 has a substantially circular shape in a side view, and penetrates through the process side wall 206 in the left-right direction.

Figure 16:
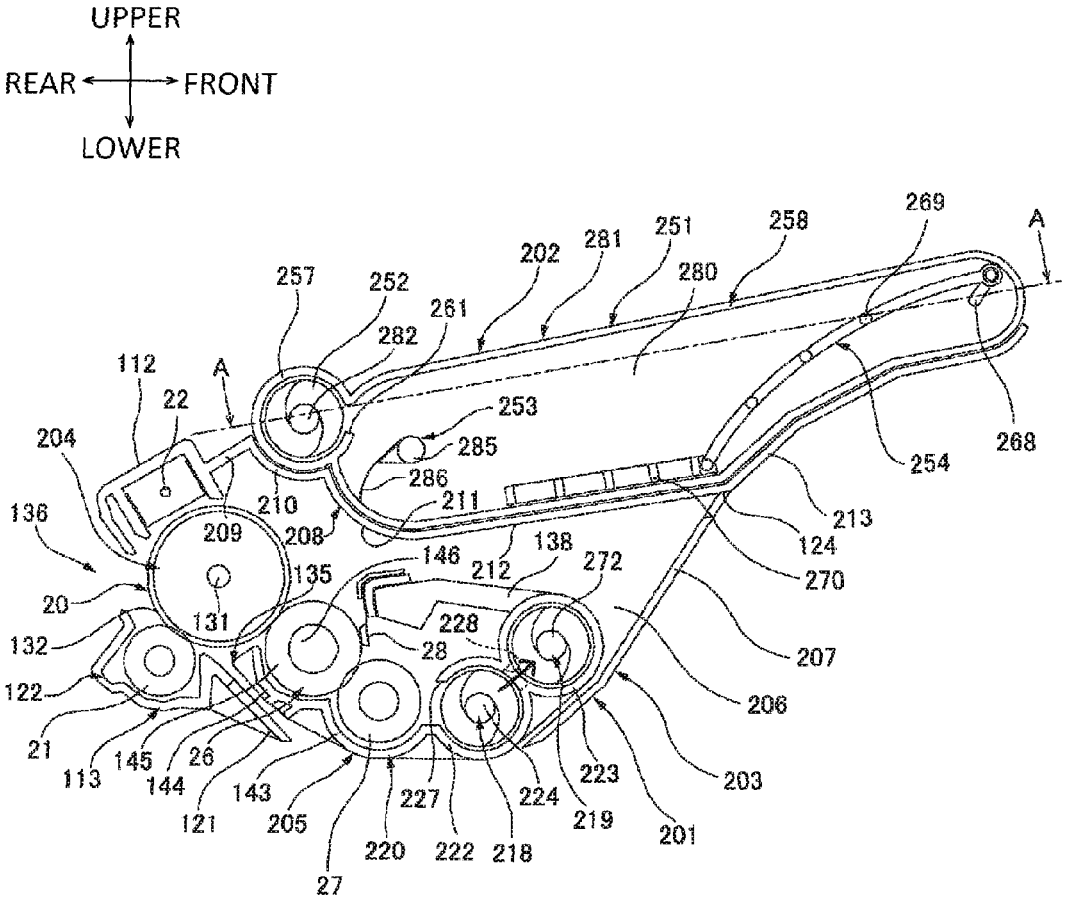
FIG. 16 is a center cross-sectional view of the process unit shown in FIG. 15.

As shown in FIG. 16, the process front wall 207 has a plate shape which extends in a direction which connects the front upper side to the rear lower side in a side view, and extends in the left-right direction. Each of both left and right ends of the process front wall 207 is connected to the front end of each process side wall 206. The process front wall 207 includes a laser passing hole 124.

The laser passing hole 124 is disposed at an upper end of the process front wall 207 so as to correspond to a light path of laser beam L. The laser passing hole 124 has a shape and a size which allow the laser beam L to pass through the laser passing hole 124, and penetrates through the process front wall 207 in the front-rear direction.

The charger holding wall 112 is disposed at a rear upper end of the process frame 203. Each of both left and right ends of the charger holding wall 112 is connected to the rear upper end of each process side wall 206.

The transfer accommodation wall 113 is disposed at the rear lower end of the process frame 203, and is disposed on the lower side with respect to the charger holding wall 112 with an interval therebetween. Each of both left and right ends of the transfer accommodation wall 113 is connected to the rear lower end of each process side wall 206.

The cartridge support wall 208 has a plate shape which extends forward from the charger holding wall 112, and extends in the left-right direction. Each of both left and right ends of the cartridge support wall 208 is connected to the upper end of each process side wall 206.

The cartridge support wall 208 includes a connection portion 209, an auger cylinder reception portion 210, and a toner accommodation receiving portion 211 which are integrally formed.

The connection portion 209 is disposed to be adjacent to the transfer accommodation wall 113 on the front side, and has a plate shape which protrudes toward the front upper side from the front wall of the transfer accommodation wall 113.

The auger cylinder reception portion 210 is disposed to be adjacent to the connection portion 209 on the front side. The auger cylinder reception portion 210 has a substantially C shape which is opened toward the front upper side in a side view, and is disposed along an outer circumferential surface of an auger accommodation cylinder 257 (described later). A rear end of the auger cylinder reception portion 210 is connected to the front end of the connection portion 209.

The toner accommodation receiving portion 211 is disposed to be adjacent to the auger cylinder reception portion 210 on the front lower side. The toner accommodation receiving portion 211 has a substantially U plate shape in a side view, and is disposed along a lower end of a toner accommodation portion 258 (described later).

Specifically, the toner accommodation receiving portion 211 includes a rear reception portion 212 and a front reception portion 213. The rear reception portion 212 is connected to the front end of the auger cylinder reception portion 210, extends downward, and is then bent so as to extend forward. A front end of the rear reception portion 212 is connected to the upper end of the process front wall 207. The front reception portion 213 extends toward the front upper side from the front end of the rear reception portion 212.

(2) Drum Unit

The drum unit 204 is disposed at a rear end in the process frame 203, and includes a photosensitive drum 20, a transfer roller 21, and a scorotron charger 22.

The photosensitive drum 20 is disposed between the rear ends of the pair of process side walls 206, and is disposed on the front lower side of the charger holding wall 112 and an upper side of the transfer accommodation wall 113. The photosensitive drum 20 is rotatably supported at the process frame 203 while both left and right ends of the drum shaft 131 are supported at the respective process side walls 206. The transfer roller 21 is rotatably supported at the process frame 203 while both left and right ends thereof are supported at the respective process side walls 206. The scorotron charger 22 is supported at the charger holding wall 112, and is thus supported at the process frame 203.

(3) Developing Unit

The developing unit 205 is disposed on the front side of the drum unit 204 in the process frame 203. The developing unit 205 includes a developing frame 220, a first auger 218, a second auger 219, a developing roller 26, a supply roller 27, and a layer thickness regulation blade 28.

The developing frame 220 has a hollow tubular shape extending in the left-right direction, and includes a first auger accommodation portion 222, a second auger accommodation portion 223, a blade support portion 138, and a developing bottom wall 140 which are integrally formed.

The first auger accommodation portion 222 is disposed on a front lower end of the developing frame 220. The first auger accommodation portion 222 has a substantially cylindrical shape extending in the left-right direction. Each of both left and right ends of the first auger accommodation portion 222 is continuous to an inner surface of each process side wall 206 in the left-right direction. Specifically, a left end of the first auger accommodation portion 222 is continuous to a circumferential edge of the toner supply port 216 of the left process side wall 206.

The first auger accommodation portion 222 includes a toner opening 227. The toner opening 227 is disposed at a rear end of the first auger accommodation portion 222, and penetrates through the rear end of the first auger accommodation portion 222 in the front-rear direction.

The second auger accommodation portion 223 is disposed to be adjacent to the first auger accommodation portion 222 on the front upper side. The second auger accommodation portion 223 has a substantially cylindrical shape extending in the left-right direction. Each of both left and right ends of the second auger accommodation portion 223 is continuous to the inner surface of each process side wall 206 in the left-right direction. Specifically, a left end of the second auger accommodation portion 223 is continuous to a circumferential edge of the toner return hole 217 of the left process side wall 206.

The rear lower end of the second auger accommodation portion 223 is continuous to the front upper end of the first auger accommodation portion 222 in the left-right direction.

Figure 19:
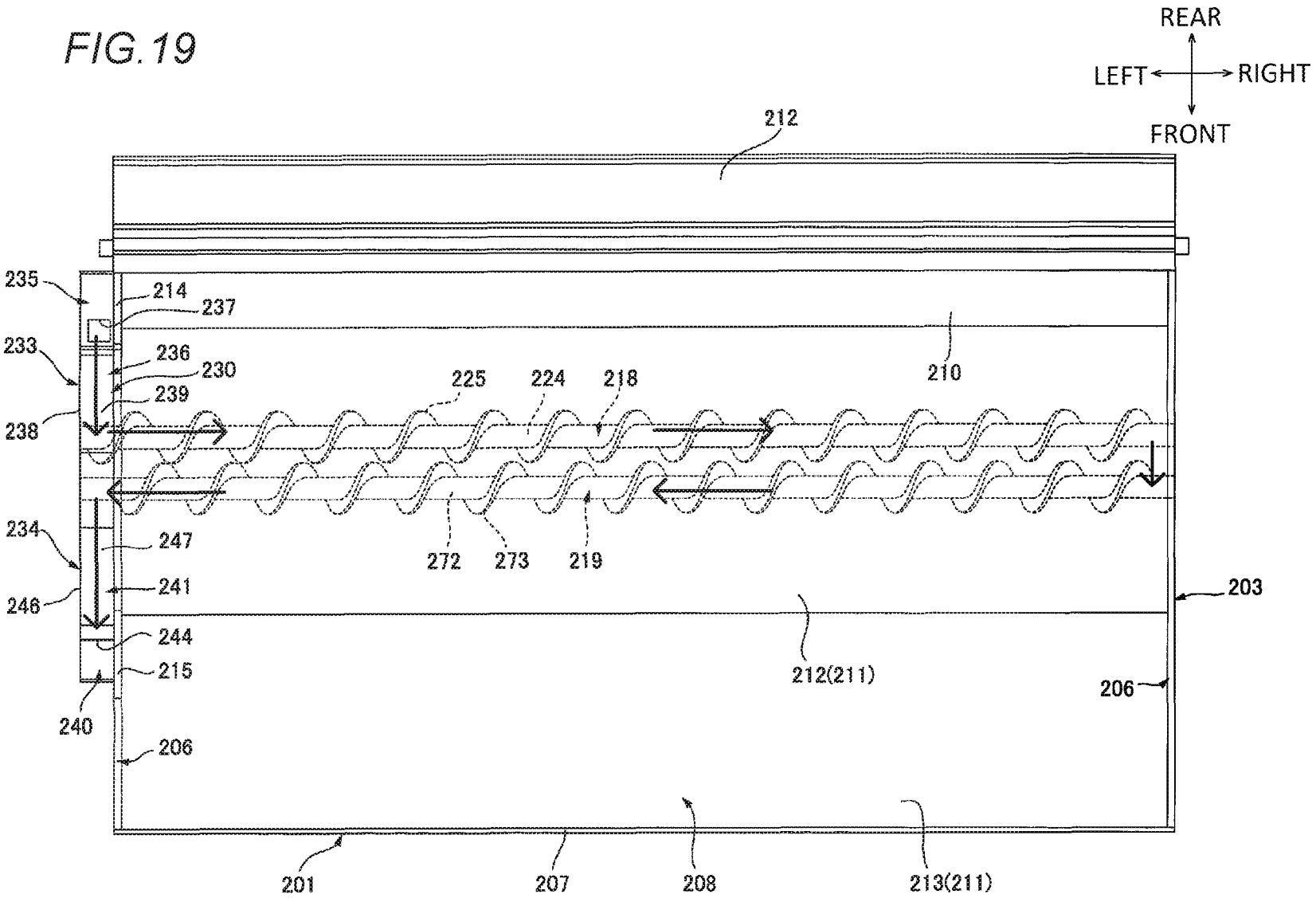
FIG. 19 is an explanatory view showing a state where a process cartridge shown in FIG. 18B transports toner.

The continuous part of the first auger accommodation portion 222 and the second auger accommodation portion 223 includes a communication hole 228. As shown in FIGS. 16 and 19, the communication hole 228 is disposed at a right end of the continuous part of the first auger accommodation portion 222 and the second auger accommodation portion 223, and penetrates through the continuous part in a direction which connects the front upper side and the rear lower side. Thus, an inner space of the first auger accommodation portion 222 communicates with an inner space of the second auger accommodation portion 223 via the communication hole 228.

The blade support portion 138 is disposed to be adjacent to the second auger accommodation portion 223 on the rear side. The blade support portion 138 has a substantially rectangular shape which protrudes forward from the rear upper end of the second auger accommodation portion 223 in a side view.

The developing bottom wall 140 extends rearward from a lower circumferential edge of the toner opening 227 of the first auger accommodation portion 222. Both left and right ends of the developing bottom wall 140 are connected to the inner surfaces of the respective process side walls 206 in the left-right direction.

The first auger 218 is disposed inside the first auger accommodation portion 222. As shown in FIG. 19, the first auger 218 includes a first auger shaft 224 and a first auger screw 225.

The first auger shaft 224 has a columnar shape extending in the left-right direction. A dimension of the first auger shaft 224 in the left-right direction is larger than a dimension of the developing frame 220 in the left-right direction. Therefore, a left end of the first auger shaft 224 protrudes further toward the left side than the left process side wall 206 via the toner supply port 216 as shown in FIGS. 18B and 19.

The first auger screw 225 is entirely disposed on a circumferential surface of the first auger shaft 224 in the left-right direction, and extends in a helical shape. The first auger 218 is rotatably supported at the process frame 203 while a right end of the first auger shaft 224 is supported at the right process side wall 206 and the left end of the first auger shaft 224 is supported at a supply closing plate 238 (described later).

The second auger 219 is disposed inside the second auger accommodation portion 223 as shown in FIG. 16. The second auger 219 includes a second auger shaft 272 and a second auger screw 273 as shown in FIG. 19.

The second auger shaft 272 has a columnar shape extending in the left-right direction. A dimension of the second auger shaft 272 in the left-right direction is larger than a dimension of the developing frame 220 in the left-right direction. Therefore, a left end of the second auger shaft 272 protrudes further toward the left side than the left process side wall 206 via the toner return hole 217 as shown in FIGS. 18B and 19.

The second auger screw 273 is disposed at a part located inside the developing frame 220 on a circumferential surface of the second auger shaft 272, and extends in a helical shape. That is, the second auger screw 273 is not disposed on the circumferential surface at the left end of the second auger shaft 272, which is located outside the developing frame 220.

The second auger 219 is rotatably supported at the process frame 203 while a right end of the second auger shaft 272 is supported at the right process side wall 206 and the left end of the second auger shaft 272 is supported at a return closing plate 246 (described later).

As shown in FIG. 16, the developing roller 26 is disposed on the front upper side of the rear part 144 of the developing bottom wall 140 with an interval therebetween. The developing roller 26 is rotatably supported at the process frame 203 while both left and right ends of the developing roller shaft 146 are supported at the respective process side walls 206.

The supply roller 27 is disposed inside the front part 143 of the developing bottom wall 140. The supply roller 27 is rotatably supported at the process frame 203 while both left and right ends thereof are supported at the respective process side walls 206.

The layer thickness regulation blade 28 is fixed to a read end of the blade support portion 138.

(4) Transport Unit

The transport unit 230 is disposed on the left surface of the left process side wall 206 as shown in FIG. 18B. The transport unit 230 includes a toner supply transport portion 233 and a toner return transport portion 234.

The toner supply transport portion 233 transports toner from the auger accommodation cylinder 257 (described later) to the toner supply port 216.

The toner supply transport portion 233 includes a supply transport frame 236. The supply transport frame 236 extends in a direction which connects the front lower side to the rear upper side, and includes a first reception portion 235, a supply circumferential side wall 239, and the supply closing plate 238 which are integrally formed.

The first reception portion 235 has a substantially semicircular shape which is opened toward the rear upper side in a side view, and protrudes toward the left side from a circumferential edge of the first reception groove 214 of the left process side wall 206.

The first reception portion 235 includes a toner supply reception hole 237. The toner supply reception hole 237 is disposed at a front lower end of the first reception portion 235, and penetrates through the first reception portion 235 in a direction which connects the front lower side to the rear upper side.

The supply circumferential side wall 239 has a substantially U shape which is opened toward the rear upper side in a side view, and protrudes the left surface of the left process side wall 206 toward the left side. Respective open ends, that is, upper ends of the supply circumferential side wall 239 are connected to the first reception portion 235, and closed ends, that is, lower ends of the supply circumferential side wall 239 surround the toner supply port 216 in a left side view.

A lower end of the supply closing plate 238 rotatably supports the left end of the first auger shaft 224. The supply closing plate 238 closes, as shown in FIG. 19, the left ends of the first reception portion 235 and the supply circumferential side wall 239, and is disposed with respect to the left process side wall 206 with an interval therebetween. Thus, as shown in FIG. 18B, a supply toner transport chamber 276 which is a closed space is defined by the process side wall 206, the first reception portion 235, the supply circumferential side wall 239, and the supply closing plate 238. The supply toner transport chamber 276 communicates with the inside of the developing frame 220 via the toner supply port 216.

The toner return transport portion 234 transports toner discharged from the toner return hole 217 to the reception cylinder 263 (described later).

The toner return transport portion 234 is disposed on the front side of the toner supply transport portion 233, and includes a return transport frame 241, a reception portion shutter 244, a belt shaft 242, and a transport belt 243.

The return transport frame 241 includes a second reception portion 240, a return circumferential side wall 247, a return closing plate 246, and a closing wall 248 which are integrally formed.

The second reception portion 240 has a substantially semicircular shape which shares a center axis line with the second reception groove 215 in a side view, and is opened toward the front upper side. The second reception portion 240 extends in the left-right direction as shown in FIG. 19, and a right end of a lower part of the second reception portion 240 is connected to a circumferential edge of the second reception groove 215 of the left process side wall 206 as shown in FIG. 18B. That is, an upper part of the second reception portion 240 is located on the upper side with respect to the upper edge of the process side wall 206.

The return circumferential side wall 247 has a substantially elliptical shape extending in a direction which connects the front upper side to the rear lower side in a side view, and extends in the left-right direction.

A rear lower end of the return circumferential side wall 247 surrounds the toner return hole 217 in a left side view, and a front upper end of the return circumferential side wall 247 is connected to the upper part of the second reception portion 240. That is, the front upper end of the return circumferential side wall 247 is located on the upper side with respect to the upper edge of the process side wall 206. Further, in the right end of the return circumferential side wall 247, a part located on the lower side with respect to the upper edge of the process side wall 206 is connected to the left surface of the process side wall 206.

A connection part between the return circumferential side wall 247 and the second reception portion 240 includes a toner discharge hole 245. The toner discharge hole 245 penetrates through the connection part between the return circumferential side wall 247 and the second reception portion 240 in a direction which connects the front lower side to the rear upper side.

The return closing plate 246 closes the left end of the return circumferential side wall 247 as shown in FIG. 19, and is disposed toward the left side with respect to the left process side wall 206 with an interval therebetween. A lower end of the return closing plate 246 rotatably supports the left end of the second auger shaft 272.

The closing wall 248 closes a part located on the upper side with respect to the upper edge of the process side wall 206 in the right end of the return circumferential side wall 247.

A lower end of the closing wall 248 is connected to the upper edge of the process side wall 206.

Thus, a tonner return transport chamber 277 which is a closed space is defined by the process side wall 206, the return circumferential side wall 247, the return closing plate 246, and the closing wall 248. The tonner return transport chamber 277 communicates with the inside of the developing frame 220 via the toner return hole 217.

The reception portion shutter 244 is disposed on the second reception portion 240. The reception portion shutter 244 is a thin plate with an arc shape in a side view, and is disposed along an inner circumferential surface of the second reception portion 240. As indicated by a broken line, the reception portion shutter 244 is located on the front side of the toner discharge hole 245, and is moved along the second reception portion 240 between a closed position where the toner discharge hole 245 is closed and an open position where the toner discharge hole 245 is opened. The reception portion shutter 244 is disposed at the closed position at the normal time.

The belt shaft 242 is disposed at an upper end in the tonner return transport chamber 277. The belt shaft 242 has a substantially columnar shape extending in the left-right direction. A right end of the belt shaft 242 is rotatably supported at the closing wall 248, and a left end of the belt shaft 242 is rotatably supported at the upper end of the return closing plate 246.

The transport belt 243 is accommodated inside the tonner return transport chamber 277. The transport belt 243 is wound around the left end of the second auger shaft 272 and the belt shaft 242. An outer circumferential surface of the transport belt 243 includes a plurality of projections. Although described later in detail, the transport belt 243 is circumferentially moved so as to transport toner toward the front upper side through driving of the second auger shaft 272 and following movement of the belt shaft 242.

(5) Toner Cartridge

Figure 14:
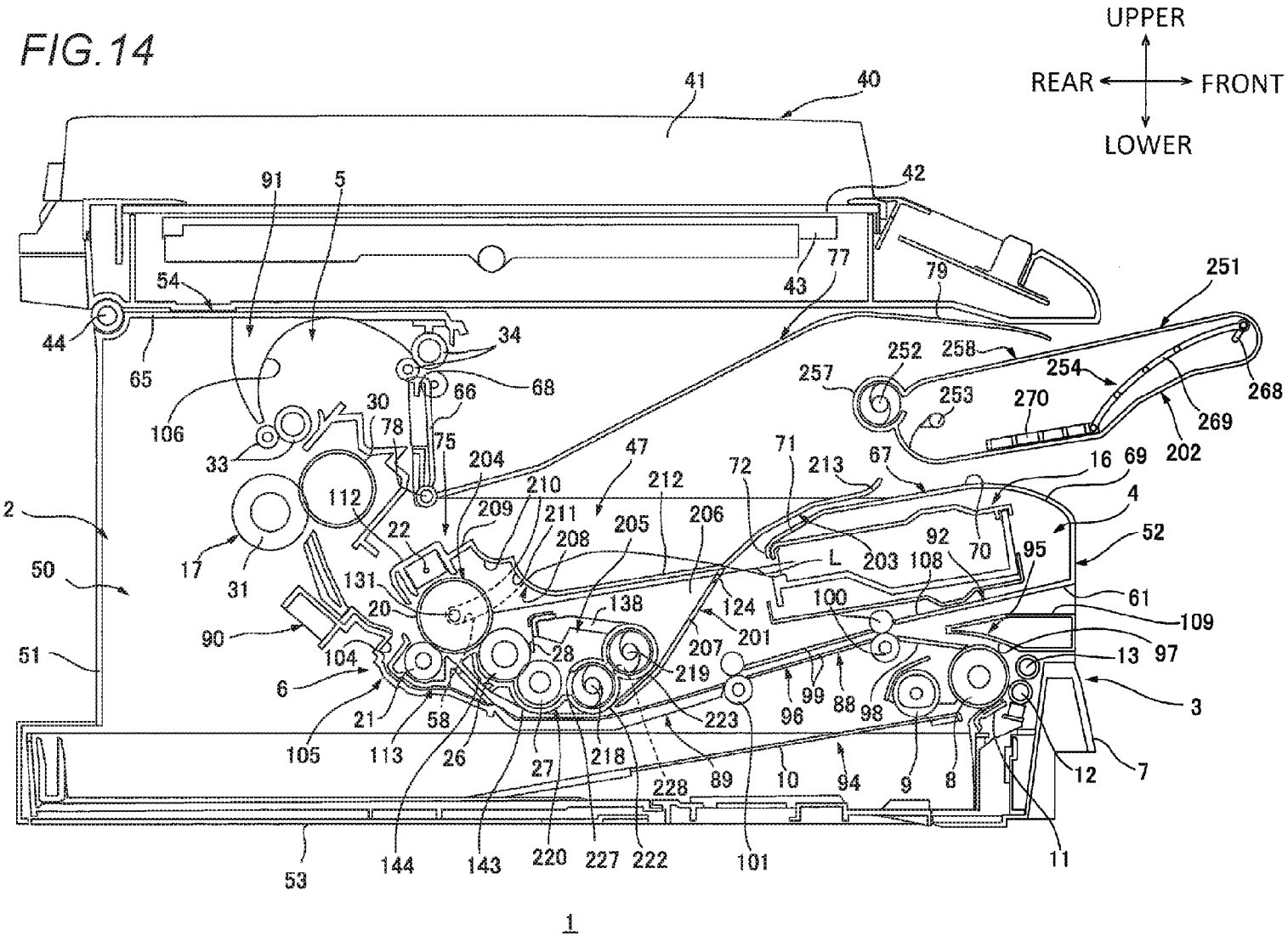
FIG. 14 is a center cross-sectional view of the printer shown in FIG. 13, and shows a state where a toner cartridge is removed from a main body casing.

The toner cartridge 202 is an upper part of the process unit 200 as shown in FIGS. 14 and 16, and is removably mounted to the process cartridge 201 (described later).

Figure 17A:
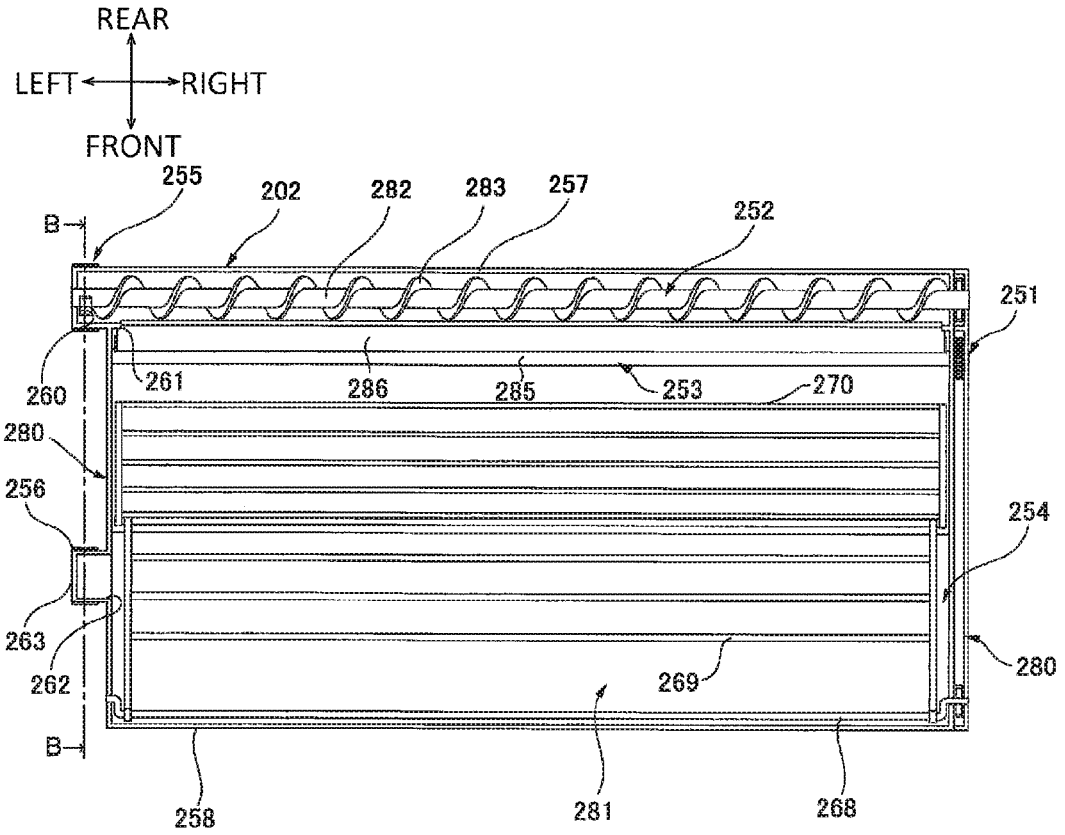
FIG. 17A is a cross-sectional view taken along a line A-A of the process unit shown in FIG. 16.

The toner cartridge 202 includes, as shown in FIGS. 16 and 17A, a cartridge frame 251, a first shutter 255, a second shutter 256, an auger member 252, an agitator 253, and an agitation member 254.

The cartridge frame 251 has a substantially box shape extending in the left-right direction, and includes the auger accommodation cylinder 257 and the toner accommodation portion 258 which are integrally formed. The auger accommodation cylinder 257 and the toner accommodation portion 258 are disposed side by side on front and rear sides, and communicate with each other via a toner passing hole 261.

The auger accommodation cylinder 257 is disposed at the rear end of the cartridge frame 251. The auger accommodation cylinder 257 has a substantially cylindrical shape extending in the left-right direction, and each of both left and right ends is closed. A dimension of the auger accommodation cylinder 257 in the left-right direction is larger than a dimension of the toner accommodation portion 258 in the left-right direction as shown in FIG. 17A. Further, a left end of the auger accommodation cylinder 257 is located on the further left side than a left end surface of the toner accommodation portion 258.

The left end of the auger accommodation cylinder 257 includes a toner ejection hole 260. As shown in FIG. 18B, the toner ejection hole 260 is disposed at a front lower end of the left end of the auger accommodation cylinder 257, and penetrates through the auger accommodation cylinder 257 in a direction which connects the front lower side to the rear upper side.

The toner accommodation portion 258 has an elliptically cylindrical shape extending in the left-right direction, and each of both left and right ends is closed. The toner accommodation portion 258 accommodates toner therein. The toner accommodation portion 258 includes an accommodation portion body 281 and a pair of accommodation portion side walls 280.

The accommodation portion body 281 has an elliptically cylindrical shape extending in the left-right direction. A lower part of the accommodation portion body 281 has a shape extending along the toner accommodation receiving portion 211 as shown in FIG. 16, and a front part of a bottom wall of the accommodation portion body 281 is curved toward the front upper side.

The pair of accommodation portion side walls 280 are respectively disposed at both left and right ends of the toner accommodation portion 258, and close both left and right ends of the accommodation portion body 281.

Of the pair of accommodation portion side walls 280, the left accommodation portion side wall 280 includes a toner return hole 262 and a reception cylinder 263 as shown in FIG. 17A. The toner return hole 262 is disposed at a substantially center of the left accommodation portion side wall 280 in the front-rear direction. The toner return hole 262 has a substantially circular shape in a side view, and penetrates through the accommodation portion side wall 280 in the left-right direction.

The reception cylinder 263 has a substantially columnar shape extending in the left-right direction, and protrudes toward the left side from a circumferential edge of the toner return hole 262 of the accommodation portion side wall 280. A left end of the reception cylinder 263 is closed.

Figure 17B:
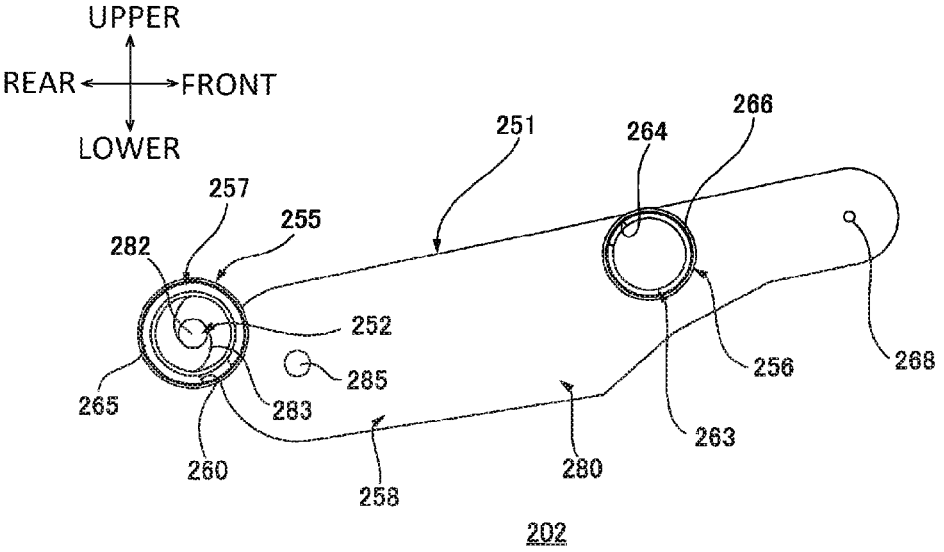
FIG. 17B is a cross-sectional view taken along a line B-B of a toner cartridge shown in FIG. 17A.

The reception cylinder 263 includes a toner return reception hole 264. The toner return reception hole 264 is disposed at a rear upper end of the reception cylinder 263 as shown in FIG. 17B, and penetrates through the reception cylinder 263 in a direction which connects the front lower side to the rear upper side.

The first shutter 255 has a substantially cylindrical shape extending in the left-right direction, and is fitted in the left end of the auger accommodation cylinder 257 from outside in a radial direction. An inner diameter of the first shutter 255 is substantially the same as an outer diameter of the auger accommodation cylinder 257.

The first shutter 255 includes a first shutter opening 265. The first shutter opening 265 penetrates through the first shutter 255 in the radial direction. The first shutter 255 is rotated along an outer circumferential surface of the auger accommodation cylinder 257 between a closed position where the toner ejection hole 260 is closed, and an open position where, as shown in FIG. 18B, the toner ejection hole 260 is opened when the first shutter opening 265 allows the toner ejection hole 260 and the auger accommodation cylinder 257 to communicate with each other in the radial direction. The first shutter 255 is disposed at the closed position at the normal time.

As shown in FIG. 17A, the second shutter 256 has a substantially cylindrical shape extending in the left-right direction, and is fitted in the reception cylinder 263 from outside in the radial direction. An inner diameter of the second shutter 256 is substantially the same as an outer diameter of the reception cylinder 263.

The second shutter 256 includes a second shutter opening 266 as shown in FIG. 17B. The second shutter opening 266 penetrates through the second shutter 256 in the radial direction. Further, the second shutter 256 is rotated along an outer circumferential surface of the reception cylinder 263 between a closed position where the toner return reception hole 264 is closed, and an open position where, as shown in FIG. 18B, the second shutter opening 266 allows the toner return reception hole 264 and the reception cylinder 263 to communicate with each other in the radial direction. The second shutter 256 is disposed at the closed position at the normal time.

The auger member 252 is disposed inside the auger accommodation cylinder 257 as shown in FIG. 17A. The auger member 252 includes an auger shaft portion 282 and a screw portion 283.

The auger shaft portion 282 has a columnar shape extending in the left-right direction. The screw portion 283 is entirely disposed on a circumferential surface of the auger shaft portion 282 and extends in a helical shape in the left-right direction. The auger member 252 is rotatably supported at the auger accommodation cylinder 257 while both left and right ends of the auger shaft portion 282 are supported at both left and right ends of the auger accommodation cylinder 257.

The agitator 253 is disposed on the front lower side of the toner passing hole 261 at the rear end in the toner accommodation portion 258 as shown in FIG. 16. The agitator 253 transports toner in the toner accommodation portion 258 to the toner passing hole 261, and includes an agitator shaft 285 and an agitation film 286.

The agitator shaft 285 has a substantially columnar shape extending in the left-right direction as shown in FIG. 17A. The agitation film 286 extends outward in the radial direction of the agitator shaft 285 from the agitator shaft 285. The agitator 253 is rotatably supported at the toner accommodation portion 258 while both left and right ends of the agitator shaft 285 are supported at the rear ends of the pair of accommodation portion side walls 280.

The agitation member 254 is disposed on the front side of the agitator 253 in the toner accommodation portion 258. The agitation member 254 agitates toner in the toner accommodation portion 258 and transports the toner rearward.

The agitation member 254 includes a swing shaft 268, a first agitation portion 269, and a second agitation portion 270.

The swing shaft 268 has a substantially columnar shape extending in the left-right direction as shown in FIG. 17A. Each of both left and right ends of the swing shaft 268 is bent in a substantially crank shape.

The first agitation portion 269 has a substantially ladder shape in a plan view, and is curved toward the front upper side in a side view as shown in FIG. 16. A front end of the first agitation portion 269 is supported at the swing shaft 268 so as to be relatively rotated.

The second agitation portion 270 has a substantially ladder shape in a plan view as shown in FIG. 17A, and extends in the front-rear direction in a side view as shown in FIG. 16. A front end of the second agitation portion 270 is connected to a rear end of the first agitation portion 269 so as to be relatively rotated.

The agitation member 254 is supported at the toner accommodation portion 258 while both left and right ends of the swing shaft 268 are supported at the front ends of the pair of accommodation portion side walls 280.

The toner cartridge 202 is mounted to the process cartridge 201. In order to mount the toner cartridge 202 to the process cartridge 201, a operator, as shown in FIG. 18B, assembles the toner cartridge 202 in the process cartridge 201 from the front upper side so that the left end of the auger accommodation cylinder 257 is received by the first reception portion 235 and the reception cylinder 263 is received by the second reception portion 240.

In the above-described manner, as shown in FIG. 16, the toner cartridge 202 is mounted to the process cartridge 201, and thus the process unit 200 is completed. At this time, the auger cylinder reception portion 210 supports the auger accommodation cylinder 257, and the toner accommodation receiving portion 211 supports the toner accommodation portion 258.

Figure 15:
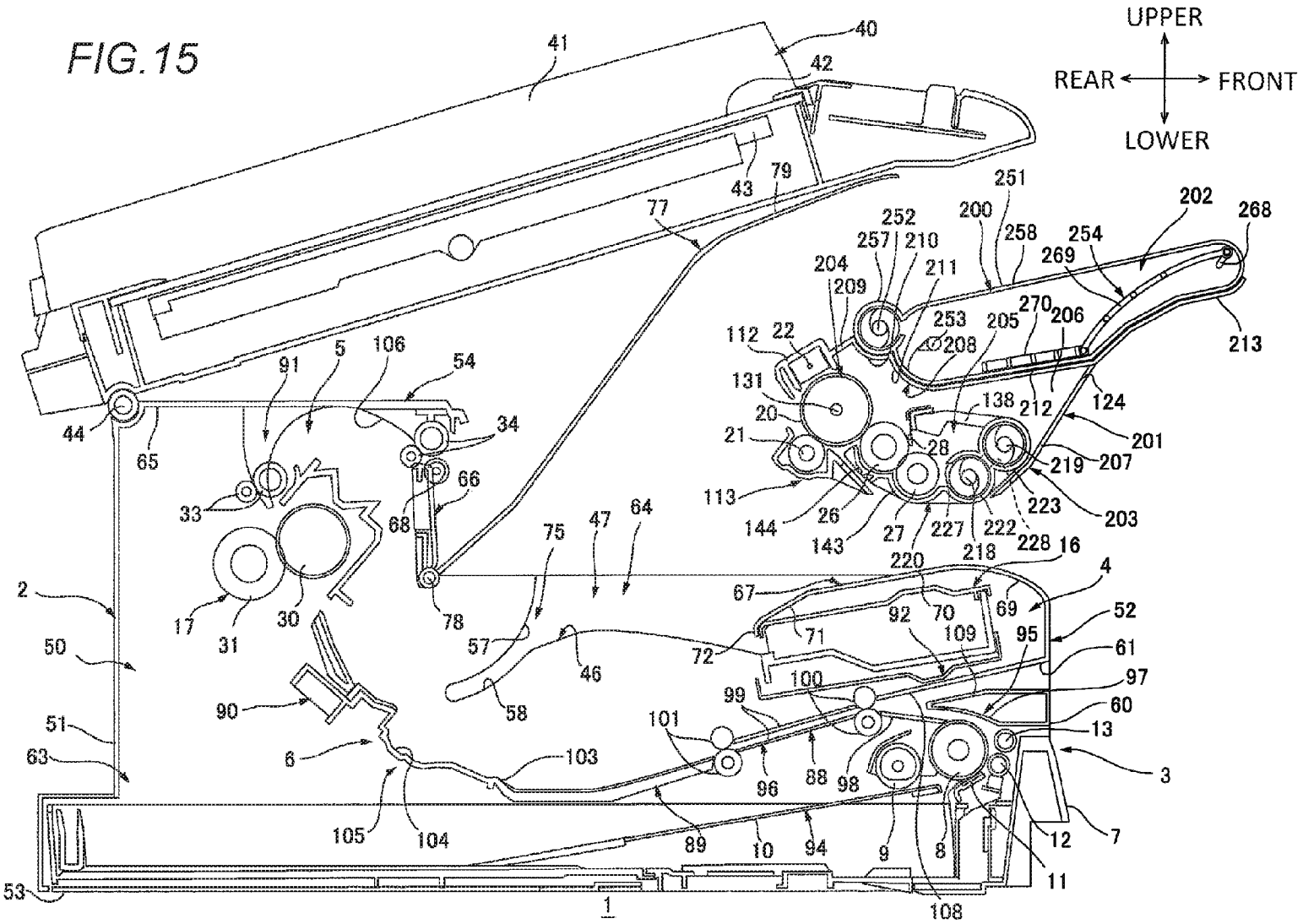
FIG. 15 is a center cross-sectional view of the printer shown in FIG. 13, and shows a state where a process unit is located at an external position.

The process unit 200 is mounted to the main body casing 2 by the operator. When the process unit 200 is mounted to the main body casing 2, as shown in FIG. 15, the operator swings the flat bed scanner 40 in the counterclockwise direction in a left side view, and also disposes the top cover 77 at the open position. Next, the operator inserts the process unit 200 into the main body casing 2 through the process opening 75.

In the above-described manner, the process unit 200 is disposed inside the main body casing 2 and is located at the internal position as shown in FIG. 13.

In a state where the process unit 200 is located at the internal position, the rear end of the roller accommodation portion 122 of the process cartridge 201 is disposed inside the recess portion 104 of the reception part 105, and the front reception portion 213 of the process cartridge 201 is disposed on the rear upper side with respect to the guide wall 71 and the inclined wall 70 of the mounting/removing guide wall 67 with an interval therebetween.

Therefore, the front end of the toner cartridge 202, specifically, the front end of the toner accommodation portion 258 overlaps the rear part of the scanner unit 16 when projected in the upper-lower direction.

Next, the operator moves the first shutter 255 from the closed position to the open position as shown in FIG. 18B. Thus, the toner ejection hole 260, the first shutter opening 265, and the toner supply reception hole 237 communicate with each other in the radial direction of the auger accommodation cylinder 257.

Further, the operator moves the second shutter 256 from the closed position to the open position, and also moves the reception portion shutter 244 from the closed position to the open position. Thus, the toner discharge hole 245, the second shutter opening 266, and the toner return reception hole 264 communicate with each other in the radial direction of the reception cylinder 263.

Successively, as shown in FIG. 13, the operator moves the top cover 77 from the open position to the closed position, and also swings the flat bed scanner 40 in the clockwise direction in a left side view.

In the above-described manner, the mounting of the process unit 200 to the main body casing 2 is completed.

In order to remove the process unit 200 from the main body casing 2, procedures are performed in a reverse order to the above-described mounting operation.

(6) Image Forming Operation in Third Illustrative Embodiment

In an image forming operation of the printer 1, the scanner unit 16 emits the laser beam L toward the surface of the photosensitive drum 20 in the rear lower direction under the control of a controller (not shown) as shown in FIG. 13. The laser beam L passes through the laser passing hole 124 of the process front wall 207, then pass under the rear reception portion 212 of the toner accommodation receiving portion 211, and exposes the front circumferential surface of the drum body 132 of the photosensitive drum 20.

That is, the toner cartridge 202 is disposed on the upper side with respect to a light path of the laser beam L, and the developing unit 205 is disposed on the lower side with respect to the light path of the laser beam L.

The laser beam L passes between the pair of process side walls 206 in the left-right direction as shown in FIG. 18A. That is, the laser beam L passes through the opposite side to the transport unit 230 with respect to the left process side wall 206. That is, the transport unit 230 is disposed on the further left side than the laser beam L with an interval therebetween.

In the image forming operation, toner is circulated between the toner cartridge 202 and the developing unit 205.

In a toner circulation operation, as shown in FIG. 13, if the agitation member 254 is rotated, the agitation member 254 agitates the toner in the toner accommodation portion 258 and causes the toner to flow rearward. Then, the agitator 253 is rotated so as to transport the toner toward the toner passing hole 261.

At this time, the toner is supplied to the auger accommodation cylinder 257 from the toner accommodation portion 258 via the toner passing hole 261 as shown in FIG. 17A. Then, the auger member 252 is rotated so that the toner supplied into the auger accommodation cylinder 257 is transported toward the left side.

Then, as shown in FIG. 18B, the toner reaches the left end of the auger accommodation cylinder 257, and falls into the supply toner transport chamber 276 due to the gravity via the toner ejection hole 260, the first shutter opening 265, and the toner supply reception hole 237. Accordingly, the toner flows up to the lower end of the supply toner transport chamber 276.

Next, the first auger 218 is rotated so as to transport the toner having reaching the lower end of the supply toner transport chamber 276 toward the right side. Thus, the toner is moved from the lower end of the supply toner transport chamber 276 to the inside of the first auger accommodation portion 222 of the developing frame 220 via the toner supply port 216.

Further, as shown in FIG. 19, the first auger 218 is rotated so as to transport the toner in the first auger accommodation portion 222 toward the right side. At this time, some portion of the toner transported by the first auger 218 is supplied to the supply roller 27 via the toner opening 227 as shown in FIG. 13.

Then, in the same manner as in the image forming operation, the supply roller 27 supplies the toner to the developing roller 26, and the developing roller 26 supplies the toner to an electrostatic latent image on the circumferential surface of the drum body 132.

On the other hand, the toner which is transported to the right end of the first auger accommodation portion 222 due to the rotation of the first auger 218 is moved from the first auger accommodation portion 222 to the second auger accommodation portion 223 via the communication hole 228 as shown in FIGS. 16 and 19.

Then, the second auger 219 is rotated so as to transport the toner in the second auger accommodation portion 223 toward the left side. Then, as shown in FIG. 18B, the toner is moved from the second auger accommodation portion 223 to the tonner return transport chamber 277 via the toner return hole 217.

Next, the transport belt 243 is circumferentially moved so as to transport the toner in the tonner return transport chamber 277 toward the front upper side. Then, the toner reaches the upper end of the tonner return transport chamber 277. Accordingly, the toner falls into the reception cylinder 263 from the tonner return transport chamber 277 via the toner discharge hole 245, the second shutter opening 266, and the toner return reception hole 264.

Next, as shown in FIG. 17A, the toner is returned to the toner accommodation portion 258 from the reception cylinder 263 via the toner return hole 262.

In the above-described manner, the toner circulation operation is performed. The toner circulation operation is continuously performed in the image forming operation of the printer 1.

Incidentally, as shown in FIG. 13, a sheet P accommodated in the sheet feed cassette 7 is transported from the sheet feed cassette 7 toward the contact point N between the drum body 132 and the transfer roller 21 and passes through the contact point N in the same manner as in the image forming operation. The sheet P on which a toner image is formed passes between the heating roller 30 and the pressing roller 31, and is then discharged to the sheet discharge tray 35 by the pair of sheet discharge rollers 34.

(7) Removing Operation of Toner Cartridge from Main Body Casing

The toner cartridge 202 can be removed from the process cartridge 201 mounted in the main body casing 2.

In order to remove the toner cartridge 202 from the process cartridge 201 mounted in the main body casing 2, first, the operator rotates the top cover 77 in the counter-clockwise direction in a left side view from the closed position, so as to secure a space through which the toner cartridge 202 passes between the cover body 79 and the mounting/removing guide wall 67.

Next, as shown in FIG. 17B, the operator moves the first shutter 255 from the open position to the closed position, and also moves the second shutter 256 from the open position to the closed position.

Then, as shown in FIG. 14, the operator pulls out the toner cartridge 202 toward the front upper side through the space between the cover body 79 and the mounting/removing guide wall 67.

Thus, the toner cartridge 202 is removed from the process cartridge 201 mounted in the main body casing 2.

(8) Operations and Effects of Third Illustrative Embodiment (8-1) The toner cartridge 202 accommodates the toner supplied to the developing frame 220 as shown in FIG. 13. Therefore, it is possible to increase an amount of toner accommodated in the process unit 200.

Further, the toner cartridge 202 is disposed on the upper side with respect to the light path of the laser beam L. Therefore, it is possible to prevent the toner cartridge 202 from interfering with exposure of the photosensitive drum 20 to the laser beam L.

As a result, it is possible to increase an amount of toner accommodated in the process unit 200 and to reliably expose the photosensitive drum 20.

Further, the toner accommodation portion 258 of the toner cartridge 202 is disposed further forward than the photosensitive drum 20, and the heating roller 30 of the fixing unit 17 is disposed further rearward than the photosensitive drum 20. Therefore, the heating roller 30 and the toner accommodation portion 258 are disposed with an interval therebetween in the front-rear direction. As a result, heat generated when the fixing unit 17 fixes a toner image onto a sheet P can be prevented from influencing toner in the toner accommodation portion 258.

(8-2) The developing unit 205 is disposed on the lower side with respect to the light path of the laser beam L as shown in FIG. 13. Therefore, it is possible to prevent the developing unit 205 from interfering with exposure of the photosensitive drum 20 by the laser beam L. The developing unit 205 is disposed on an opposite side to the toner cartridge 202 with respect to the light path of the laser beam L, and thus it is possible to ensure an efficient arrangement of the developing unit 205 and the toner cartridge 202.

(8-3) The toner cartridge 202 is removably mounted to the process cartridge 201 as shown in FIG. 14. Therefore, it is possible to improve maintenance property of the toner cartridge 202.

(8-4) The toner supply transport portion 233 transports toner from the toner cartridge 202 to the developing unit 205 as shown in FIG. 18B. Therefore, it is possible to reliably transport the toner from the toner cartridge 202 to the developing frame 220. Further, the toner supply transport portion 233 is disposed on the left side with respect to the light path of the laser beam L with an interval therebetween as shown in FIG. 18A. Therefore, it is possible to prevent the toner supply transport portion 233 from interfering with exposure of the photosensitive drum 20 by the laser beam L.

As a result, it is possible to reliably transport the toner from the toner cartridge 202 to the developing frame 220 and also to reliably expose the photosensitive drum 20.

Also, in the third illustrative embodiment, it is possible to achieve the same operations and effects as in the first illustrative embodiment.

Incidentally, in the third illustrative embodiment, the process unit 200 is an example of a process unit; the toner cartridge 202 is an example of a second developer accommodation portion; the developing frame 220 is an example of a first developer accommodation portion; and the toner supply transport portion 233 is an example of a developer transport portion.

10. Fourth Illustrative Embodiment

Figure 20:
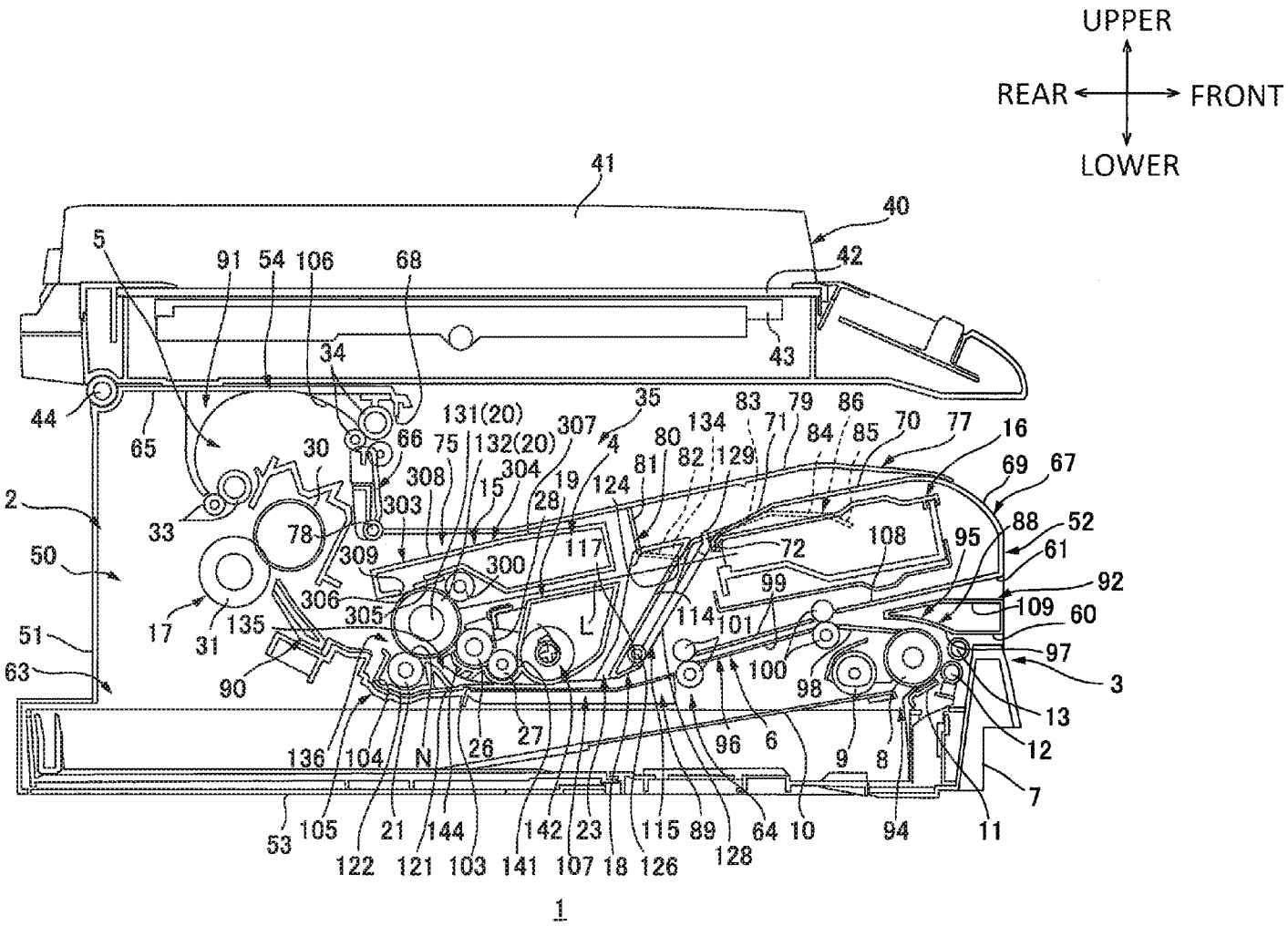
FIG. 20 is a center cross-sectional view showing a printer as an image forming apparatus according to a fourth illustrative embodiment of the present invention.

Next, with reference to FIG. 20, a fourth illustrative embodiment of the printer 1 will be described. In the fourth illustrative embodiment, the same members as in the first illustrative embodiment are given the same reference numerals, and description thereof will be omitted.

(1) Details of Process Cartridge of Fourth Illustrative Embodiment

The process cartridge 15 includes a charging roller 300 and a cleaning unit 303.

The charging roller 300 has a substantially columnar shape extending in the left-right direction, and is disposed on the front upper side with respect to the photosensitive drum 20. A rear lower end of the charging roller 300 is in contact with a front upper end of the photosensitive drum 20.

The cleaning unit 303 removes attached substances such as remaining toner attached onto the photosensitive drum 20. The cleaning unit 303 is disposed on the upper side of the photosensitive drum 20 and the developing cartridge 19. The cleaning unit 303 includes a cleaner frame 304, a cleaning blade 305, and a sheet member 306.

The cleaner frame 304 is disposed on the upper side of the developing cartridge 19 and the photosensitive drum 20. The cleaner frame 304 has a substantially box shape extending in the front-rear direction. The cleaner frame 304 includes a reservoir 307 and a collecting portion 308.

The reservoir 307 is a front part of the cleaner frame 304, and is disposed on the front upper side of the charging roller 300.

The collecting portion 308 is a rear part of the cleaner frame 304, and is disposed on the upper side of the charging roller 300 and the photosensitive drum 20. An upper surface of the collecting portion 308 is connected to an upper surface of the reservoir 307 to have a flat surface. That is, the collecting portion 308 is disposed parallel to the reservoir 307 in the front-rear direction, and communicates with the reservoir 307. A dimension of the collecting portion 308 in the upper-lower direction is smaller than a dimension of the reservoir 307 in the upper-lower direction. The collecting portion 308 includes a cleaner opening 309.

The cleaner opening 309 is disposed at a substantially center in the front-rear direction in a lower wall of the collecting portion 308, and penetrates through the lower wall of the collecting portion 308 in the upper-lower direction. The cleaner opening 309 extends in the entire lower wall of the collecting portion 308 in the left-right direction.

The cleaning blade 305 is disposed on the upper side of the photosensitive drum 20 and the lower side of the collecting portion 308. That is, the reservoir 307 is disposed further forward than the cleaning blade 305. The cleaning blade 305 has a plate shape which has a thickness in the upper-lower direction and extends in the left-right direction. A front end of the cleaning blade 305 is fixed to a front circumferential edge of the cleaner opening 309 on a lower surface of the lower wall of the collecting portion 308. A rear end of the cleaning blade 305 faces a half of the cleaner opening 309 on the front side. The rear end of the cleaning blade 305 is in contact with the upper end of the photosensitive drum 20, that is, the circumferential surface of the drum body 132.

The sheet member 306 prevents attached substances in the cleaner frame 304 which are removed from the photosensitive drum 20 from leaking out from the cleaner opening 309. The sheet member 306 is disposed at a lower end of the collecting portion 308 and on the rear side of the cleaning blade 305. The sheet member 306 is made of a flexible sheet material. A rear end of the sheet member 306 is fixed to a rear circumferential edge of the cleaner opening 309 on the lower surface of the lower wall of the collecting portion 308. A front end of the sheet member 306 faces a half of the cleaner opening 309 on the rear side. A front end of the sheet member 306 is in contact with the upper end of the photosensitive drum 20.

When an image forming operation is started and the photosensitive drum 20 is rotated, the cleaning blade 305 of the cleaning unit 303 scrapes attached substances such as remaining toner attached to the photosensitive drum 20 so that the attached substances are collected into the collecting portion 308. The attached substances collected in the collecting portion 308 are stored in the reservoir 307. That is, the reservoir 307 stores attached substances removed from the surface of the photosensitive drum 20 by the cleaning blade 305.

In the image forming operation, the scanner unit 16 emits a laser beam L toward the surface of the photosensitive drum 20 in the rear lower direction. The laser beam L passes over the developing cartridge 19 and under the cleaning unit 303, that is, passes between the developing cartridge 19 and the cleaning unit 303, and eposes the circumferential surface of the photosensitive drum 20. That is, the cleaning unit 303 is disposed on the upper side with respect to the light path of the laser beam L.

(2) Operations and Effects of Process Cartridge of Fourth Illustrative Embodiment (2-1) The cleaning unit 303 cleans attached substances from the photosensitive drum 20. Therefore, it is possible to minimize the occurrence of poor image formation due to the attached substances on the photosensitive drum 20. Further, the cleaning unit 303 is disposed on the upper side with respect to the light path of the laser beam L. As a result, it is possible to prevent the cleaning unit 303 from interfering with exposure of the photosensitive drum 20 by the laser beam L.

(2-2) The cleaning blade 305 of the cleaning unit 303 is in contact with the circumferential surface of the photosensitive drum 20. Therefore, it is possible to reliably clean attached substances from the photosensitive drum 20. Further, attached substances scraped by the cleaning blade 305 are stored in the reservoir 307 of the cleaner frame 304.

Since the reservoir 307 is disposed on the front side with respect to the cleaning blade 305, the fixing unit 17 and the photosensitive drum 20 can be disposed to be close to each other even if a size of the reservoir 307 is increased. Therefore, it is possible to reliably transport a sheet P from the photosensitive drum 20 to the fixing unit 17.

Further, the reservoir 307 is disposed further forward than the photosensitive drum 20, and the heating roller 30 of the fixing unit 17 is disposed further rearward than the photosensitive drum 20. Therefore, the heating roller 30 and the reservoir 307 are disposed with an interval therebetween in the front-rear direction. As a result, heat generated when the fixing unit 17 fixes a toner image onto a sheet P can be prevented from influencing attached substances in the reservoir 307.

Also, in the fourth illustrative embodiment, it is possible to achieve the same operations and effects as in the first illustrative embodiment.

Incidentally, in the fourth illustrative embodiment, the cleaning unit 303 is an example of a cleaning unit; the cleaning blade 305 is an example of a blade; and the reservoir 307 is an example of a reservoir.

11. Fifth Illustrative Embodiment

Figure 21:
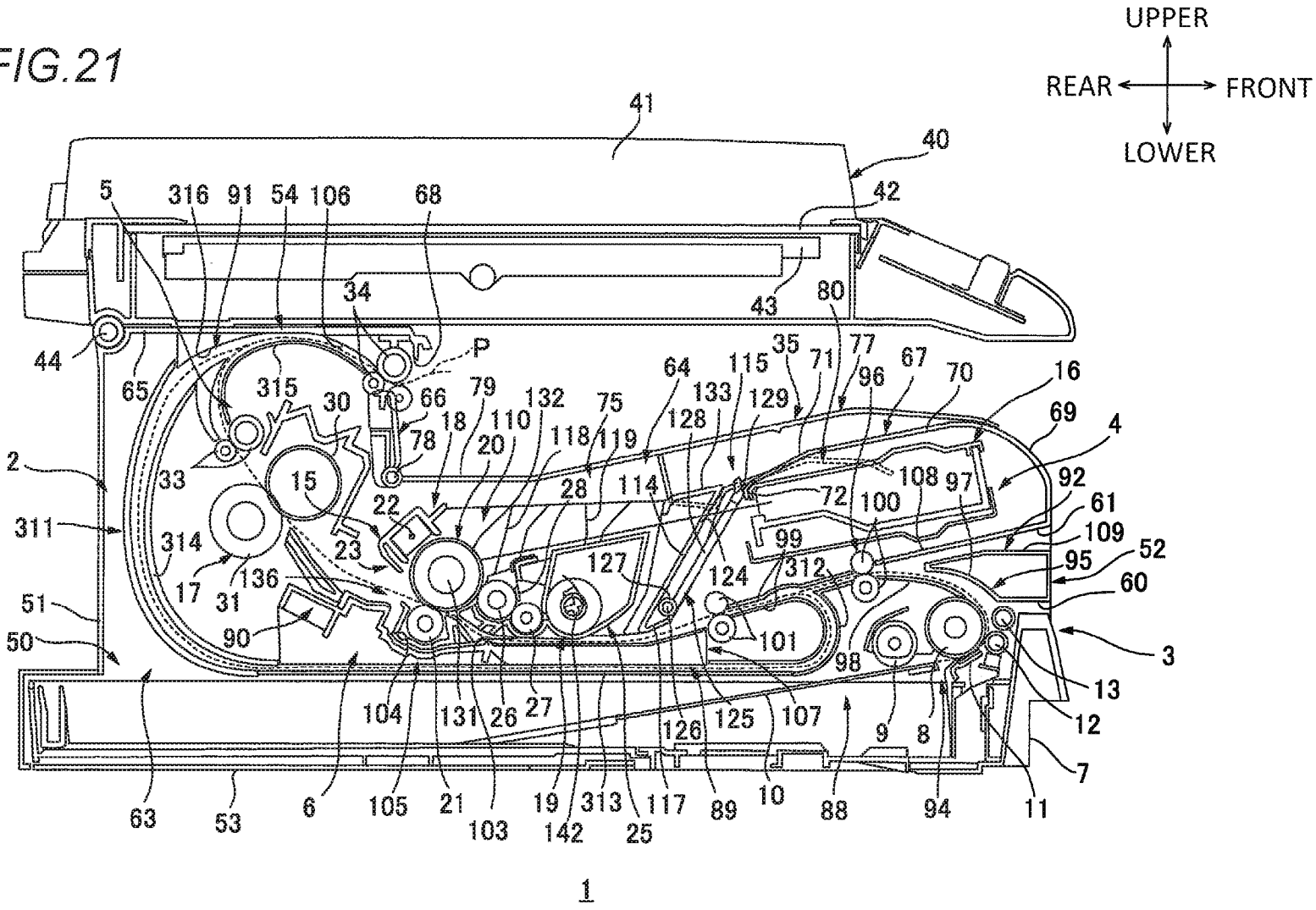
FIG. 21 is a center cross-sectional view showing a printer as an image forming apparatus according to a fifth illustrative embodiment of the present invention.

Next, with reference to FIG. 21, a fifth illustrative embodiment of the printer 1 will be described. In the fifth illustrative embodiment, the same members as in the first illustrative embodiment are given the same reference numerals, and description thereof will be omitted. Further, among operations in the fifth illustrative embodiment, the same operation in the first illustrative embodiment will not be repeated.

In the fifth illustrative embodiment of the present invention, the sheet guide section 6 includes a sixth sheet guide 311.

Although described later in detail, the sixth sheet guide 311 guides transport of a sheet P so that the sheet P reaches the inclined guide 99 from the sheet discharge rollers 34 in a duplex printing operation.

The sixth sheet guide 311 connects the downstream part 96 of the first sheet guide 88 to the concave portion 106 of the fourth sheet guide 91, and includes a first guide connection portion 312, a middle portion 313, and a fourth guide connection portion 314.

The first guide connection portion 312 has a substantially C shape which is opened rearward in a side view. An upper end of the first guide connection portion 312 is connected to a substantially center of the lower inclined guide 99 in the front-rear direction. Thus, the first guide connection portion 312 communicates with the pair of inclined guides 99.

The middle portion 313 is connected to the lower end of the first guide connection portion 312, and extends rearward. The middle portion 313 is disposed to be adjacent to the second sheet guide 89 on the lower side.

The fourth guide connection portion 314 is disposed at a rear end of the middle portion 313, and has a substantially C shape which is opened forward in a side view. A lower end of the fourth guide connection portion 314 is connected to the rear end of the middle portion 313, and an upper end of the fourth guide connection portion 314 is connected to the rear end of the fourth sheet guide 91. Thus, the fourth guide connection portion 314 communicates with the middle portion 313. Further, the fourth sheet guide 91 includes a sheet passing hole 316 and a curved plate 315.

The sheet passing hole 316 is disposed on the front side of the upper end of the fourth guide connection portion 314 at the rear end of the fourth sheet guide 91. The sheet passing hole 316 has a shape and a size which allow the sheet P to pass through the sheet passing hole 316, and penetrates through the rear end of the fourth sheet guide 91 in the front-rear direction so as to communicate with the concave portion 106. Thus, the fourth guide connection portion 314 communicates with the concave portion 106 of the fourth sheet guide 91 via the sheet passing hole 316.

The curved plate 315 has a substantially C plate shape which is opened toward the front lower side in a side view, and is curved along the concave portion 106. The curved plate 315 is disposed on the lower side with respect to the concave portion 106 with an interval therebetween. Further, a rear end of the curved plate 315 is disposed on the upper side of the front guide rollers 33, and a front end of the curved plate 315 is disposed on the rear upper side of the rear sheet discharge rollers 34.

The pair of sheet discharge rollers 34 switches its rotation between a first rotation in which the sheet P is discharged toward the sheet discharge tray 35 and a second rotation in which the sheet P is transported toward the sheet passing hole 316.

In the fifth illustrative embodiment, when images are formed on both sides of the sheet P, first, a toner image is formed on one surface of the sheet P in the same manner as in the above-described image forming operation. The sheet P is transported toward the sheet discharge tray 35 until a trailing end of the sheet P in the transport direction is located on the front of the sheet passing hole 316 of the fourth sheet guide 91.

Then, if the trailing end of the sheet P in the transport direction is disposed on the front side of the sheet passing hole 316 of the fourth sheet guide 91, the pair of sheet discharge rollers 34 switches its rotation from the first rotation to the second rotation. Thus, the pair of sheet discharge rollers 34 reverses the transport direction of the sheet P so as to transport the sheet P rearward.

Then, the sheet P enters the fourth guide connection portion 314 of the sixth sheet guide 311 through the sheet passing hole 316. The fourth guide connection portion 314, the middle portion 313, and the first guide connection portion 312 sequentially guide the sheet P.

Thus, the sheet P reaches between the pair of inclined guides 99, and is supplied between the second transport rollers 101 again. The pair of second transport rollers 101 is rotated so as to supply the sheet P to the contact point N between the drum body 132 and the transfer roller 21.

Further, when the sheet P passes through the contact point N, the transfer roller 21 transfers a toner image carried on the circumferential surface of the drum body 132 onto the other surface of the sheet P. Accordingly, the toner images are formed on both sides of the sheet P.

Then, in the same manner as the above-described image forming operation, the toner image is fixed onto the sheet P by the fixing unit 17, and then the sheet P is discharged to the sheet discharge tray 35 through the first rotation of the pair of sheet discharge rollers 34.

According to the fifth illustrative embodiment, the sheet guide section 6 includes the sixth sheet guide 311, and thus toner images can be formed on both sides of the sheet P.

Also, in the fifth illustrative embodiment, it is possible to achieve the same operations and effects as in the first illustrative embodiment.

12. Sixth Illustrative Embodiment

Figure 22:
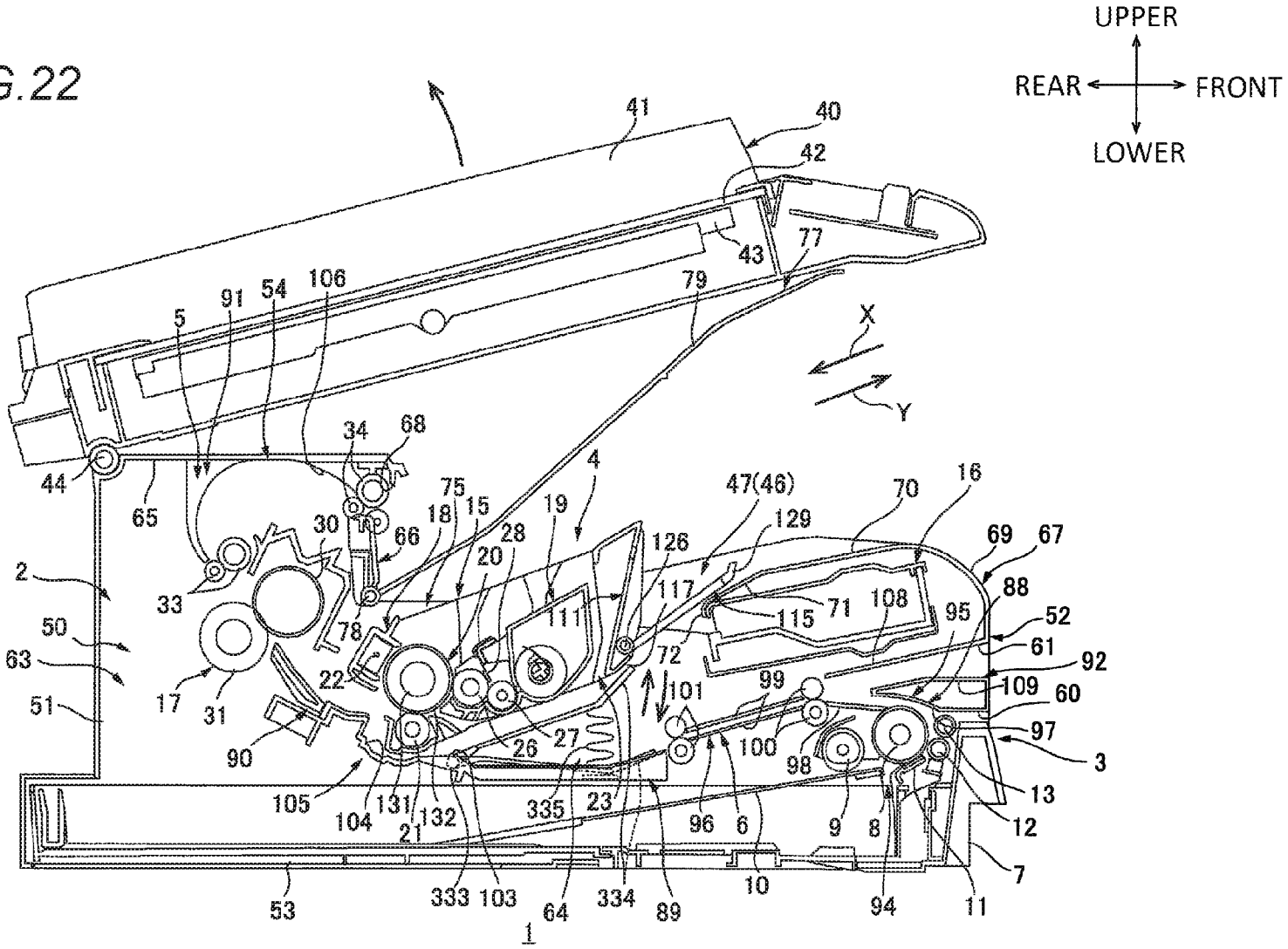
FIG. 22 is a center cross-sectional view showing a printer as an image forming apparatus according to a sixth illustrative embodiment of the present invention.

Next, with reference to FIG. 22, a sixth illustrative embodiment of the printer 1 will be described. In the sixth illustrative embodiment, the same members as in the first illustrative embodiment are given the same reference numerals, and description thereof will be omitted.

In the sixth illustrative embodiment of the present invention, the second sheet guide 89 includes a cartridge lift 331.

The cartridge lift 331 moves the process cartridge 15 between the internal position and the extraction position in interlocking with a movement of the top cover 77 between the closed position and the open position.

The cartridge lift 331 includes a lift shaft 333, lift plates 334, and a lift spring 335.

The lift shaft 333 has a substantially columnar shape extending in the left-right direction, and is rotatably supported on the lower side of the guide protrusion 103 in the second sheet guide 89.

The lift plates 334 are respectively disposed at both left and right ends of the lift shaft 333. The lift plates 334, which have a plate shape, extend outward in the radial direction from the lift shaft 333, and are then bent so as to be inclined in the counterclockwise direction in a left side view. A dimension between the two lift plates 334 in the left-right direction is larger than a dimension of the sheet P in the left-right direction.

The lift spring 335 is a compression spring extending in the upper-lower direction, and is disposed between the lift plates 334 and the second sheet guide 89.

The cartridge lift 331 can swing between a compression position indicated by a broken line where the process cartridge 15 is located at the internal position and an extended position indicated by a solid line where the process cartridge 15 is located at the extraction position, with the lift shaft 333 as a fulcrum.

When the top cover 77 is located at the closed position, the cover body 79 comes into contact with the upper end of the handle portion 133 of the process cartridge 15 so as to press the process cartridge 15 downward. Thus, the cartridge lift 331 is located at the compression position, and the process cartridge 15 is located at the internal position.

In a state where the cartridge lift 331 is located at the compression position, the lift spring 335 is compressed in the upper-lower direction, and the lift plate 334 is disposed so as to extend forward from the lift shaft 333. At this time, an upper surface at a front end of the lift plate 334 is in contact with a lower surface at both ends of the contact portion 117 of the process cartridge 15 in the left-right direction.

If the top cover 77 is moved from the closed position to the open position, the contact between the cover body 79 and the upper end of the handle portion 133 of the process cartridge 15 is released.

Accordingly, the lift plate 334 is swung in the counterclockwise direction in a left side view by a biasing force of the lift spring 335, and thus the cartridge lift 331 is moved from the compression position to the extended position. At this time, the lift plate 334 is disposed so as to extend from the lift shaft 333 toward the front upper side. Thus, the contact portion 117 of the drum front wall 111 is brought into contact with the front end of the lift plate 334 so as to be biased upward.

Then, the process cartridge 15 is moved from the internal position to the extraction position. Also, the handle 115 is moved from the accommodation position to the ejection position by the gravity in interlocking with the movement of the process cartridge 15 from the internal position to the extraction position in the same manner as described above.

Further, when the top cover 77 is moved from the open position to the closed position, the cover body 79 is brought into contact with the handle portion 133 of the process cartridge 15, and the process cartridge 15 is pressed downward according to the movement of the top cover 77.

Therefore, the front end of the lift plate 334 is brought into contact with the lower surface of the contact portion 117 of the process cartridge 15, and thus the cartridge lift 331 is swung in the clockwise direction in a left side view while resisting the biasing force of the lift spring 335, so as to be located at the compression position.

Accordingly, the process cartridge 15 is moved from the extraction position to the internal position. The handle 115 is moved from the ejection position to the accommodation position in interlocking with the movement of the process cartridge 15 from the extraction position to the internal position.

Incidentally, in the sixth illustrative embodiment, the cartridge lift 331 is an example of an interlocking mechanism.

Also, in the sixth illustrative embodiment, it is possible to achieve the same operations and effects as in the first illustrative embodiment.

13. Seventh Illustrative Embodiment

Figure 23A:
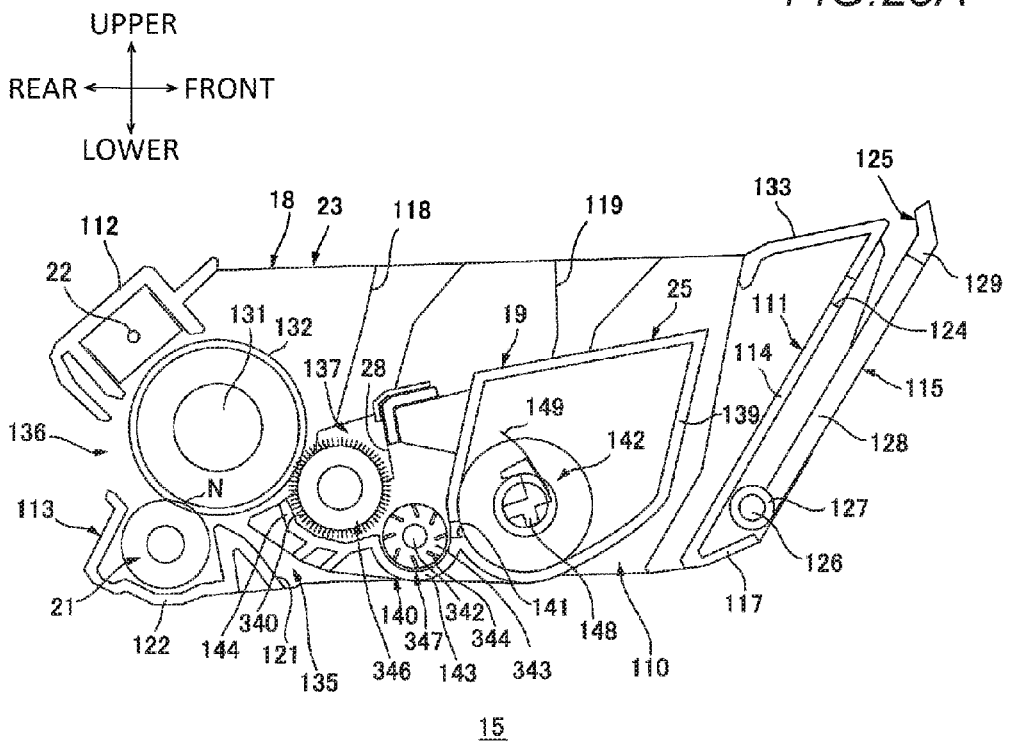
FIG. 23A is a center cross-sectional view of a process cartridge for a printer as an image forming apparatus according to a seventh illustrative embodiment of the present invention.

Next, with reference to FIG. 23A, a seventh illustrative embodiment of the printer 1 will be described. In the seventh illustrative embodiment, the same members as in the first illustrative embodiment are given the same reference numerals, and description thereof will be omitted.

The developing cartridge 19 includes a brush roller 346 and a supply member 347.

The brush roller 346 includes a brush portion 340.

The brush portion 340 is formed by a pile of nylon, polyester, or the like, and is disposed on a circumferential surface of the brush roller 346. The brush portion 340 is in contact with the photosensitive drum 20.

The supply member 347 includes a supply shaft 342, a pair of disc portions 343, and a plurality of paddle portions 344.

The supply shaft 342 has a substantially columnar shape extending in the left-right direction. Both left and right ends of the supply shaft 342 are rotatably supported at the developing frame 25.

The pair of disc portions 343 are disposed with an interval therebetween in the left-right direction. The disc portions 343 have a substantially circular plate shape in a side view.

The disc portions 343 are respectively disposed at both left and right ends of the supply shaft 342 so as to share a center axis line with the supply shaft 342. The disc portions 343 are disposed inward in the left-right direction with respect to the corresponding developing side walls 137 with an interval therebetween.

Each of the plurality of paddle portions 344 has a plate shape extending in the left-right direction, and is disposed so as to connect the pair of disc portions 343 to each other. Each of the paddle portions 344 extends so as to intersect the radial direction of the supply shaft 342 in a side view. Thus, the pair of disc portions 343 and the plurality of paddle portions 344 substantially configure an impeller.

The supply member 347 is rotatably supported at the developing frame 25 while both left and right ends of the supply shaft 342 are supported at the pair of developing side walls 137.

In an image forming operation, the supply member 347 sweeps out toner which is supplied from the agitator 142, with the plurality of paddle portions 344, so as to supply the toner to the brush roller 346. The layer thickness regulation blade 28 scrapes off the toner carried on the brush portion 340 of the brush roller 346 through a rotation of the brush roller 346. Thus, the brush roller 346 carries a constant amount of toner.

Also, in the above-described manner, a toner image can be formed on the sheet P in the same manner as in the first illustrative embodiment. Further, also in the seventh illustrative embodiment, it is possible to achieve the same operations and effects as in the first illustrative embodiment.

Incidentally, in the seventh illustrative embodiment, the brush roller 346 is an example of a developer carrier.

14. Eighth Illustrative Embodiment

Figure 23B:
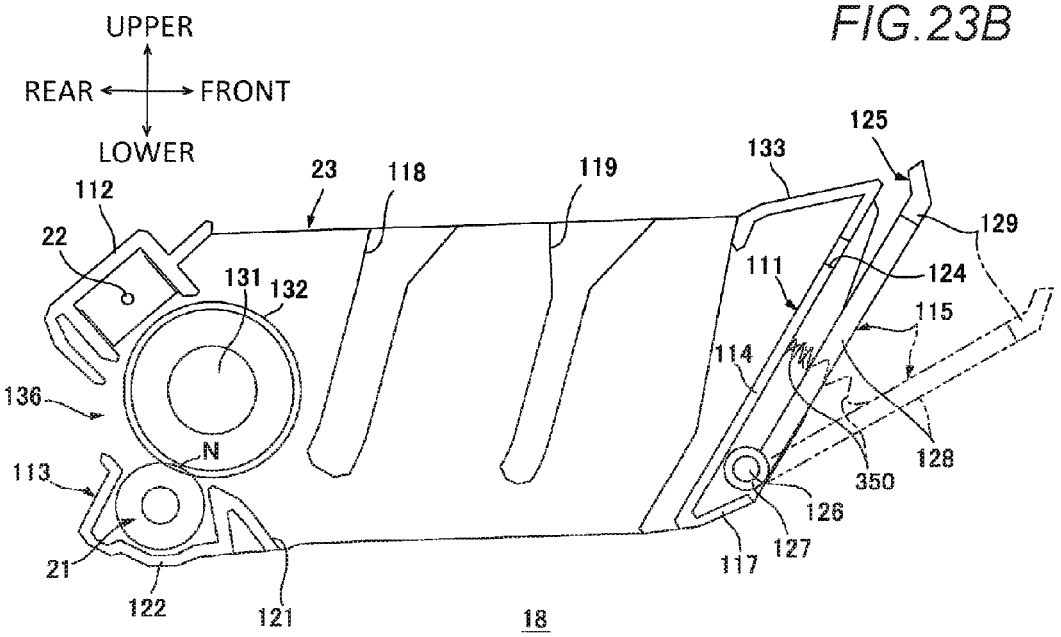
FIG. 23B is a center cross-sectional view of a drum cartridge for a printer as an image forming apparatus according to an eighth illustrative embodiment of the present invention.

Next, with reference to FIG. 23B, an eighth illustrative embodiment of the printer 1 will be described. In the eighth illustrative embodiment, the same members as in the first illustrative embodiment are given the same reference numerals, and description thereof will be omitted.

The drum cartridge 18 of the process cartridge 15 includes a handle spring 350.

The handle spring 350 is a compression spring extending in a direction which connects the front lower side to the rear upper side, and is disposed between each of the pair of connection portions 128 and the front wall body 114 of the drum front wall 111.

Thus, the handle 115 is biased toward the front lower side at the normal time.

Therefore, the handle 115 is reliably moved from the accommodation position to the ejection position by a biasing force of the handle spring 350.

Also, in the eighth illustrative embodiment, it is possible to achieve the same operations and effects as in the first illustrative embodiment.

While the present invention has been shown and described with reference to certain illustrative embodiments thereof, it will be understood by those skilled in the art that various changes in form and details may be made therein without departing from the spirit and scope of the invention as defined by the appended claims.

For example, the above-described first to eighth illustrative embodiments may be arbitrary combined.

What is claimed is:

1. An image forming apparatus comprising:

a casing;

an image forming unit that is configured to form an image on a sheet at an image forming position, the image forming unit including a toner accommodation portion that accommodates toner;

a sheet feed cassette that is disposed at a lower part of the casing and accommodates a stack of sheets including the sheet;

a pickup roller that feeds the sheet from the sheet feed cassette in a first direction;

a separation member that is arranged at a position separated from the pickup roller in the first direction and separates the sheet fed from the pickup roller from the stack of sheets;

a sheet conveying path along which the sheet passed through the separation member is conveyed to a second direction that is opposite the first direction, the sheet conveying path passing between the toner accommodation portion and the sheet feed cassette; and a sheet discharge path along which the sheet on which the image is formed by the image forming unit is conveyed and discharged from the casing, wherein the toner accommodation portion of the image forming unit is arranged at a first position in a first height range from a bottom of the casing, wherein the pickup roller is arranged at a second position in a second height range from the bottom of the casing, and wherein the first height range and the second height range at least partially overlap one another.

2. The apparatus according to claim 1, wherein the separation member includes a sheet feed pad having a plate shape.

3. The apparatus according to claim 1 further comprising:

a scanner unit that emits a beam toward the image forming unit and is arranged at a third position in a third height range from the bottom of the casing, wherein the image forming unit includes a photosensitive drum on which an electrostatic latent image is formed by being scanned by the beam emitted from the scanner unit, and wherein the first height range and the third height range at least partially overlap one another.

4. The apparatus according to claim 3, wherein the third position at which the scanner unit is arranged is located above the second position at which the pickup roller is arranged.

5. The apparatus according to claim 3, further comprising:

a conveying roller that conveys the sheet in the second direction along the sheet conveying path, the conveying roller being arranged at a fourth position in a fourth height range from the bottom of the casing, wherein the first height range and the fourth height range at least partially overlap one another.

6. The apparatus according to claim 1, wherein the image forming unit includes a process cartridge having a bottom face that serves as a part of the sheet conveying path.

7. The apparatus according to claim 1, wherein the sheet conveying path is configured to have a highest position near the pickup roller.

8. An image forming apparatus comprising:

a casing;

an image forming unit that is configured to form an image on a sheet at an image forming position, the image forming unit including a toner accommodation portion that accommodates toner;

a sheet feed cassette that is disposed at a lower part of the casing and accommodates a stack of sheets including the sheet;

a pickup roller that feeds the sheet from the sheet feed cassette in a first direction;

a separation member that is arranged at a position separated from the pickup roller in the first direction and separates the sheet fed from the pickup roller from the stack of sheets;

a sheet conveying path along which the sheet passed through the separation member is conveyed to a second direction that is opposite the first direction; and a sheet discharge path along which the sheet on which the image is formed by the image forming unit is conveyed and discharged from the casing, wherein the toner accommodation portion of the image forming unit is arranged at a first position in a first height range from a bottom of the casing, wherein the pickup roller is arranged at a second position in a second height range from the bottom of the casing, wherein the first height range and the second height range at least partially overlap one another, and wherein the sheet feed cassette is detachable from the casing in the first direction.

9. An image forming apparatus comprising:

a casing;

an image forming unit that is configured to form an image on a sheet at an image forming position, the image forming unit including a toner accommodation portion that accommodates toner and a process cartridge;

a sheet feed cassette that is disposed at a lower part of the casing and accommodates a stack of sheets including the sheet;

a pickup roller that feeds the sheet from the sheet feed cassette in a first direction;

a separation member that is arranged at a position separated from the pickup roller in the first direction and separates the sheet fed from the pickup roller from the stack of sheets;

a sheet conveying path along which the sheet passed through the separation member is conveyed to a second direction that is opposite the first direction, a bottom face of the process cartridge serving as a part of the sheet conveying path; and a sheet discharge path along which the sheet on which the image is formed by the image forming unit is conveyed and discharged from the casing, wherein the toner accommodation portion of the image forming unit is arranged at a first position in a first height range from a bottom of the casing, wherein the pickup roller is arranged at a second position in a second height range from the bottom of the casing, wherein the first height range and the second height range at least partially overlap one another, and wherein the sheet conveying path is configured to have a lowermost position at the bottom face of the process cartridge.

10. An image forming apparatus comprising:

a casing;

an image forming unit that is configured to form an image on a sheet at an image forming position, the image forming unit including a toner accommodation portion that accommodates toner;

a sheet feed cassette that is disposed at a lower part of the casing and accommodates a stack of sheets including the sheet;

a pickup roller that feeds the sheet from the sheet feed cassette in a first direction;

a separation member that is arranged at a position separated from the pickup roller in the first direction and separates the sheet fed from the pickup roller from the stack of sheets;

a sheet conveying path along which the sheet passed through the separation member is conveyed to a second direction that is opposite the first direction, the sheet conveying path passing between the toner accommodation portion and the sheet feed cassette; and a sheet discharge path along which the sheet on which the image is formed by the image forming unit is conveyed and discharged from the casing, wherein the image forming unit and the pickup roller are arranged at positions where at least a part of the toner accommodation portion overlaps the pickup roller when viewed in horizontal direction.

11. The apparatus according to claim 10, wherein the separation member includes a sheet feed pad having a plate shape.

12. The apparatus according to claim 10 further comprising:

a conveying roller that conveys the sheet in the second direction along the sheet conveying path, wherein the toner accommodation portion of the image forming unit and the conveying roller are arranged at positions where at least a part of the toner accommodation portion overlaps the conveying roller when viewed in horizontal direction.

13. An image forming apparatus comprising:

a casing;

an image forming unit that is configured to form an image on a sheet at an image forming position, the image forming unit including a toner accommodation portion that accommodates toner;

a sheet feed cassette that is disposed at a lower part of the casing and accommodates a stack of sheets including the sheet;

a pickup roller that feeds the sheet from the sheet feed cassette in a first direction;

a separation member that is arranged at a position separated from the pickup roller in the first direction and separates the sheet fed from the pickup roller from the stack of sheets;

a sheet conveying path along which the sheet passed through the separation member is conveyed to a second direction that is opposite the first direction;

a sheet discharge path along which the sheet on which the image is formed by the image forming unit is conveyed and discharged from the casing; and a scanner unit that emits a beam toward the image forming unit, wherein the image forming unit and the pickup roller are arranged at positions where at least a part of the toner accommodation portion overlaps the pickup roller when viewed in horizontal direction, wherein the image forming unit includes a photosensitive drum on which an electrostatic latent image is formed by being scanned by the beam emitted from the scanner unit, and wherein the toner accommodation portion of the image forming unit and the scanner unit are arranged at positions where at least a part of the toner accommodation portion overlaps the scanner unit when viewed in horizontal direction.

14. The apparatus according to claim 13, wherein the scanner unit is located above the pickup roller.

15. An image forming apparatus comprising:

a casing;

an image forming unit that is configured to form an image on a sheet at an image forming position, the image forming unit including a toner accommodation portion that accommodates toner;

a sheet feed cassette that is disposed at a lower part of the casing and accommodates a stack of sheets including the sheet;

a pickup roller that feeds the sheet from the sheet feed cassette in a first direction;

a separation member that is arranged at a position separated from the pickup roller in the first direction and separates the sheet fed from the pickup roller from the stack of sheets;

a sheet conveying path along which the sheet passed through the separation member is conveyed to a second direction that is opposite the first direction; and a sheet discharge path along which the sheet on which the image is formed by the image forming unit is conveyed and discharged from the casing, wherein the image forming unit and the pickup roller are arranged at positions where at least a part of the toner accommodation portion overlaps the pickup roller when viewed in horizontal direction, and wherein the sheet feed cassette is detachable from the casing in the first direction.

16. The apparatus according to claim 15, wherein the image forming unit includes a process cartridge having a bottom face that serves as a part of the sheet conveying path.

17. The apparatus according to claim 16, wherein the sheet conveying path is configured to have a lowermost position at the bottom face of the process cartridge.

18. The apparatus according to claim 15, wherein the sheet conveying path is configured to have a highest position near the pickup roller.

* * * * *